US008220792B2

(12) United States Patent
Kojima et al.

(10) Patent No.: US 8,220,792 B2
(45) Date of Patent: Jul. 17, 2012

(54) SHEET TRANSPORT APPARATUS

(75) Inventors: Noriyuki Kojima, Noda (JP); Shigeaki Kurihara, Noda (JP); Hidenobu Tsurunaga, Noda (JP)

(73) Assignee: Komori Corporation, Tokyo (JP)

( * ) Notice: Subject to any disclaimer, the term of this patent is extended or adjusted under 35 U.S.C. 154(b) by 70 days.

(21) Appl. No.: 12/671,854

(22) PCT Filed: Aug. 1, 2008

(86) PCT No.: PCT/JP2008/063896

§ 371 (c)(1),
(2), (4) Date: Mar. 22, 2010

(87) PCT Pub. No.: WO2009/020076

PCT Pub. Date: Feb. 12, 2009

(65) Prior Publication Data

US 2011/0237415 A1 Sep. 29, 2011

(30) Foreign Application Priority Data

Aug. 3, 2007 (JP) ..... 2007-203661

(51) Int. Cl.
*B41L 43/00* (2006.01)

(52) U.S. Cl. ..... 270/47; 270/48; 270/51

(58) Field of Classification Search ..... 270/6, 7, 270/10, 12, 13, 14, 15, 19, 43, 44, 47, 48, 270/51, 52.07, 52.08, 52.09; 271/82, 85; 74/567, 569

See application file for complete search history.

(56) References Cited

U.S. PATENT DOCUMENTS 2,435,881 A * 2/1948 Facber ..... 493/30
3,459,421 A * 8/1969 Motter ..... 271/279
3,521,878 A 7/1970 Bolza-Schunemann
5,065,993 A * 11/1991 Reponty ..... 270/49
5,096,174 A * 3/1992 Nishihara ..... 270/47
5,287,805 A 2/1994 Fischer et al.
5,697,881 A 12/1997 Nishihara

FOREIGN PATENT DOCUMENTS

JP 62-70172 A 3/1987
JP 2566265 B2 10/1996
JP 2002-60128 A 2/2002

OTHER PUBLICATIONS

Extended European Search Report mailed Nov. 21, 2011.

* cited by examiner

*Primary Examiner* — Leslie A Nicholson, III
(74) *Attorney, Agent, or Firm* — Birch, Stewart, Kolasch & Birch, LLP

(57) ABSTRACT

For effective achievement of an increase in productivity, prolongation of the life cycle of a consumable part, a decrease in the running cost, a lighter burden on the operator's work, and a reduction in spending on plants and equipment, a sheet transport apparatus comprises: a folding cylinder (11) for transporting sheets one by one or as a stack of a plurality of the sheets; a jaw cylinder (12) or a reduction cylinder (13) for holding the sheets by alternate ones of holding means and transporting the sheets when the sheets are transported as the stack of the plurality of sheets; an upper transfer cylinder (14) opposing the jaw cylinder or the reduction cylinder; a lower transfer cylinder (15) opposing the jaw cylinder or the reduction cylinder; and switching means for transporting the sheets from the jaw cylinder or the reduction cylinder to the upper transfer cylinder and the lower transfer cylinder, while allocating the sheets to the upper transfer cylinder and the lower transfer cylinder, when the sheets are transported as the stack of the plurality of sheets.

12 Claims, 39 Drawing Sheets

SHEET TRANSPORT APPARATUS

TECHNICAL FIELD

This invention relates to a sheet transport apparatus in a folder or the like of a web rotary printing press.

BACKGROUND ART

In a folder of a web rotary printing press, it is common practice to switch folding specifications such as folding in a collect run mode or collect folding (folding in a gathered or stacked state), or folding in a non-collect run mode or non-collect folding (folding in an ungathered or unstacked state), or to switch transport paths during non-collect folding, as in parallel folding two-stage delivery (upper-lower two-stage delivery) or parallel folding merge delivery (upper one-stage delivery) (see Patent Document 1, etc.).

Patent Document 1: JP-A-2002-60128

DISCLOSURE OF THE INVENTION

Problems to be solved by the invention

During the above-mentioned collect folding, however, it has been general practice to adopt a manner of delivery, such as delivery in only one stage of two-stage delivery.

If only one stage delivery is prevalent, therefore, consumable parts, such as transport belts, are consumed early in only one stage, and the consumable parts have to be replaced for one stage at a time, thus increasing the total number of replacements. If only one stage is replaced, the state of two-stage delivery may change according to a difference in the state of the transport belt or the like during two-stage delivery, so that readjustment may be needed. In order to prevent these disadvantages, moreover, a wasteful operation, such as replacement for both of the two stages at the time of one-stage replacement, is performed.

Thus, there have been problems, such as decreased productivity, shortened life cycles of the consumable parts, increased running cost, and heavier burden on the operator's work. If only one stage is frequently used as above when signatures delivered from the folder are piled by a post-treatment apparatus such as a stacker-bundler, the same situation as mentioned above occurs to the post-treatment apparatus such as the stacker-bundler. Furthermore, if only one stage is available, a higher piling capacity is required of one post-treatment apparatus such as stacker-bundler. Thus, a high performance post-treatment apparatus such as stacker-bundler is required, leading to increased spending on plants and equipment. This is more remarkable in accomplishing the high operating speed of the machine.

It is an object of the present invention to provide a sheet transport apparatus which effectively achieve an increase in productivity, prolongation of the life cycle of a consumable part, a decrease in the running cost, a lighter burden on the operator's work, and a reduction in spending on plants and equipment.

Means for Solving the Problems

A sheet transport apparatus according to the present invention, intended for solving the above problems, comprises:

a folding cylinder for transporting sheets one by one or as a stack of a plurality of the sheets;

a first transport cylinder having first holding means, which holds the sheet, at a plurality of locations in a circumferential direction, and being adapted to hold the sheets by alternate ones of the first holding means and transport the sheets when the sheets are transported as the stack of the plurality of sheets;

a second transport cylinder opposing the first transport cylinder, having second holding means, which holds the sheet, at a plurality of locations in a circumferential direction, and being supported rotatably;

a third transport cylinder opposing the first transport cylinder, having third holding means, which holds the sheet, at a plurality of locations in a circumferential direction, and being supported rotatably; and switching means for switching transport paths so as to transport the stack of the plurality of sheets from the first transport cylinder to the second transport cylinder and from the first transport cylinder to the third transport cylinder, while allocating the sheets to the second transport cylinder and to the third transport cylinder.

The sheet transport apparatus is characterized in that the switching means switches the transport paths so as to transport the stack of the plurality of sheets from the first transport cylinder to one of the second transport cylinder and the third transport cylinder.

The sheet transport apparatus is also characterized in that the switching means switches the transport paths so as to transport the sheets, transported one by one, from the first transport cylinder to the second transport cylinder and from the first transport cylinder to the third transport cylinder, while allocating the sheets to the second transport cylinder and to the third transport cylinder.

The sheet transport apparatus is also characterized in that the switching means switches the transport paths so as to transport the sheets, transported one by one, from the first transport cylinder to one of the second transport cylinder and the third transport cylinder.

The sheet transport apparatus is also characterized in that the first transport cylinder comprises a sextuple-diameter cylinder having the first holding means at six locations, the second transport cylinder comprises a quadruple-diameter cylinder having the second holding means at two locations, and the third transport cylinder is provided downstream, in a rotating direction of the first transport cylinder, of an opposing position where the first transport cylinder and the second transport cylinder oppose, and comprises a quadruple-diameter cylinder having the third holding means at two locations.

The sheet transport apparatus is also characterized in that the first transport cylinder includes:

a first fixed cam for operating one set of the alternately arranged first holding means of the first holding means to transport the sheets, transported one by one, to the second transport cylinder;

a rotating cam for operating alternate ones of other set of the first holding means arranged between the one set of the first holding means to transport the sheets, transported as the stack of the plurality of sheets, to the second transport cylinder, the rotating cam rotating at a speed 1.5 times a speed of the first transport cylinder;

a second fixed cam for operating the other set of the first holding means to transport the sheets, transported one by one or as the stack of the plurality of sheets, to the third transport cylinder; and a phase switching mechanism for switching the second holding means between a position where the second holding means oppose the one set of the first holding means and a position where the second holding means oppose the other set of the first holding means.

The sheet transport apparatus is also characterized in that the second transport cylinder includes:

a third fixed cam for operating the second holding means so as to transport the sheets transported from the one set of the first holding means operated by the first fixed cam, and for operating the second holding means so as to transport the sheets, transported as the stack of the plurality of sheets, from the other set of the first holding means operated by the rotating cam; and a moving cam for preventing the second holding means from making a receiving motion for the stack of the plurality of sheets held by the first holding means of the other set of the first holding means not operated by the rotating cam, and the third transport cylinder includes a fourth fixed cam for operating the third holding means which transports the sheets, transported one by one or as the stack of the plurality of sheets, from the other set of the first holding means operated by the second fixed cam.

The sheet transport apparatus is also characterized in that the first transport cylinder comprises a quadruple-diameter cylinder having the first holding means at four locations, the second transport cylinder comprises a quadruple-diameter cylinder having the second holding means at four locations, and the third transport cylinder is provided downstream, in a rotating direction of the first transport cylinder, of an opposing position where the first transport cylinder and the second transport cylinder oppose, and comprises a quadruple-diameter cylinder having the third holding means at two locations.

The sheet transport apparatus is also characterized in that the first transport cylinder includes:

a first fixed cam for operating other set of the alternately arranged first holding means of the first holding means to transport the sheets, transported one by one or as the stack of the plurality of sheets, to the second transport cylinder;

a movable second pivoting cam for operating alternate ones of the other set of the first holding means to transport the sheets, transported one by one or as the stack of the plurality of sheets, to the third transport cylinder;

a movable first pivoting cam and a second fixed cam for operating one set of the first holding means arranged between the other set of the first holding means to transport the sheets, transported one by one, to the second transport cylinder or to the third transport cylinder; and a phase switching mechanism for switching the third holding means between a position where the third holding means oppose the one set of the first holding means and a position where the third holding means oppose the other set of the first holding means.

The sheet transport apparatus is also characterized in that the second transport cylinder operates the second holding means so as to transport the sheets, transported one by one or as the stack of the plurality of sheets, from the other set of the first holding means operated by the first fixed cam, and operates the second holding means so as to transport the sheets, transported one by one, from the one set of the first holding means operated by the first pivoting cam; and the third transport cylinder operates the third holding means so as to transport the sheets, transported as the stack of the plurality of sheets, from the alternate ones of the other set of the first holding means operated by the second pivoting cam, and operates the third holding means so as to transport the sheets, transported one by one, from the one set of the first holding means operated by the first pivoting cam.

The sheet transport apparatus is also characterized in that the first holding means of the first transport cylinder comprise at least two of one set of the first holding means for holding the sheets transported one by one, and at least two of other set of the first holding means, provided between the one set of the first holding means, for holding the sheets transported one by one and the sheets transported as the stack of the plurality of the sheets, and the switching means comprises a pivoting cam for operating alternate ones of the other set of the first holding means, upon pivoting, to make a transfer motion from the other set of the first holding means for holding the sheets transported as the stack of the plurality of the sheets, to the second holding means of the second transfer cylinder, and a fixed cam for making a transfer motion from the first holding means of the other set of the first holding means, which have not been operated by the pivoting cam, to the third holding means of the third transport cylinder past the second holding means of the second transport cylinder.

The sheet transport apparatus is also characterized in that the first holding means of the first transport cylinder comprise at least two of one set of the first holding means for holding the sheets transported one by one, and at least two of other set of the first holding means, provided between the one set of the first holding means, for holding the sheets transported one by one and the sheets transported as the stack of the plurality of the sheets, and the switching means comprises a fixed cam for making a transfer motion from the other set of the first holding means for holding the sheets, transported as the stack of the plurality of the sheets, to the second holding means of the second transfer cylinder, and a pivoting cam for making a transfer motion from the other set of the first holding means to the third holding means of the third transport cylinder past the second holding means of the second transport cylinder by operating alternate ones of the sheets transported as the stack of the plurality of the sheets which are subjected to the transfer motion from the other set of the first holding means to the second holding means of the second transport cylinder by the fixed cam.

Effects of the Invention

According to the features of the preset invention, two-stage allocating delivery in collect folding can be performed, and an increase in productivity, prolongation of the life cycle of a consumable part, a decrease in the running cost, a lighter burden on the operator's work, and a reduction in spending on plants and equipment can be achieved effectively.

That is, two-stage allocating delivery in collect folding equalizes the mechanical states in the two stages, facilitates agreement between the states in the two stages, and results in comparable consumption of consumable parts. Thus, the number of replacements can be decreased. Wasteful replacement of parts before expiration of their lives can also be avoided. The same effects as mentioned above can be expected of a post-treatment apparatus such as the stacker-bundler. Furthermore, the piling capacity of the post-treatment apparatus such as the stacker-bundler doubles. Thus, a high performance post-treatment apparatus such as a stacker-bundler is not necessary any more, leading to the increased operating speed of the machine.

DESCRIPTION OF THE NUMERALS AND SYMBOLS

Figure 1:
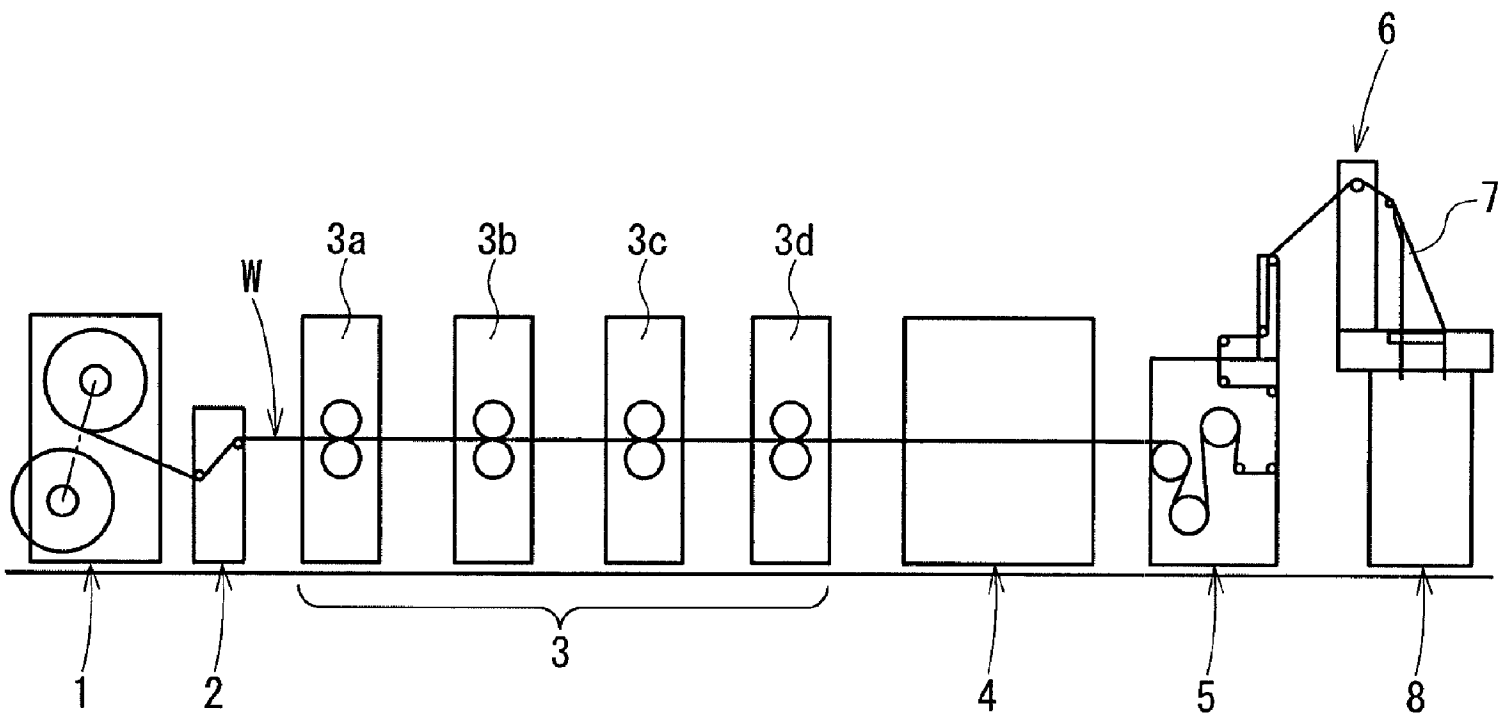
FIG. 1 is a schematic configurational drawing of a web rotary printing press showing Embodiment 1 of the present invention.

10 Collecting and cutting cylinder
11 Folding cylinder
12 Jaw cylinder (first transport cylinder)
13 Reduction cylinder (first transport cylinder)
14 Upper transfer cylinder (second transport cylinder)
15 Lower transfer cylinder (third transport cylinder)
23 Pin cam
30A Clutch
30B Clutch
34 Air cylinder
45 Sucker blade cam
50 Pin main cam
52 Pin sub-cam
53 Air cylinder
59 Gripping main cam
61 Gripping sub-cam
62 Air cylinder
67 Gripper main cam (switching means)
68 Gripper rotating cam (switching means)
69 Gripper cam (switching means)
75 Air cylinder (switching means)
83 Gripper main cam (switching means)
94 Gripper main cam (switching means)
96 Gripper sub-cam (switching means)
97 Air cylinder (switching means)
102 Harmonic gear drive device
120 Cam mechanism
123 First main cam

125 First sub-cam
128 Second main cam
132 Second sub-cam

BEST MODE FOR CARRYING OUT THE INVENTION

The sheet transport apparatus according to the present invention will be described in detail by the following embodiments with the use of the accompanying drawings.

Embodiment 1

Figure 2:
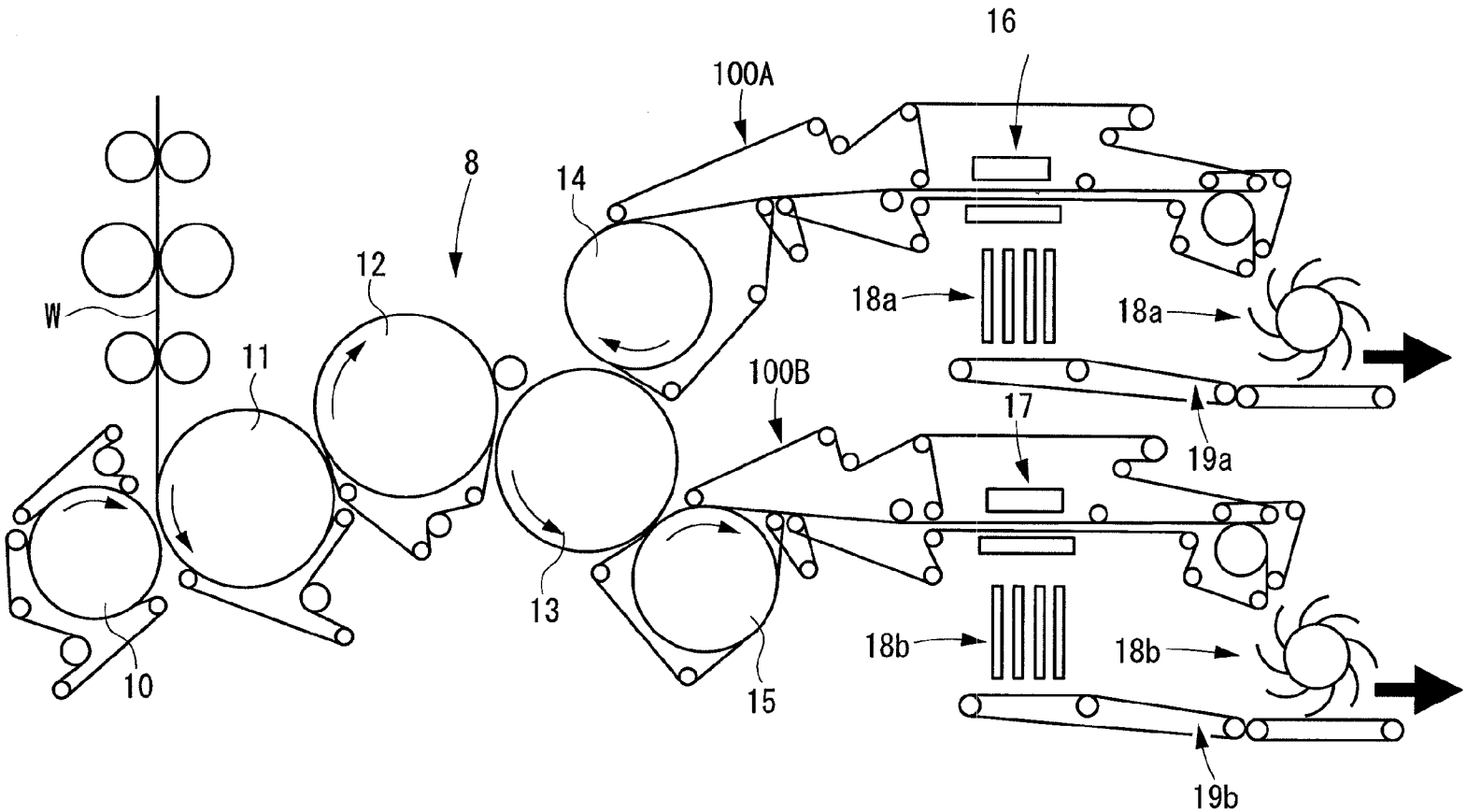
FIG. 2 is a schematic configurational drawing of a transport path of a folder.
Figure 3:
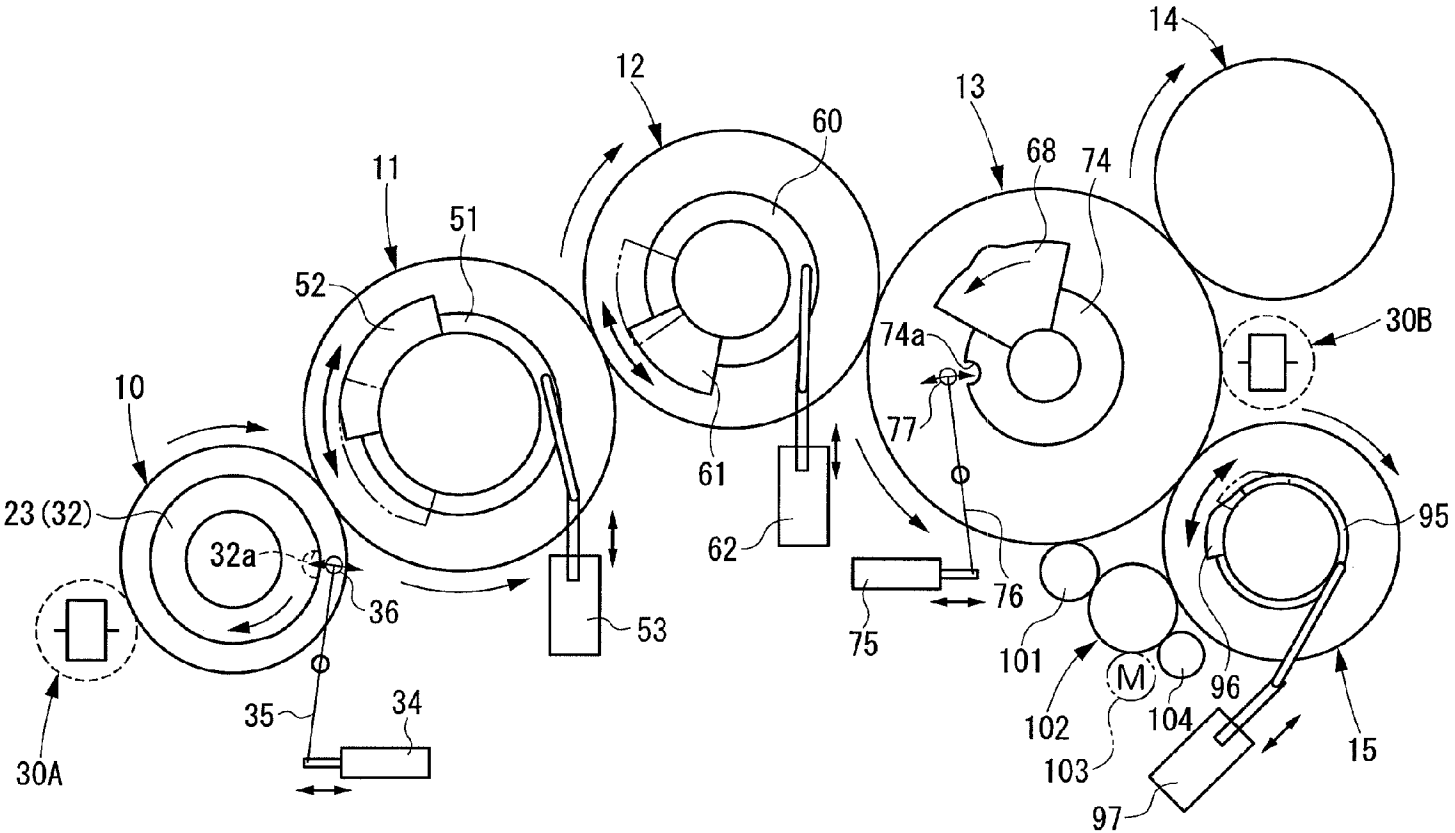
FIG. 3 is a front view of the cylinder arrangement of the folder.
Figure 4A:
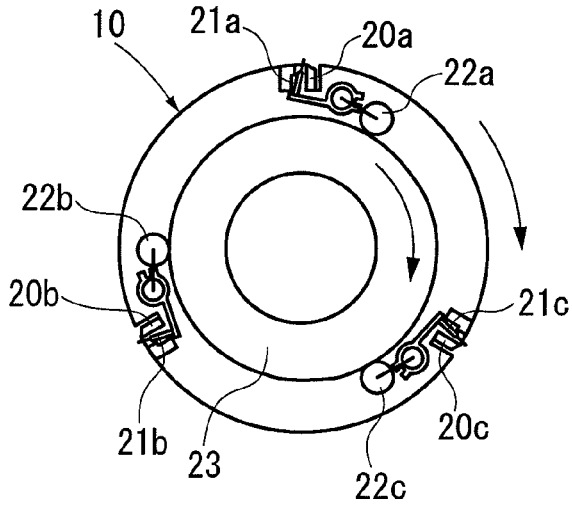
FIG. 4A is an explanation drawing of a collecting and cutting cylinder.
Figure 4B:
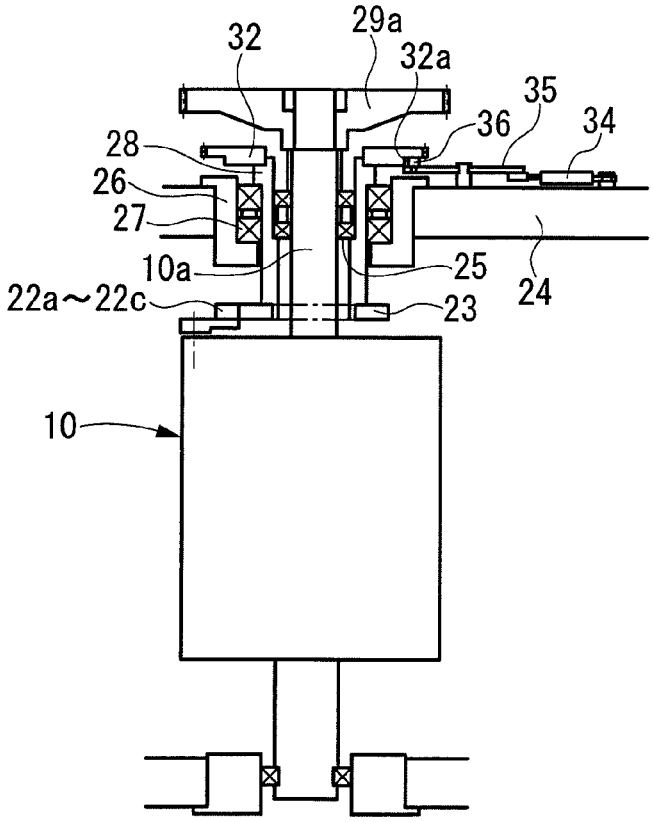
FIG. 4B is an explanation drawing of the collecting and cutting cylinder.
Figure 5A:
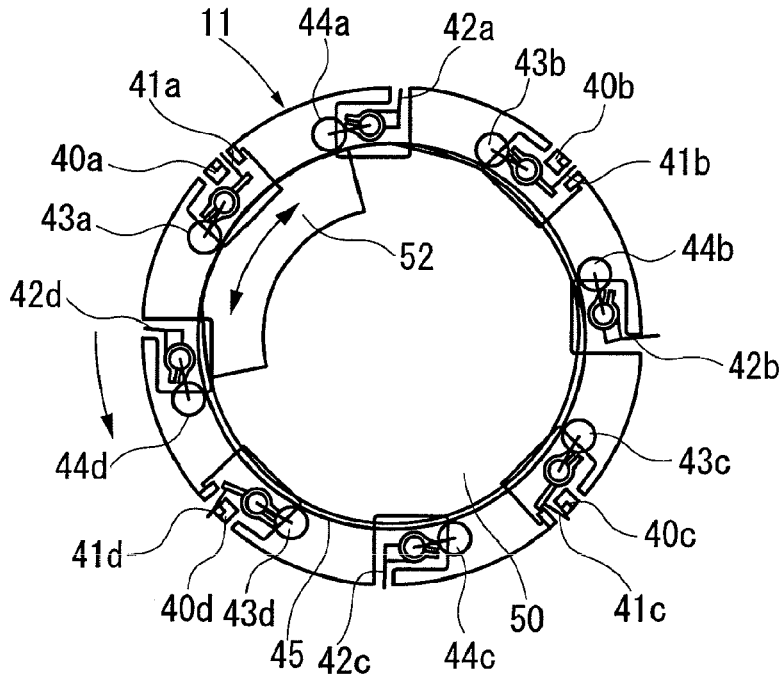
FIG. 5A is an explanation drawing of a folding cylinder.
Figure 5B:
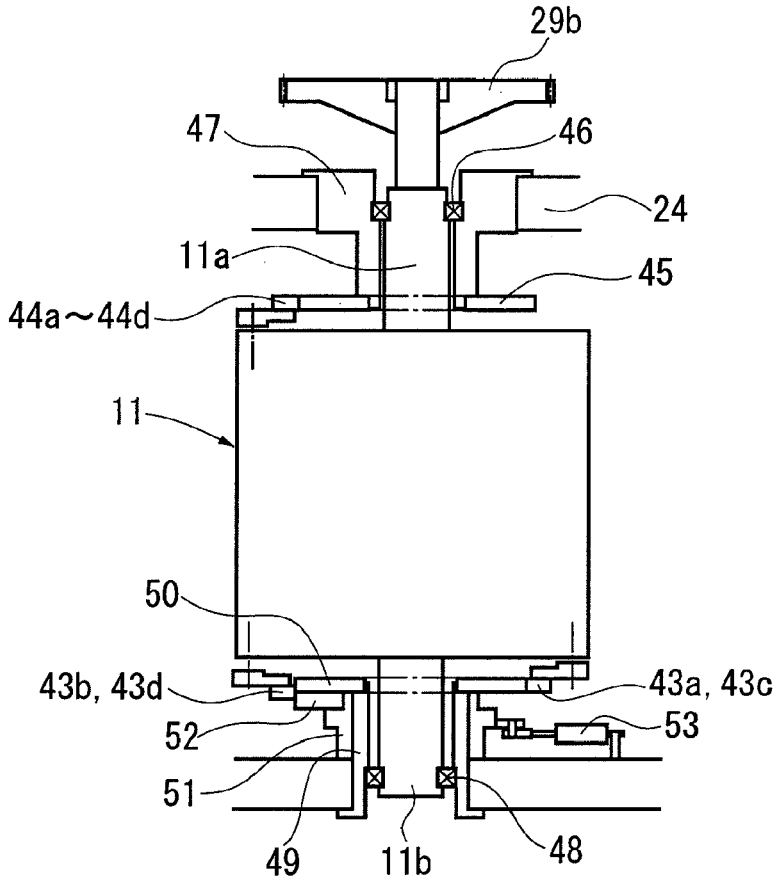
FIG. 5B is an explanation drawing of the folding cylinder.
Figure 6A:
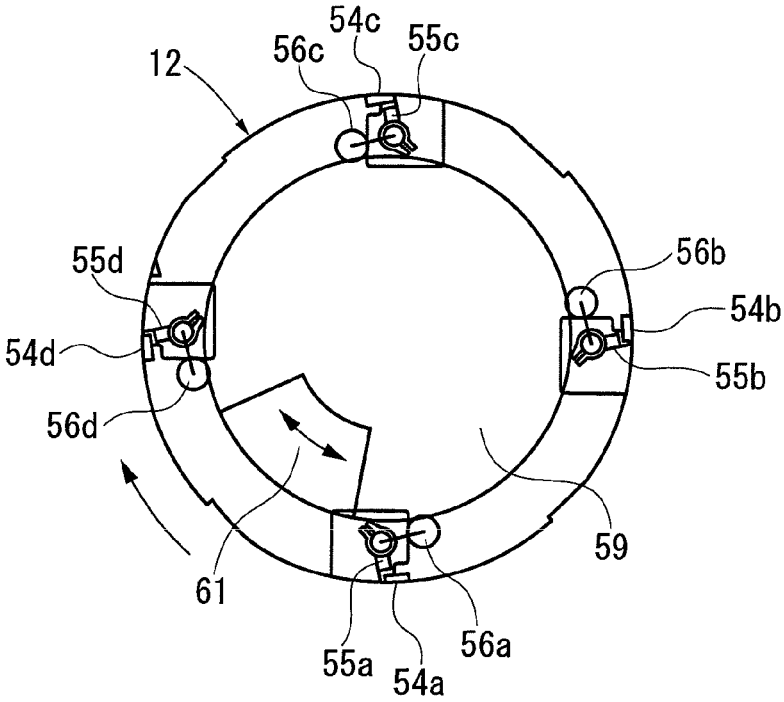
FIG. 6A is an explanation drawing of a jaw cylinder.
Figure 6B:
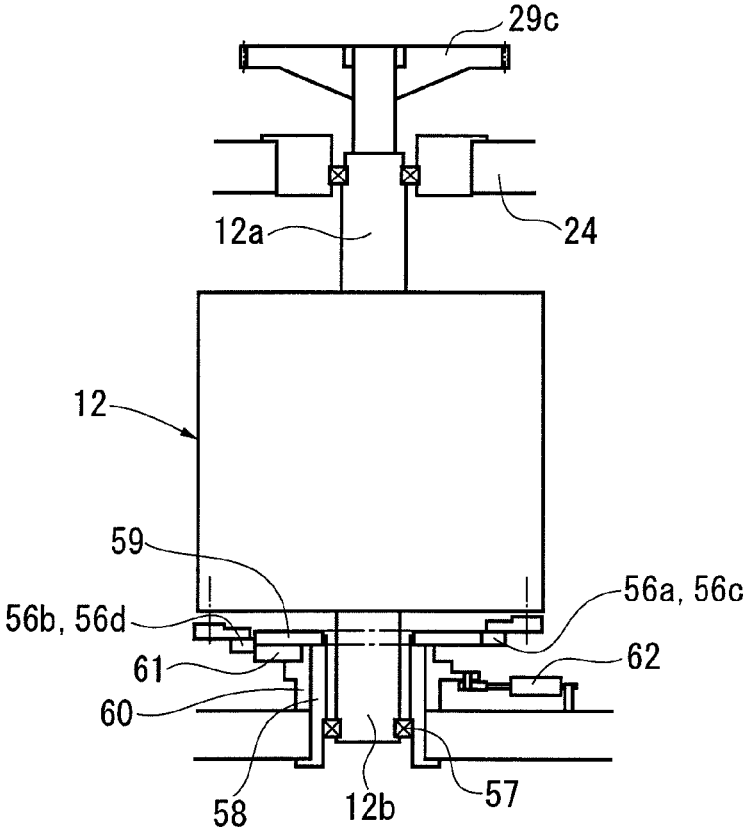
FIG. 6B is an explanation drawing of the jaw cylinder.
Figure 7A:
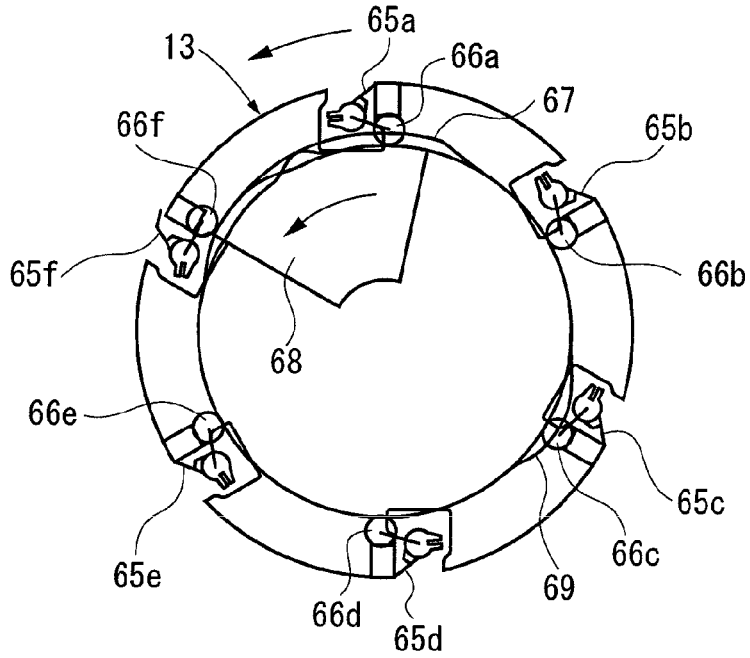
FIG. 7A is an explanation drawing of a reduction cylinder.
Figure 7B:
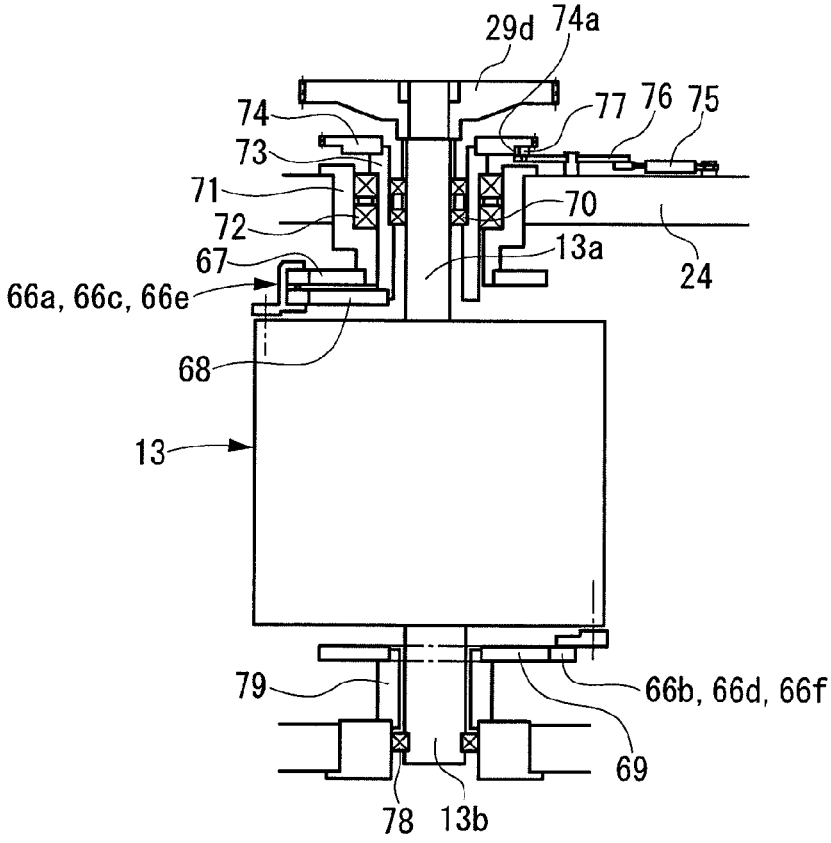
FIG. 7B is an explanation drawing of the reduction cylinder.
Figure 8A:
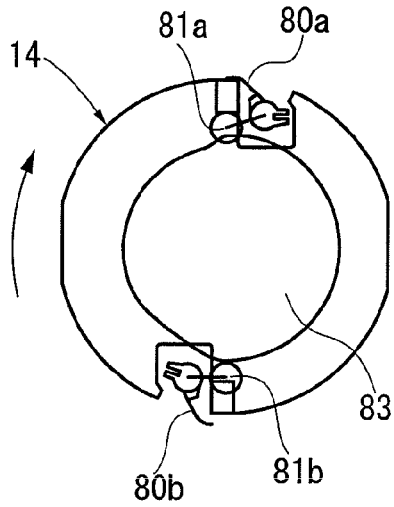
FIG. 8A is an explanation drawing of an upper transfer cylinder.
Figure 8B:
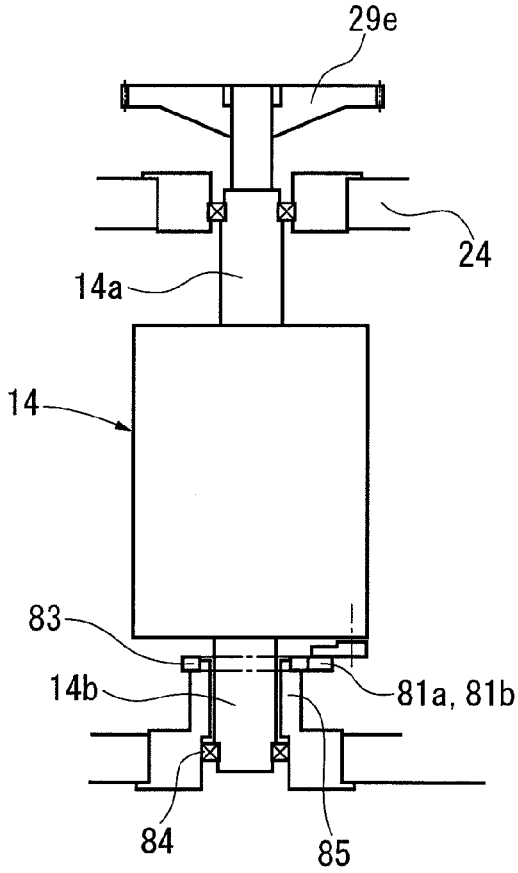
FIG. 8B is an explanation drawing of the upper transfer cylinder.
Figure 9A:
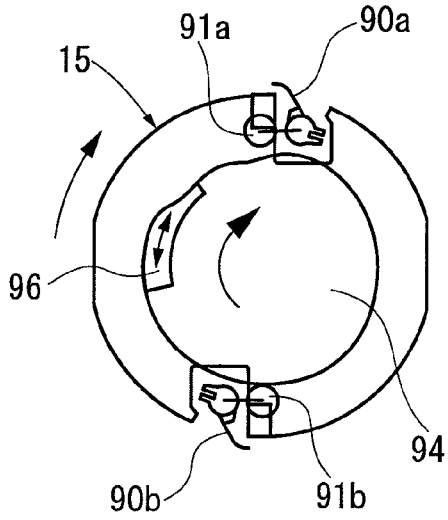
FIG. 9A is an explanation drawing of a lower transfer cylinder.
Figure 9B:
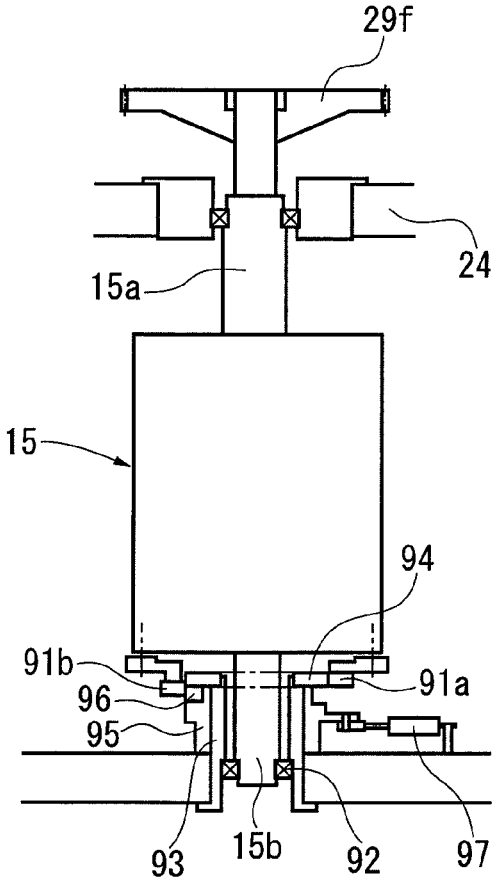
FIG. 9B is an explanation drawing of the lower transfer cylinder.

FIG. 1 is a schematic configurational drawing of a web rotary printing press showing Embodiment 1 of the present invention. FIG. 2 is a schematic configurational drawing of a transport path of a folder. FIG. 3 is a front view of the cylinder arrangement of the folder. FIGS. 4A and 4B are explanation drawings of a collecting and cutting cylinder. FIGS. 5A and 5B are explanation drawings of a folding cylinder. FIGS. 6A and 6B are explanation drawings of a jaw cylinder. FIGS. 7A and 7B are explanation drawings of a reduction cylinder. FIGS. 8A and 8B are explanation drawings of an upper transfer cylinder. FIGS. 9A and 9B are explanation drawings of a lower transfer cylinder.

Figure 10A:
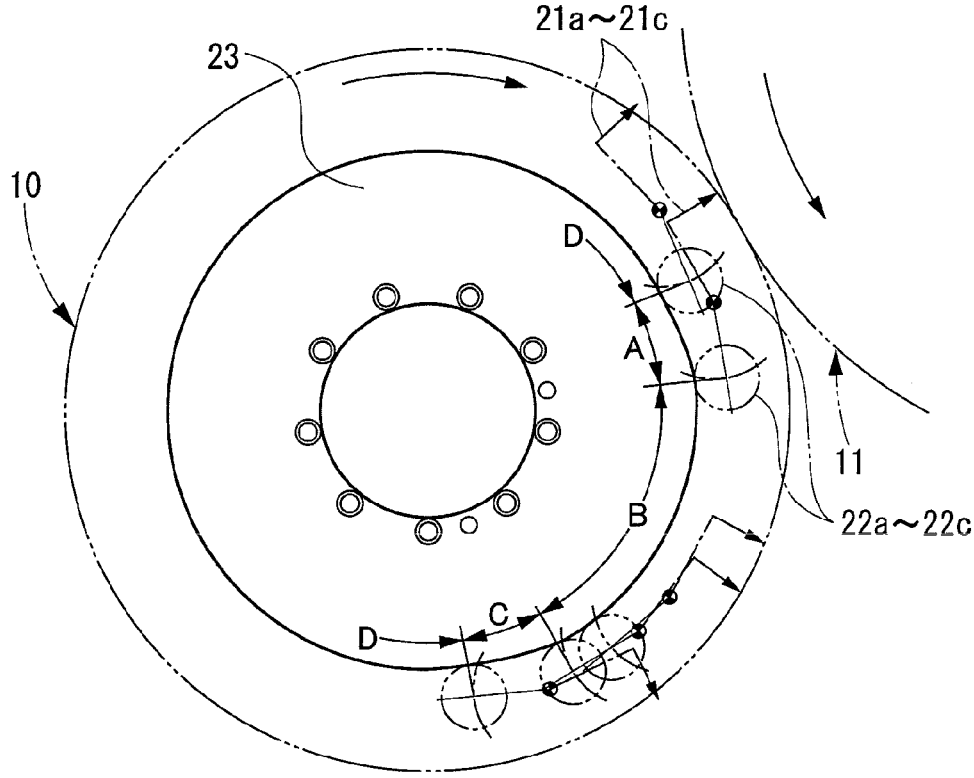
FIG. 10A is an explanation drawing of a pin cam of the collecting and cutting cylinder.
Figure 10B:
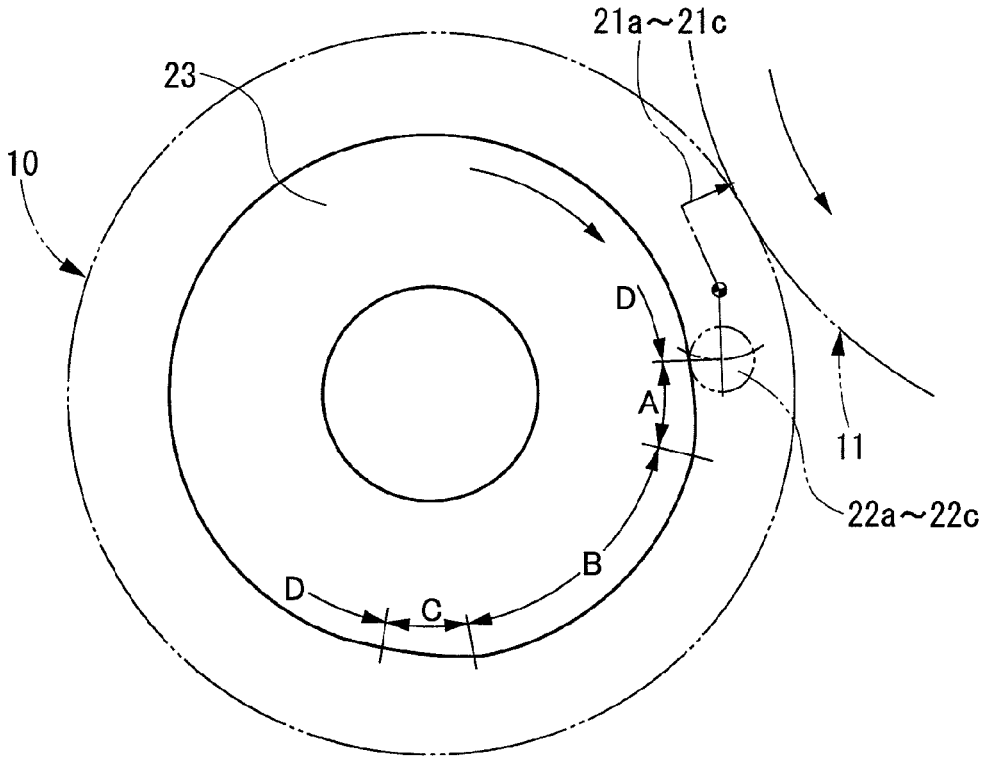
FIG. 10B is an explanation drawing of the pin cam of the collecting and cutting cylinder.
Figure 11:
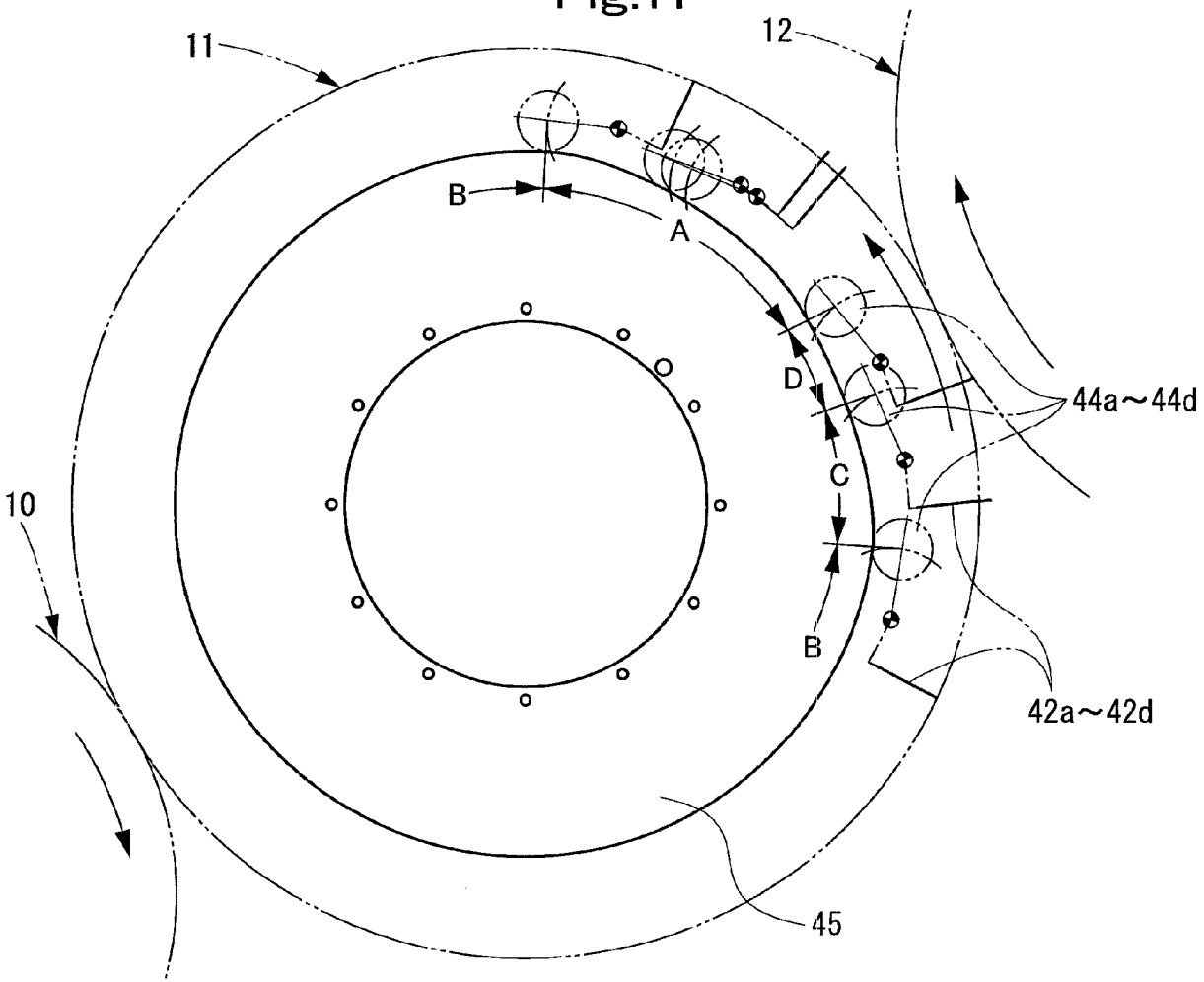
FIG. 11 is an explanation drawing of a sucker blade cam of the folding cylinder.
Figure 12:
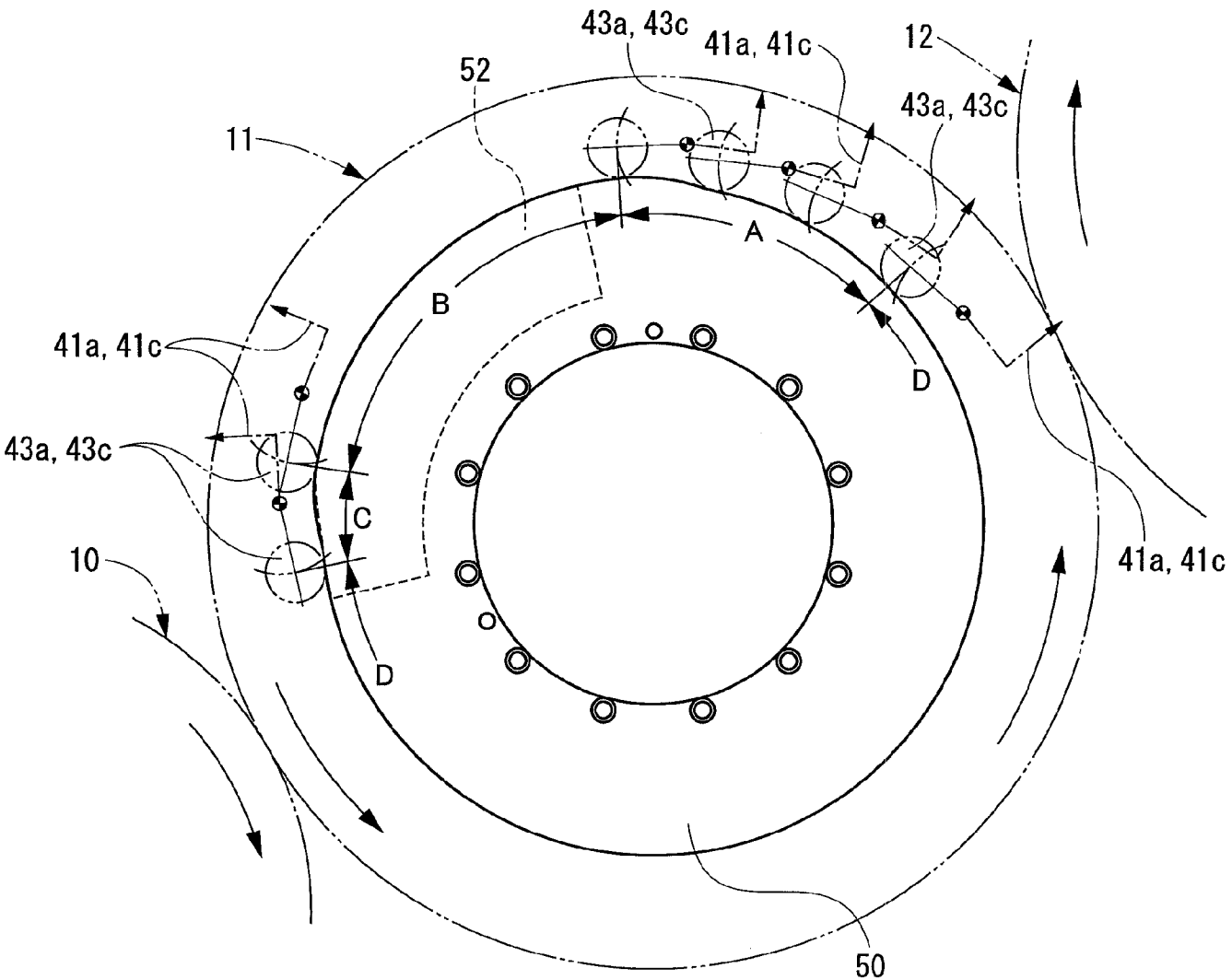
FIG. 12 is an explanation drawing of a pin main cam of the folding cylinder.
Figure 13A:
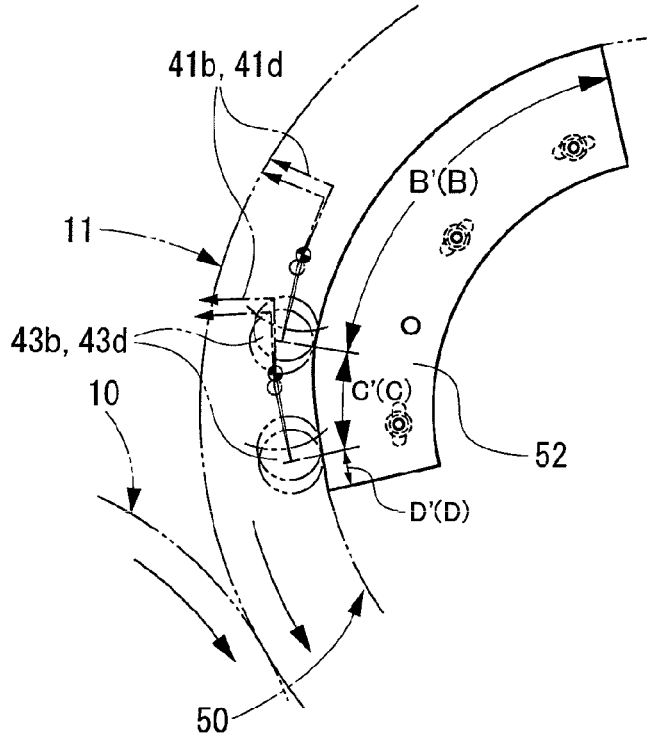
FIG. 13A is an explanation drawing of a pin sub-cam of the folding cylinder.
Figure 13B:
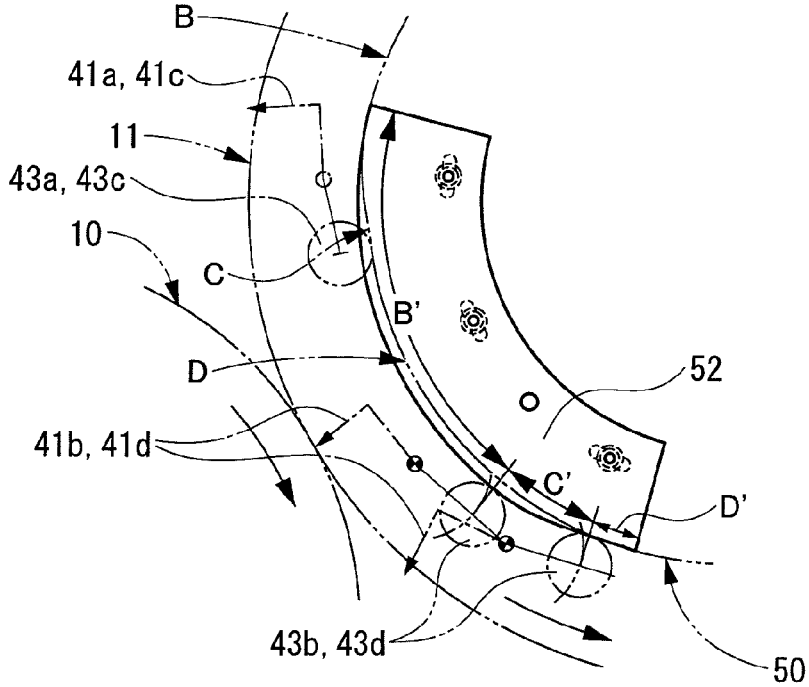
FIG. 13B is an explanation drawing of the pin sub-cam of the folding cylinder.
Figure 14:
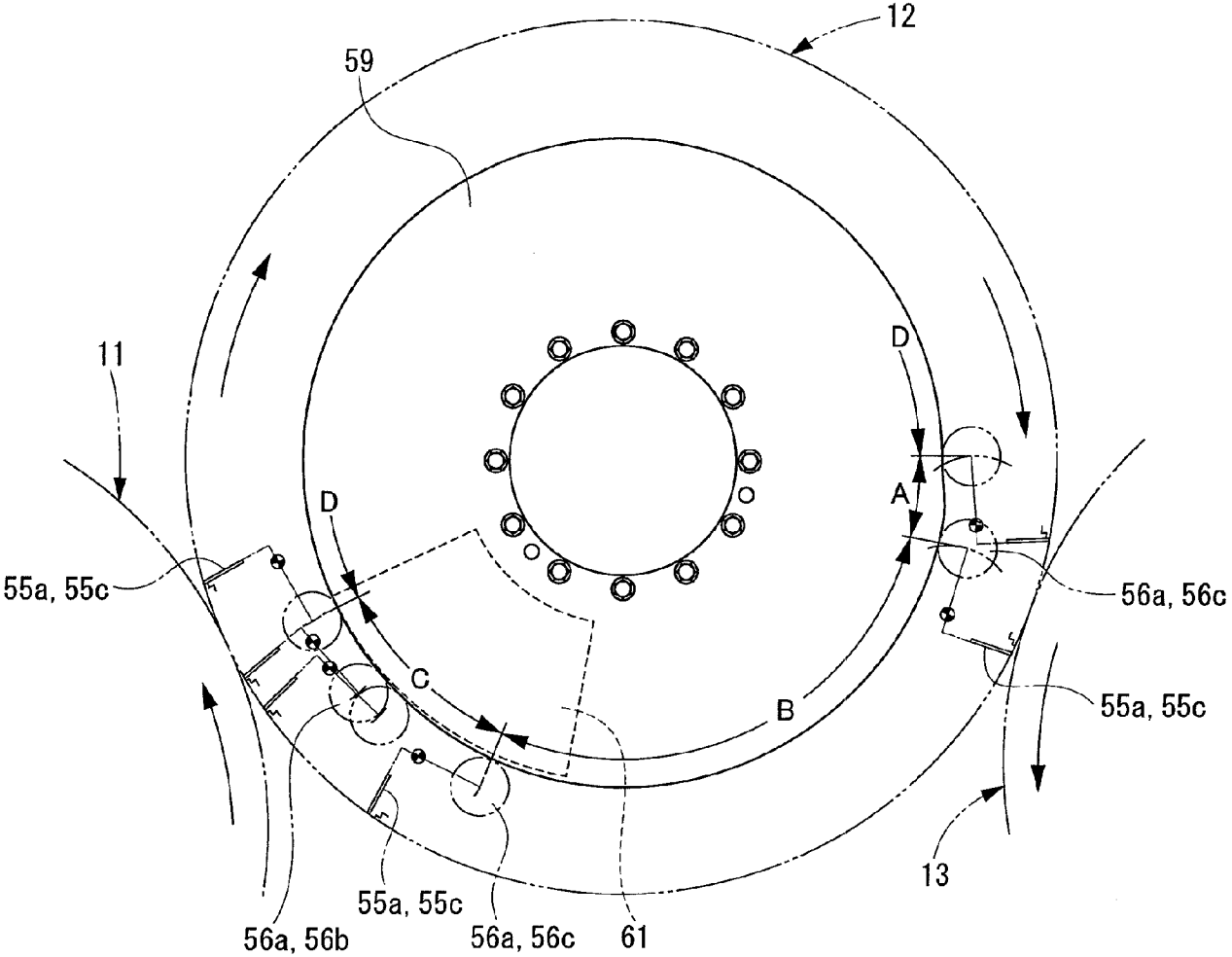
FIG. 14 is an explanation drawing of a gripping main cam of the jaw cylinder.
Figure 15A:
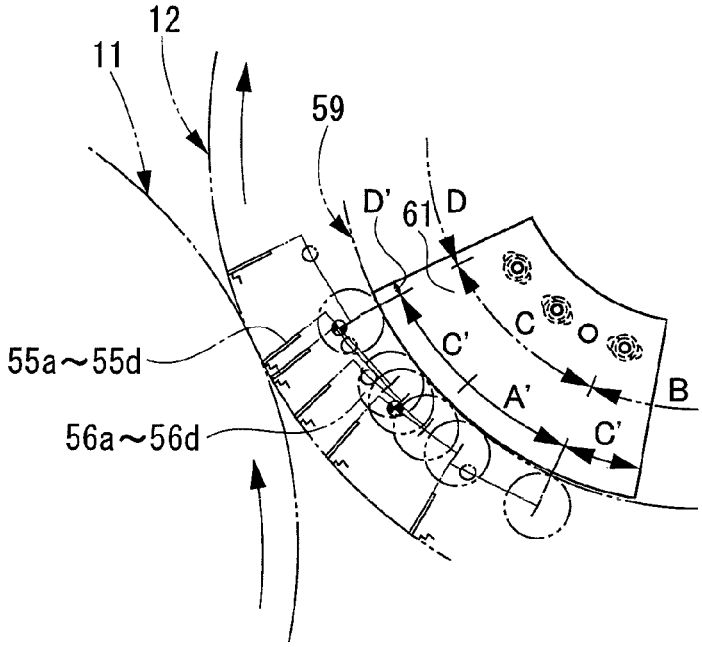
FIG. 15A is an explanation drawing of a gripping sub-cam of the jaw cylinder.
Figure 15B:
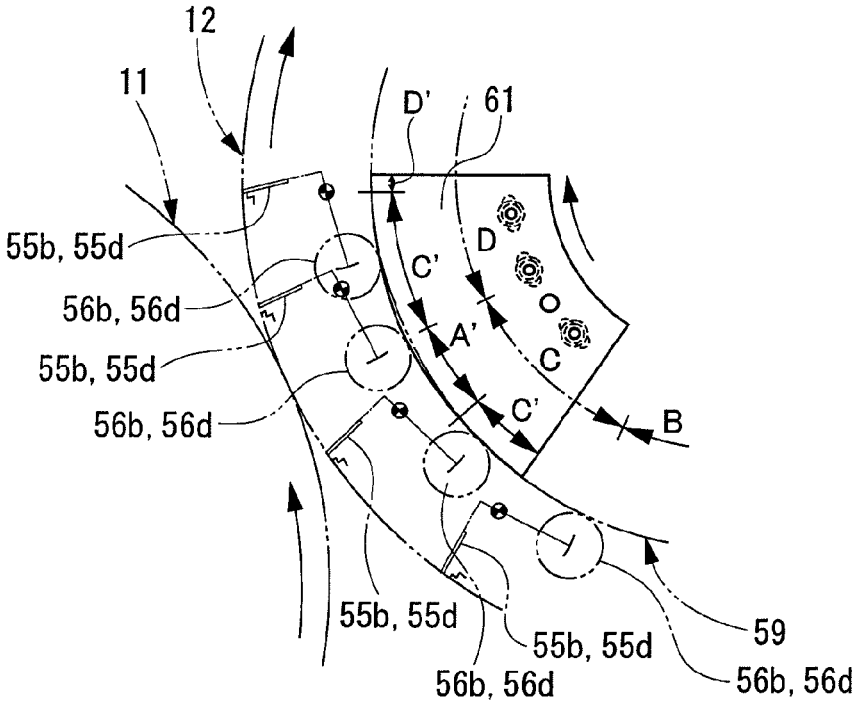
FIG. 15B is an explanation drawing of the gripping sub-cam of the jaw cylinder.
Figure 16:
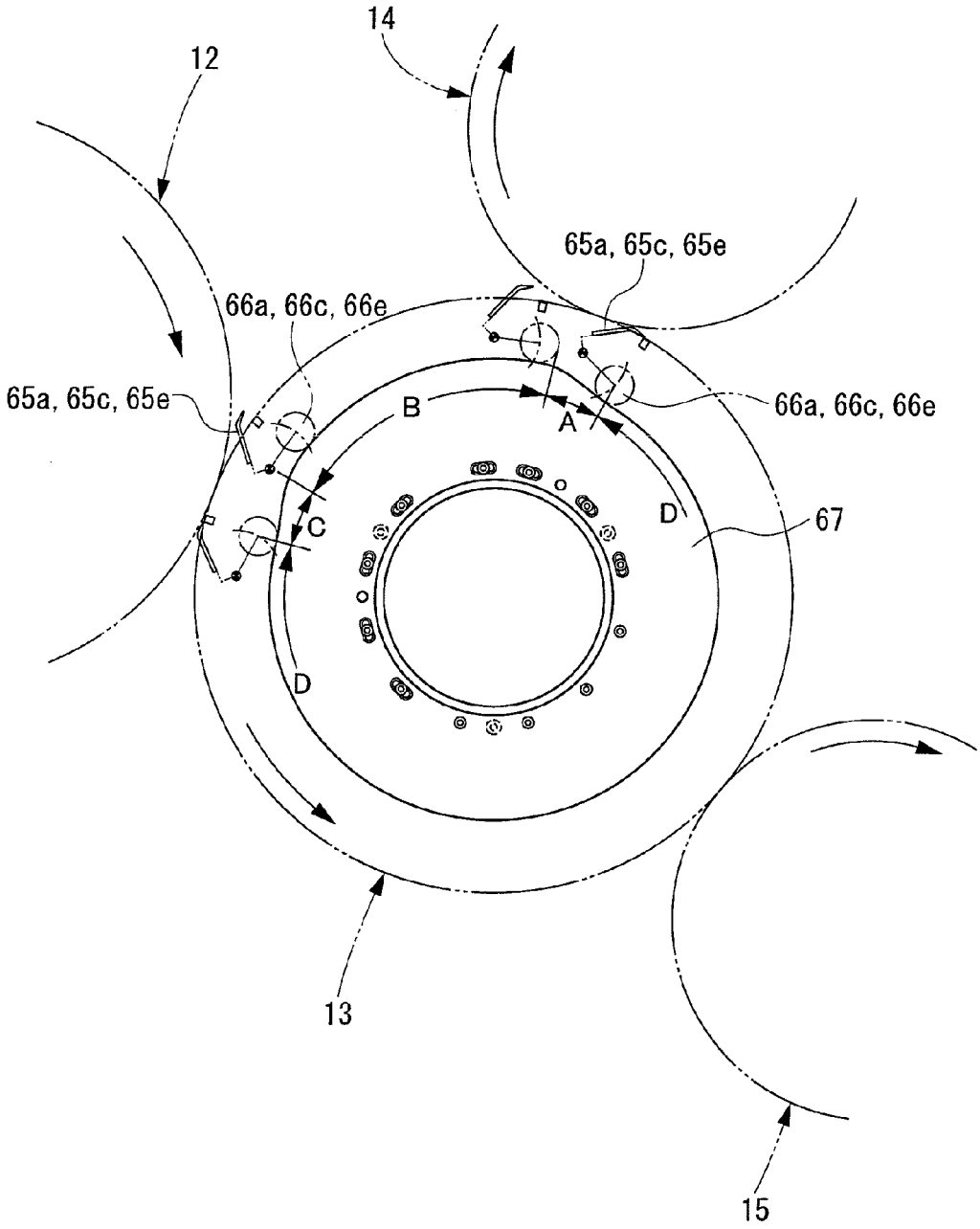
FIG. 16 is an explanation drawing of a gripper main cam of the reduction cylinder.
Figure 17A:
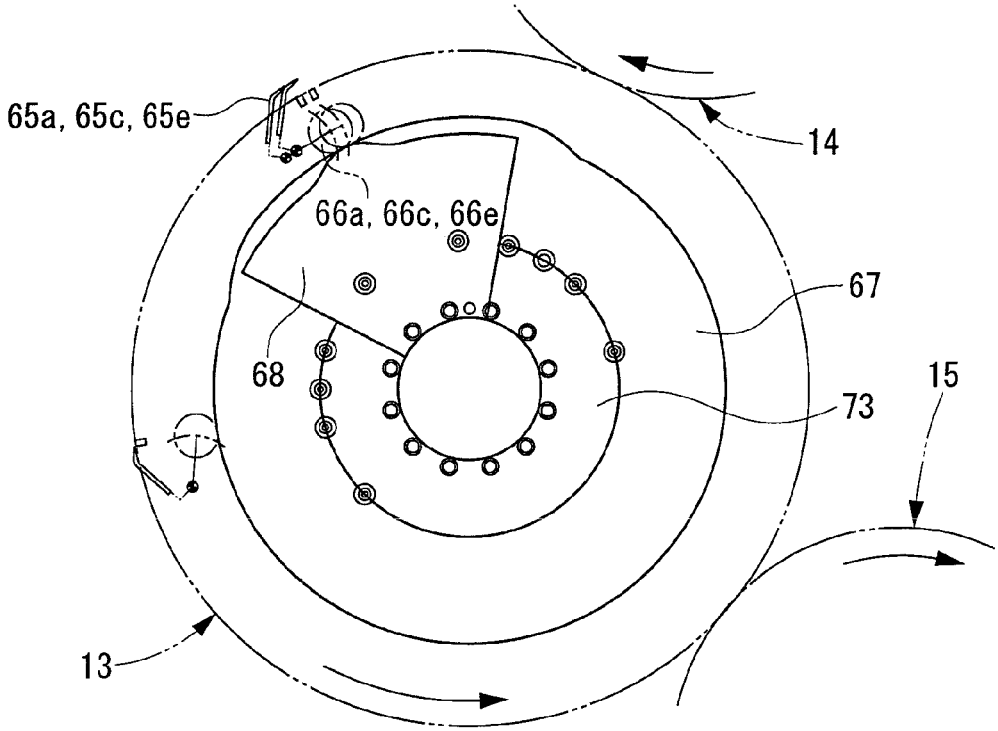
FIG. 17A is an explanation drawing of a gripper rotating cam of the reduction cylinder.
Figure 17B:
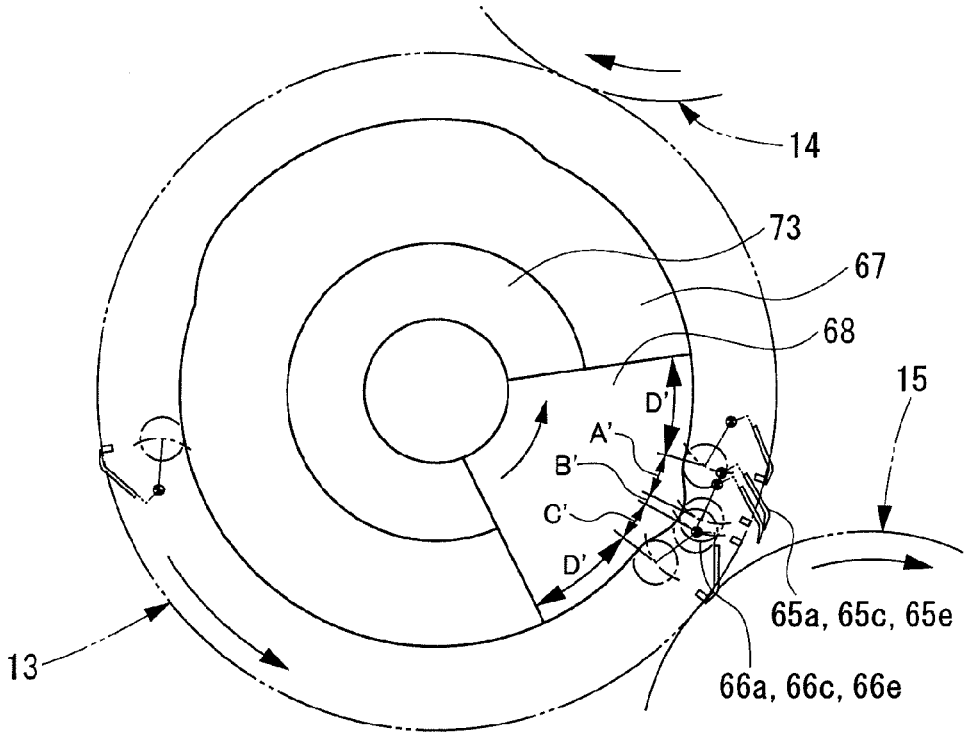
FIG. 17B is an explanation drawing of the gripper rotating cam of the reduction cylinder.
Figure 18:
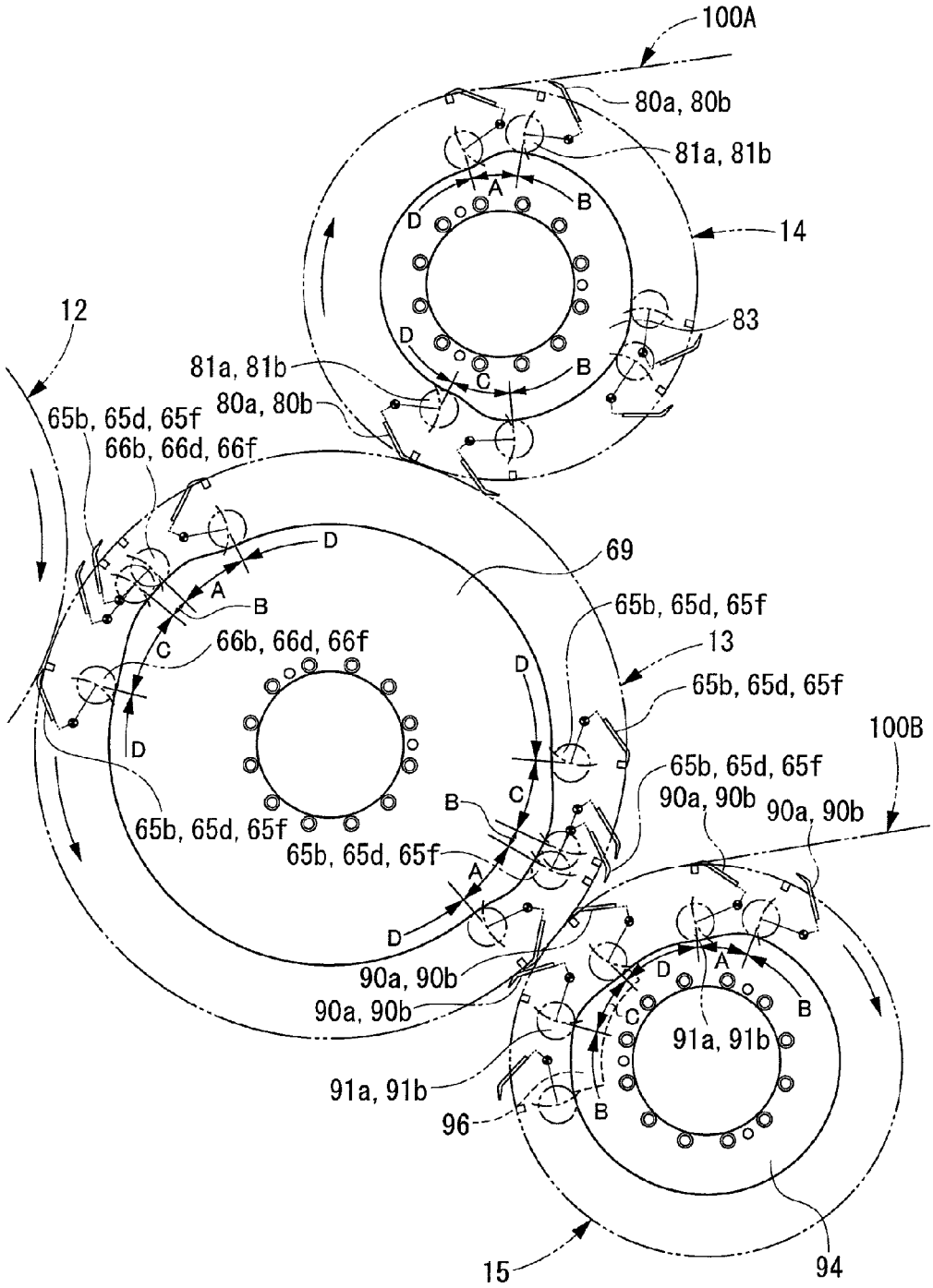
FIG. 18 is an explanation drawing of a gripper cam of the reduction cylinder, a gripper main cam of the upper transfer cylinder, and a gripper main cam of the lower transfer cylinder.
Figure 19A:
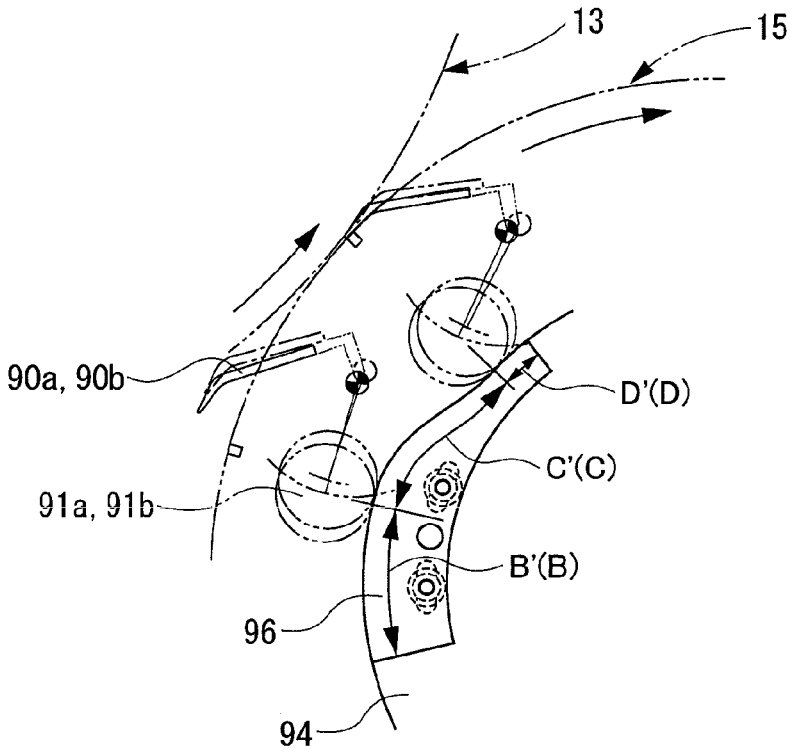
FIG. 19A is an explanation drawing of a gripper sub-cam of the lower transfer cylinder.
Figure 19B:
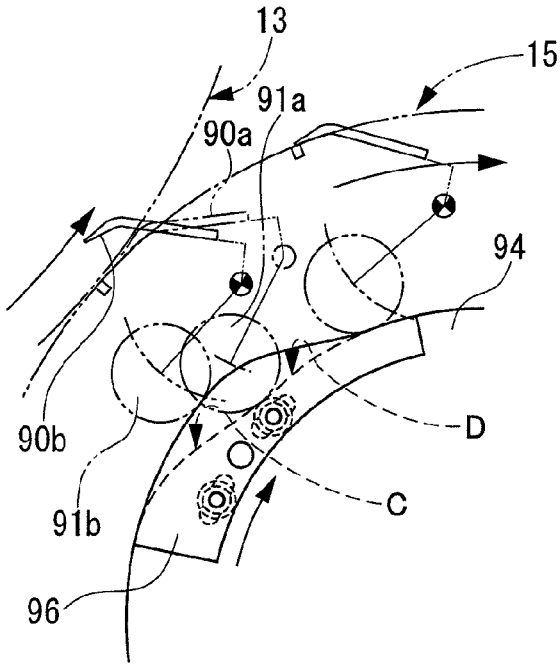
FIG. 19B is an explanation drawing of the gripper sub-cam of the lower transfer cylinder.

FIGS. 10A and 10B are explanation drawings of a pin cam of the collecting and cutting cylinder. FIG. 11 is an explanation drawing of a sucker blade cam of the folding cylinder. FIG. 12 is an explanation drawing of a pin main cam of the folding cylinder. FIGS. 13A and 13B are explanation drawings of a pin sub-cam of the folding cylinder. FIG. 14 is an explanation drawing of a gripping main cam of the jaw cylinder. FIGS. 15A and 15B are explanation drawings of a gripping sub-cam of the jaw cylinder. FIG. 16 is an explanation drawing of a gripper main cam of the reduction cylinder. FIGS. 17A and 17B are explanation drawings of a gripper rotating cam of the reduction cylinder. FIG. 18 is an explanation drawing of a gripper cam of the reduction cylinder, a gripper main cam of the upper transfer cylinder, and a gripper main cam of the lower transfer cylinder. FIGS. 19A and 19B are explanation drawings of a gripper sub-cam of the lower transfer cylinder.

Figure 20:
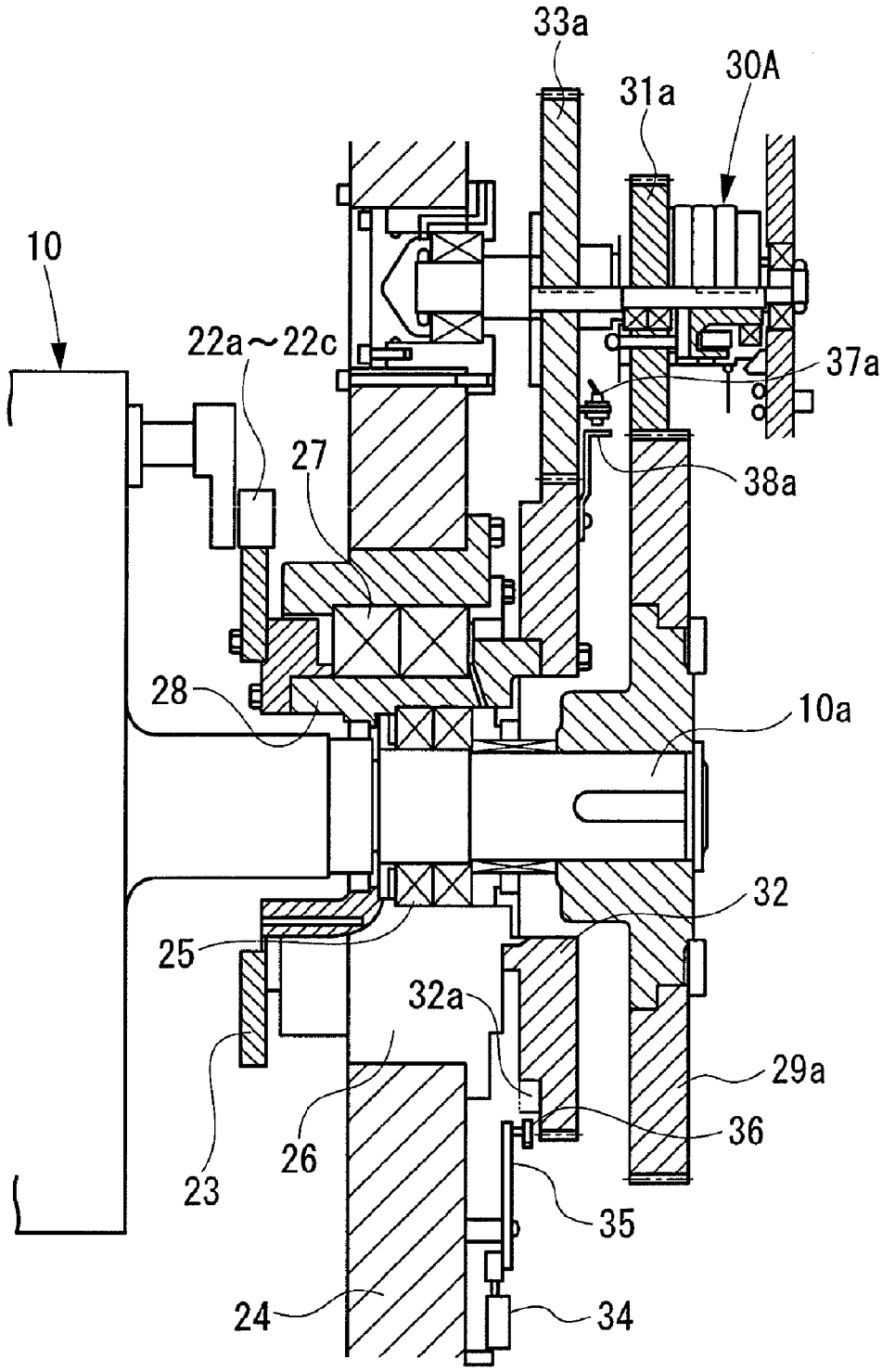
FIG. 20 is a sectional view of a drive mechanism for the collecting and cutting cylinder.
Figure 21:
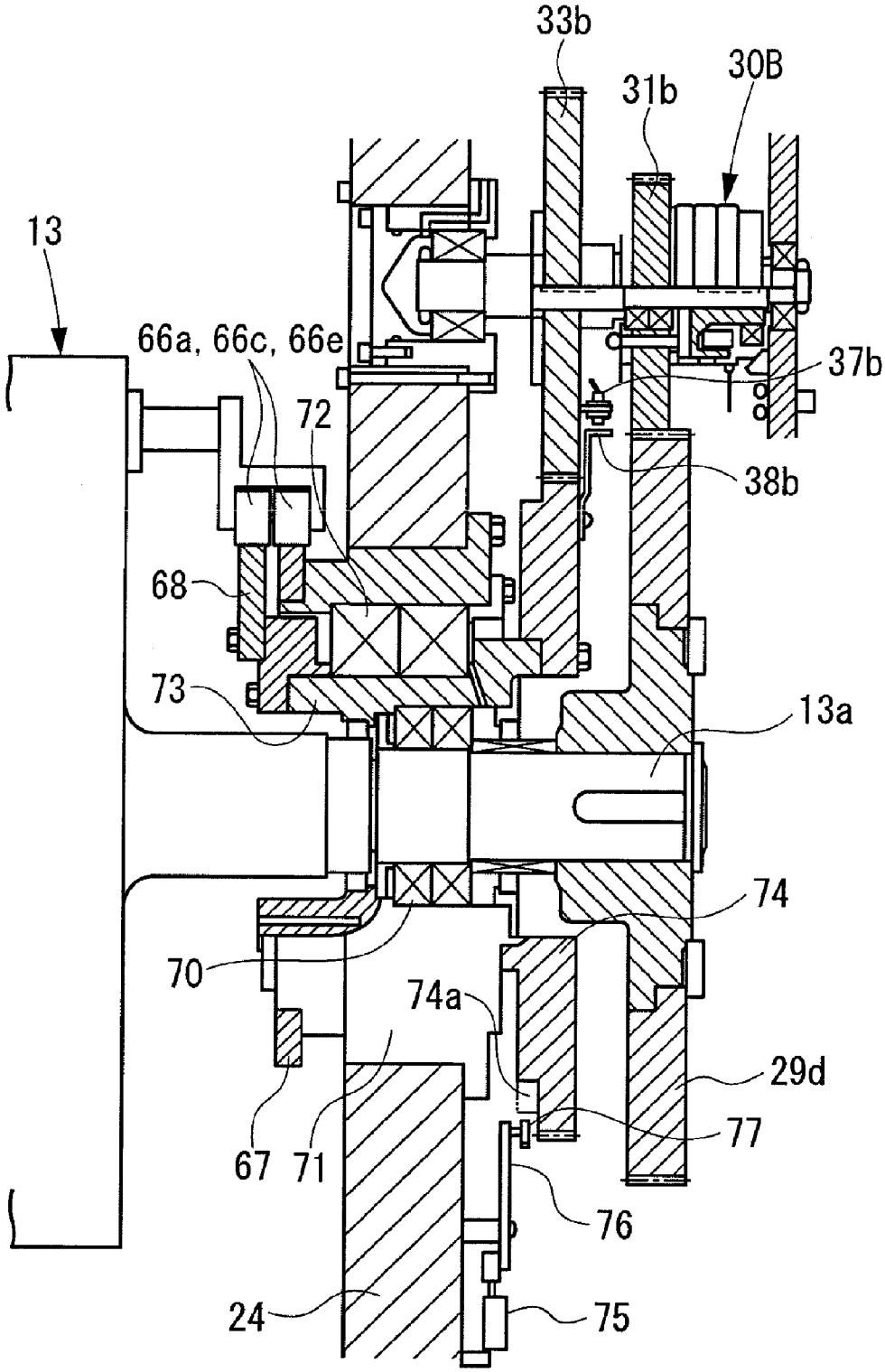
FIG. 21 is a sectional view of a drive mechanism for the reduction cylinder.
Figure 22:
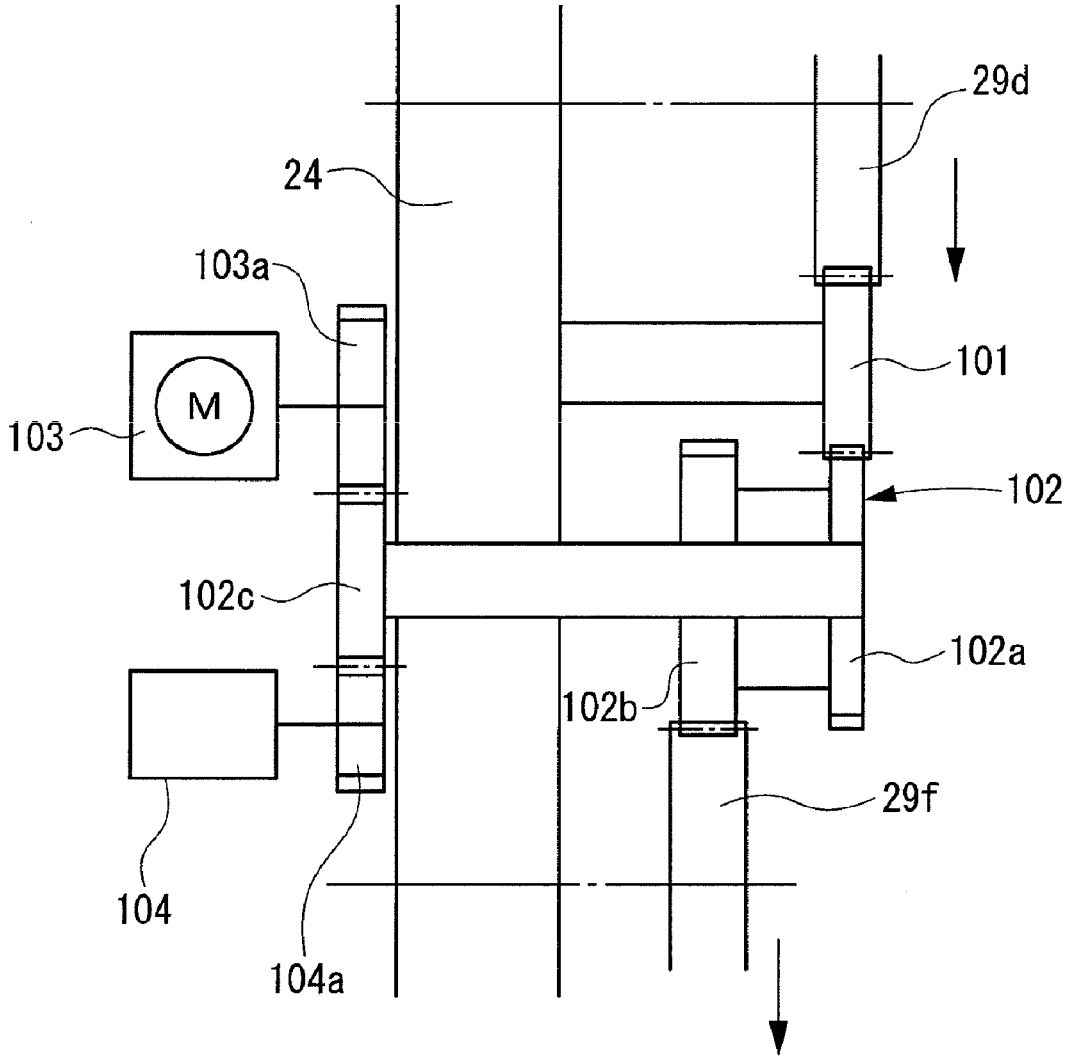
FIG. 22 is an explanation drawing of a drive mechanism between the reduction cylinder and the lower transfer cylinder.
Figure 23:
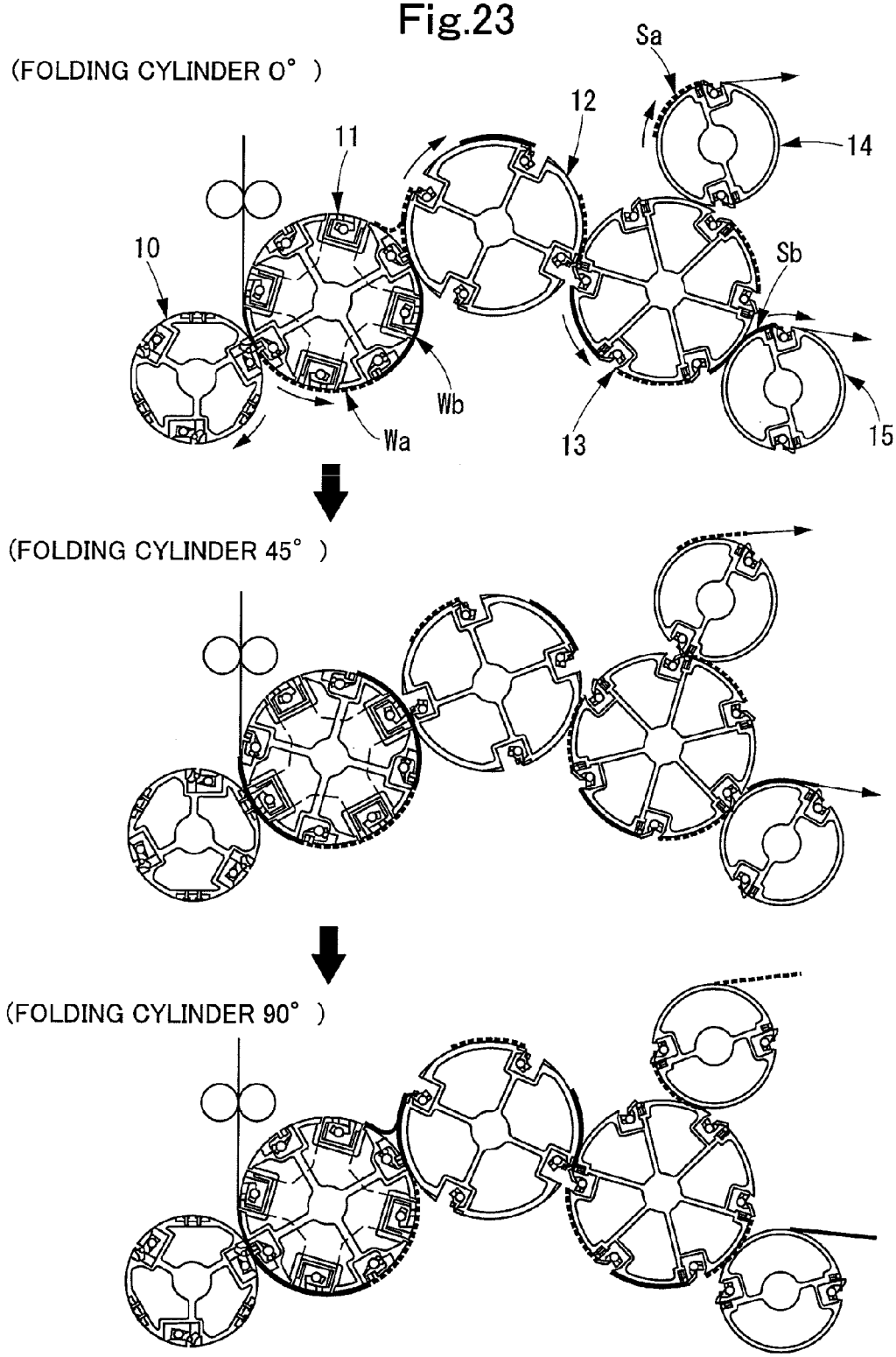
FIG. 23 is an explanation drawing of actions during upper-lower two-stage delivery in non-collect folding.
Figure 24:
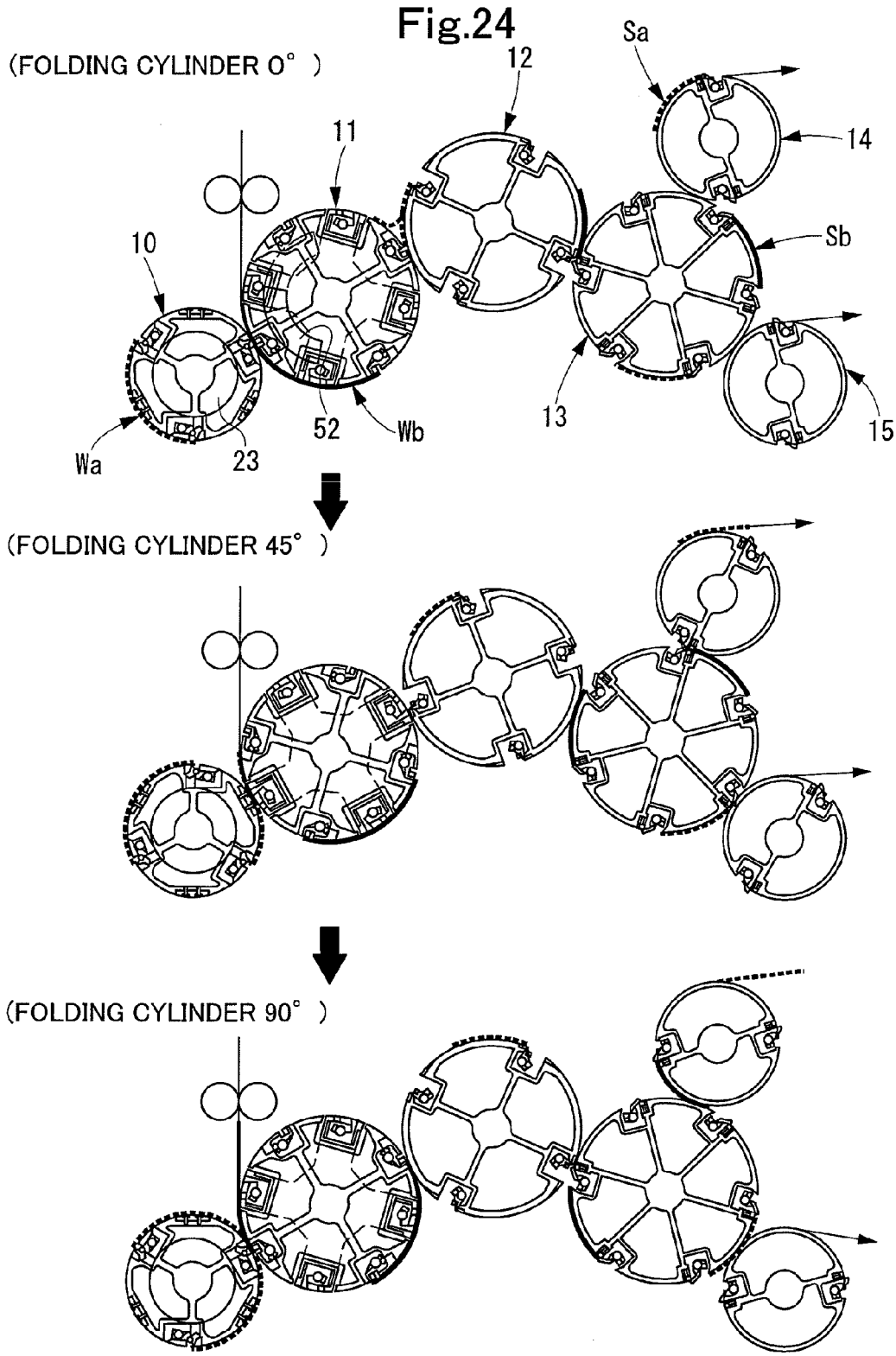
FIG. 24 is an explanation drawing of actions during upper one-stage delivery in collect folding.
Figure 25:
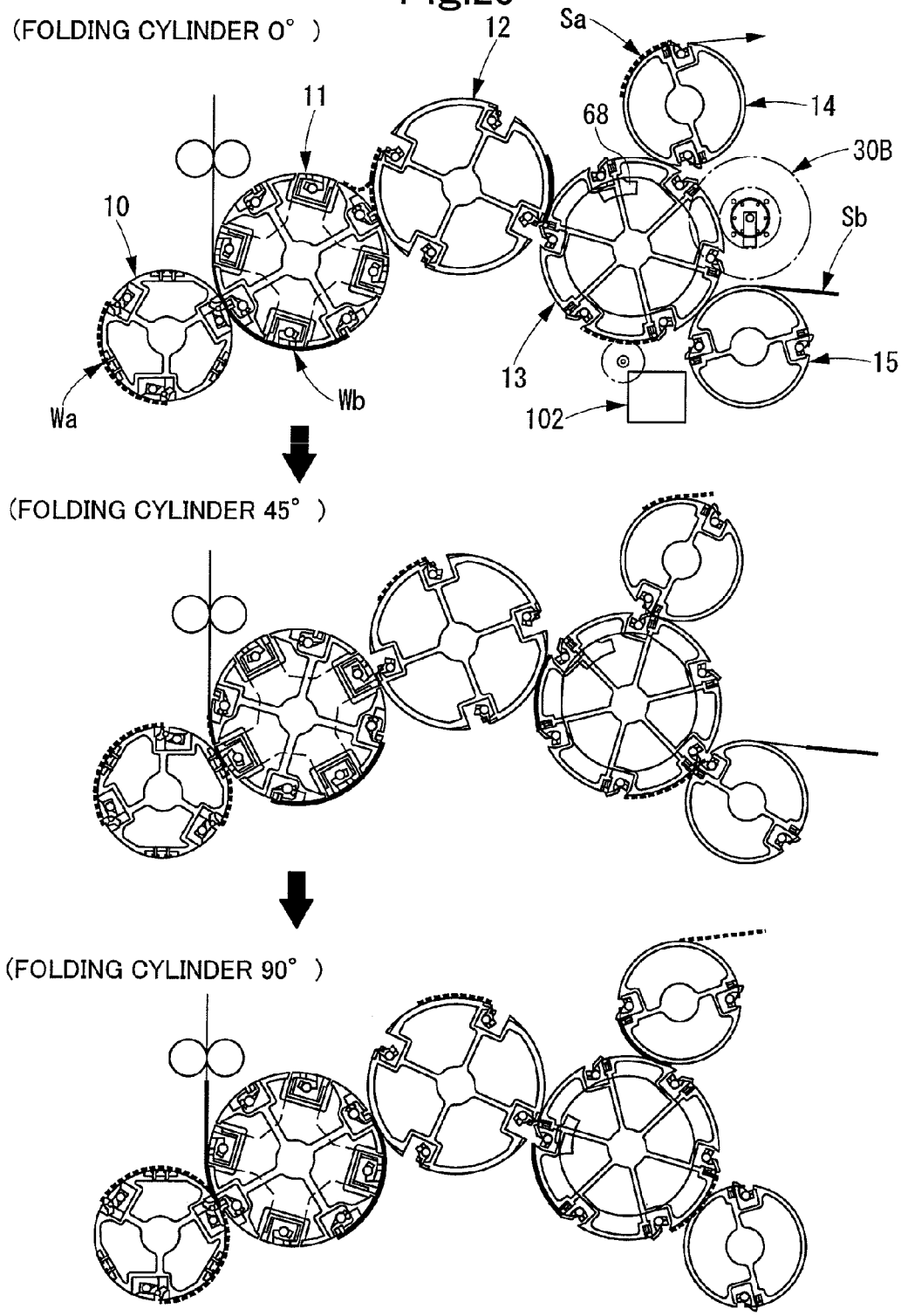
FIG. 25 is an explanation drawing of actions during upper-lower two-stage delivery in collect folding.
Figure 26A:
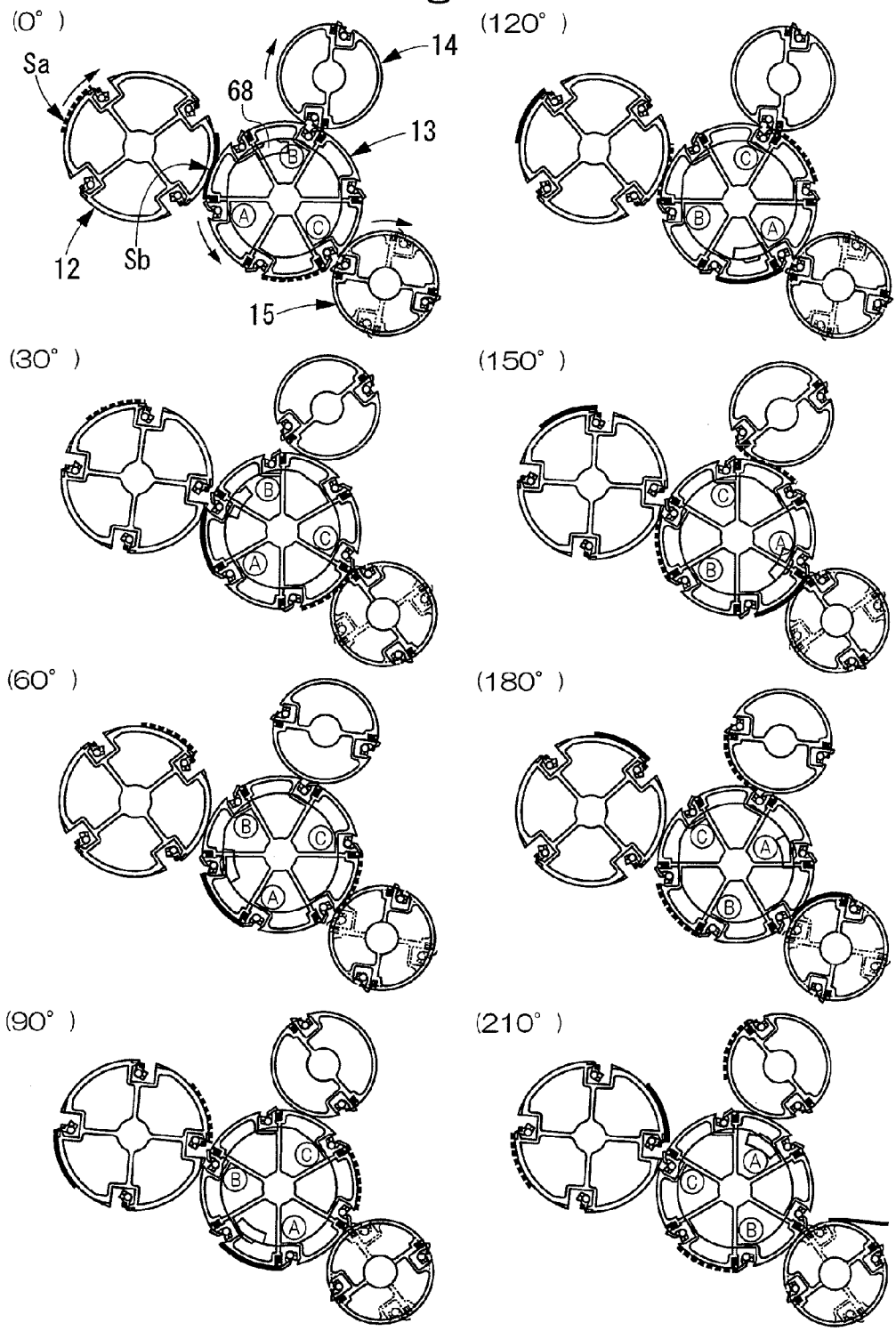
FIG. 26A is an explanation drawing of the actions during the upper-lower two-stage delivery in the collect folding.
Figure 26B:
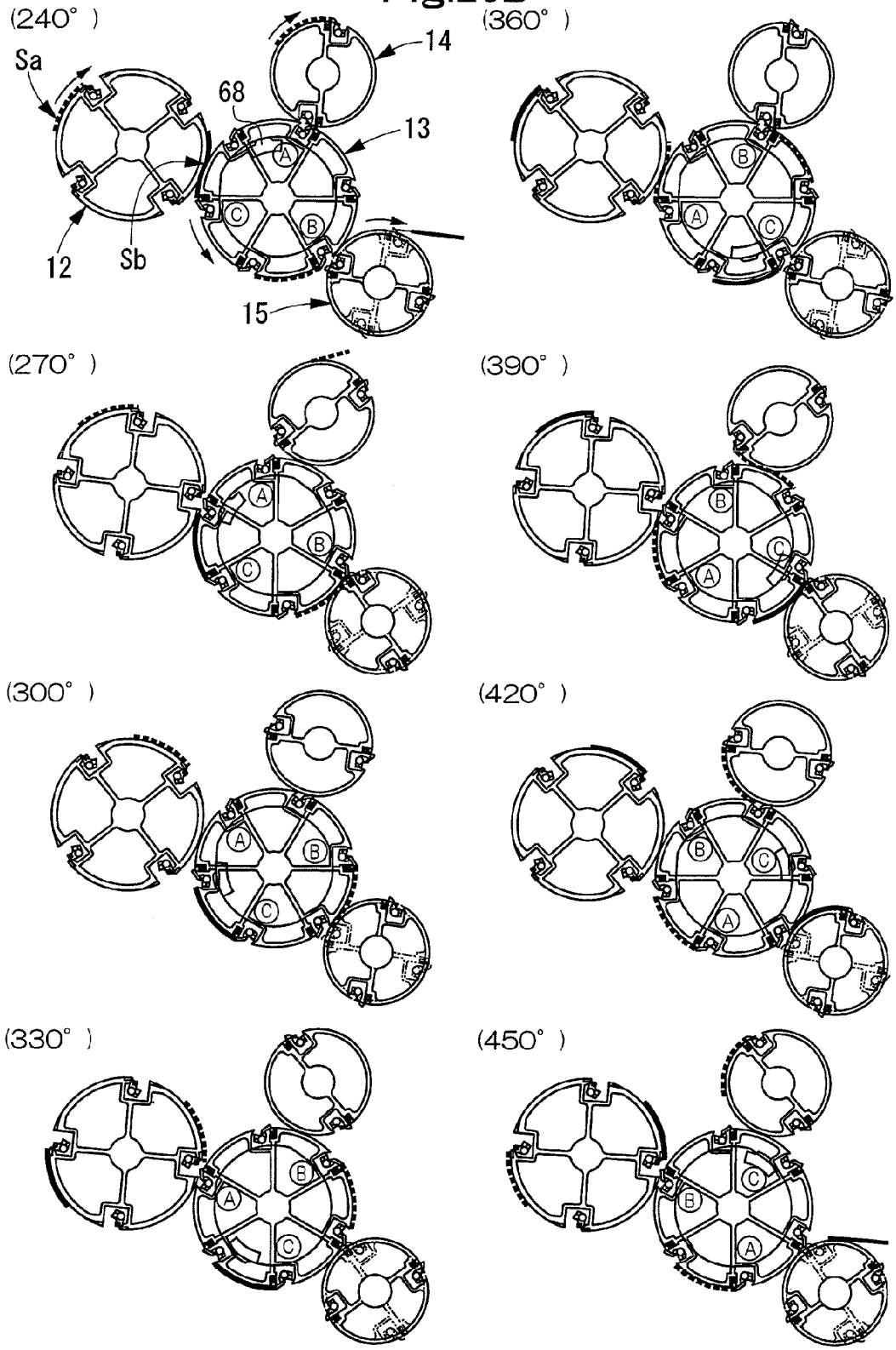
FIG. 26B is an explanation drawing of the actions during the upper-lower two-stage delivery in the collect folding.

FIG. 20 is a sectional view of a drive mechanism for the collecting and cutting cylinder. FIG. 21 is a sectional view of a drive mechanism for the reduction cylinder. FIG. 22 is an explanation drawing of a drive mechanism between the reduction cylinder and the lower transfer cylinder. FIG. 23 is an explanation drawing of actions during upper-lower two-stage delivery in non-collect folding. FIG. 24 is an explanation drawing of actions during upper one-stage delivery in collect folding. FIG. 25 is an explanation drawing of actions during upper-lower two-stage delivery in collect folding. FIG. 26A is an explanation drawing of the actions during the upper-lower two-stage delivery in the collect folding. FIG. 26B is an explanation drawing of the actions during the upper-lower two-stage delivery in the collect folding.

As shown in FIG. 1, a web W in a web rotary printing press is continuously sent out from a feeding apparatus 1 and an infeed apparatus 2, and passed through a first printing unit 3*a* to a fourth printing unit 3*d* of a printing apparatus 3 for various printings. The printed web W is heated and dried by a drying apparatus 4, and then cooled by a cooling apparatus 5. Then, in a web path apparatus 6, the web W has its tension adjusted and its direction changed. Then, in a former 7, the web W is longitudinally folded along a transport direction (longitudinal direction), and then fed into a folder 8.

As shown in FIG. 2, within the folder 8, the web W fed between a collecting and cutting cylinder 10 and a folding cylinder 11 is cut to predetermined dimensions by cut-off knives 20*a* to 20*c* (to be described later) of the collecting and cutting cylinder 10 and cut bearers 40*a* to 40*d* (to be described later) of the folding cylinder 11, for example, during upper-lower two-stage delivery (transport path) in non-collect folding. In this case, the web W is also held by pins 41*a* to 41*d* (to be described later) of the folding cylinder 11, and wrapped around the lower half of the circumferential surface of the folding cylinder 11.

The cutoff web (sheet) held by the pins 41*a* to 41*d* of the folding cylinder 11 is then gripped by gripper boards 55*a* to 55*d* and gripper jaws 54*a* to 54*d* (to be described later) of a jaw cylinder 12, and single-parallel-folded thereby in collaboration with sucker blades 42*a* to 42*d* (to be described later) of the folding cylinder 11. While being subjected to single parallel folding, the cutoff web is converted into a signature (sheet) and contacted with and along the upper circumferential surface of the jaw cylinder 12. Further, the single parallel folded signature is passed from the gripper boards 55*a* to 55*d* and gripper jaws 54*a* to 54*d* of the jaw cylinder 12 on to grippers (first holding means, one set of the first holding means, the other set of the first holding means) 65*a* to 65*f* (to be described later) of a reduction cylinder (first transport cylinder) 13.

Then, the same signatures are sent from the reduction cylinder 13 and alternately allocated to grippers (third holding means; to be described later) 80*a*, 80*b* of an upper transfer cylinder (third transport cylinder) 14, and to grippers (second holding means; to be described later) 90*a*, 90*b* of a lower transfer cylinder (second transport cylinder) 15 for delivery. These signatures are chopper folded by an upper chopper folding apparatus 16 and a lower chopper folding apparatus 17, respectively. Alternatively, the signatures are passed, unchanged, through the upper chopper folding apparatus 16 and the lower chopper folding apparatus 17, and delivered to conveyors 19*a*, 19*b* via fan wheels 18*a*, 18*b*, respectively. Then, the signatures are piled on a stacker-bundler (not shown) as a post-treatment apparatus. Upper one-stage delivery (transport path) can also be performed by a switching means (to be described later).

During collect folding, the cutoff web once held on the collecting and cutting cylinder 10 and transported around it is superposed on the web W held on the folding cylinder 11, and the resulting double-cutoff web stack is single parallel folded between the folding cylinder 11 and the jaw cylinder 12. The resulting single parallel folded signatures are fed from the reduction cylinder 13, and allocated by the switching means (to be described later) to the upper transfer cylinder 14 and the lower transfer cylinder 15 for delivery (upper-lower two-stage delivery; transport path), or they are merged for delivery to either of the upper transfer cylinder 14 and the lower transfer cylinder 15 (upper or lower one-stage delivery; transport path).

The collecting and cutting cylinder 10, as shown in FIG. 3 and FIGS. 4A, 4B, is formed of a triple-diameter cylinder having the cutoff knives 20*a* to 20*c* and the pins 21*a* to 21*c* disposed at positions dividing its circumferential surface into three equal parts in the circumferential direction, the cutoff knives 20*a* to 20*c* being adapted to cut the web W to predetermined dimensions, and a plurality of the pins 21*a* to 21*c* being provided in the axial direction and being capable of holding the cutoff web. The respective pins 21*a* to 21*c* are urged by an urging member (torsion bar; not shown) in a direction in which they protrude from the circumferential surface of the collecting and cutting cylinder 10. Cam followers 22*a* to 22*c* for them roll over a predetermined cam surface of a pin cam 23 (to be described later), whereby the pins 21*a* to 21*c* can move to sink.

The pin cam 23 comprises an all-around cam, and is fixedly provided on a cam holder 28 on the gear side of a machine frame 24, the cam holder 28 being externally fitted rotatably onto a shaft 10*a* of the collecting and cutting cylinder 10 via a bearing 25 and being internally fitted rotatably via a bearing 27 to a jogger bearing 26 fixedly provided on the machine frame 24.

The cam holder 28 (pin cam 23) is rotationally driven at a speed 1.5 times that of the collecting and cutting cylinder 10 during collect folding, and is fixed at a predetermined rotating position during non-collect folding.

That is, as shown in FIG. 20, a transmission gear 29*a* is mounted on the shaft 10*a* of the collecting and cutting cylinder 10, and the transmission gear 29*a* meshes with an input gear 31*a* of a clutch 30A. The cam holder 28 is mounted integrally with a cam gear 32, and the cam gear 32 meshes with an output gear 33*a* of the clutch 30A. Thus, when the input gear 31*a* and the output gear 33*a* are coupled together by the operation (ON) of the clutch 30A, the cam gear 32 rotates in accordance with the rotation of the collecting and cutting cylinder 10. As a result, the pin cam 23 rotates at a speed 1.5 times that of the collecting and cutting cylinder 10 according to the setting of a gear ratio in the gear train.

On the other hand, the machine frame 24 is provided with an air cylinder 34 for cam fixing, and a cam fixing lever 35 is mounted on the air cylinder 34. A cam follower 36 is mounted on the cam fixing lever 35 and, during the aforementioned collect folding, the cam follower 36 becomes non-fitted to a groove 32*a* of the cam gear 32, thereby enabling the aforementioned rotation of the pin cam 23. During non-collect folding, under non-operating conditions (OFF) of the aforementioned clutch 30A, the cam follower 36 is fitted to the groove 32*a* of the cam gear 32, thereby fixing the rotating position of the pin cam 23.

The above clutch 30A is also provided with a proximity switch 37*a*, and the cam gear 32 is mounted with a proximity dog 38*a*. Thus, if the clutch 30A is turned off during non-collect folding, the cam gear 32 is rotated with inertia. When the proximity switch 37*a* detects the proximity dog 38*a* during the inertial rotation, the air cylinder 34 contracts to swing the cam fixing lever 35, thereby fitting the cam follower 36 into the groove 32*a* of the cam gear 32. As a result, the rotation of the cam gear 32 is stopped, and the pin cam 23 is fixed at the predetermined rotating position.

The pin cam 23, as shown in FIGS. 10A and 10B, has a cam surface as an upward inclined surface (a lower part⇒a higher part) indicated by a region A (hereinafter referred to as the cam surface A), a higher cam surface indicated by a region B (hereinafter referred to as the cam surface B), a cam surface as a downward inclined surface (a higher part⇒a lower part) indicated by a region C (hereinafter referred to as the cam surface C), and a lower cam surface indicated by a region D (hereinafter referred to as the cam surface D).

When the aforementioned cam followers 22*a* to 22*c* roll over the cam surface A of the pin cam 23, the pins 21*a* to 21*c* move from the protruding position to the sinking position with respect to the surface of the collecting and cutting cylinder 10. When the cam followers 22*a* to 22*c* roll over the cam surface B of the pin cam 23, the pins 21*a* to 21*c* maintain the sinking position. When the cam followers 22*a* to 22*c* roll over the cam surface C of the pin cam 23, the pins 21*a* to 21*c* move from the sinking position to the protruding position. When the cam followers 22*a* to 22*c* roll over the cam surface D of the pin cam 23, the pins 21*a* to 21*c* maintain the protruding position.

Thus, during non-collect folding, the pin cam 23 is fixed at the rotating position shown in FIG. 10A. Thus, with the pins 21*a* to 21*c* of the collecting and cutting cylinder 10 being located at the position opposing the folding cylinder 11, the cam followers 22*a* to 22*c* constantly roll over the cam surface A to the cam surface B of the pin cam 23. As a result, the pins 21*a* to 21*c* keep sinking, failing to hold the cutoff web.

During collect folding, on the other hand, the pin cam 23 rotates at a speed 1.5 times that of the collecting and cutting cylinder 10. As shown in FIG. 10B, therefore, with the pins 21*a* to 21*c* of the collecting and cutting cylinder 10 being located at the position opposing the folding cylinder 11, the cam followers 22*a* to 22*c* roll over the cam surface A to the cam surface D of the pin cam 23. As a result, the pins 21*a* to 21*c* protrude, holding the cutoff web. Alternatively, the cam followers 22*a* to 22*c* roll over the cam surface C to the cam surface B of the pin cam 23, with the result that the pins 21*a* to 21*c* sink, failing to hold the cutoff web. These motions are alternately repeated.

That is, during collect folding, the pin cam 23 rotates at the 1.5-fold speed, so that the cam followers 22*a* to 22*c* roll over the cam surfaces of the pin cam 23 in the order D⇒C⇒B⇒A⇒D. In other words, during collect folding, the region A defines the downward inclined surface (higher part⇒lower part), and the region C defines the upward inclined surface (lower part⇒higher part). This is the opposite of non-collect folding.

The folding cylinder 11, as shown in FIG. 3 and FIGS. 5A, 5B, is formed of a quadruple-diameter cylinder having the cut bearers 40*a* to 40*d* and the pins 41*a* to 41*d* disposed at positions dividing its circumferential surface into four equal parts in the circumferential direction, the cut bearers 40*a* to 40*d* corresponding to the cutoff knives 20*a* to 20*c* of the collecting and cutting cylinder 10, and a plurality of the pins 41*a* to 41*d* being provided in the axial direction and being capable of holding the cutoff web. The folding cylinder 11 also has the sucker blades 42*a* to 42*d* provided at positions intermediate between the above-mentioned positions, a plurality of the sucker blades 42*a* to 42*d* being arranged parallel in the axial direction and constituting a set. The respective pins 41*a* to 41*d* and the respective sucker blades 42*a* to 42*d* are urged by urging members (torsion bars; not shown) in a direction in which they protrude from the circumferential surface of the folding cylinder 11.

A sucker blade cam 45, over which respective cam followers 44*a* to 44*d* of the sucker blades 42*a* to 42*d* roll, comprises an all-around cam and, on the gear side of the machine frame 24, is fixedly provided on a jogger bearing 47 which supports a shaft 11*a* of the folding cylinder 11 rotatably via a bearing 46. A transmission gear 29*b* is mounted on the shaft 11*a* of the folding cylinder 11.

On the counter-gear side of the machine frame 24, a pin main cam 50 comprising an all-around cam is fixedly provided on a jogger bearing 49 which supports a shaft 11*b* of the folding cylinder 11 rotatably via a bearing 48. A pin sub-cam 52 comprising an arcuate cam is fixedly provided on a cam holder 51 which is rotatably fitted to the outer periphery of the jogger bearing 49. A rod leading end of an air cylinder 53 for cam switching is pinned to the cam holder 51, and a head proximal end of the air cylinder 53 is pinned to the machine frame 24.

Of cam followers 43*a* to 43*d* of the respective pins 41*a* to 41*d*, the cam followers 43*a* and 43*c* located in point symmetry roll over the pin main cam 50 only, while the cam followers 43*b* and 43*d* similarly located in point symmetry can roll over both of the pin main cam 50 and the pin sub-cam 52 astride them.

The sucker blade cam 45, as shown in FIG. 11, has a cam surface as an upward inclined surface (a lower part⇒a higher part) indicated by a region A (hereinafter referred to as the cam surface A), a higher cam surface indicated by a region B (hereinafter referred to as the cam surface B), a cam surface as a downward inclined surface (a higher part ⇒a lower part) indicated by a region C (hereinafter referred to as the cam surface C), and a lower cam surface indicated by a region D (hereinafter referred to as the cam surface D).

When the aforementioned cam followers 44*a* to 44*d* roll over the cam surface A of the sucker blade cam 45, the sucker blades 42*a* to 42*d* move from the protruding position to the sinking position with respect to the surface of the folding cylinder 11. When the cam followers 44*a* to 44*d* roll over the cam surface B of the sucker blade cam 45, the sucker blades 42*a* to 42*d* maintain the sinking position. When the cam followers 44*a* to 44*d* roll over the cam surface C of the sucker blade cam 45, the sucker blades 42*a* to 42*d* move from the sinking position to the protruding position. When the cam followers 44*a* to 44*d* roll over the cam surface D of the sucker blade cam 45, the sucker blades 42*a* to 42*d* maintain the protruding position.

Thus, during non-collect folding and collect folding, with the sucker blades 42*a* to 42*d* of the folding cylinder 11 being located at the position opposing the collecting and cutting cylinder 10, the cam followers 44*a* to 44*d* roll over the cam surface B of the sucker blade cam 45. As a result, the sucker blades 42*a* to 42*d* constantly sink, and do not interfere with the collecting and cutting cylinder 10. At the position of the sucker blades 42*a* to 42*d* opposing the jaw cylinder 12, the cam followers 44*a* to 44*d* roll over the cam surface C to the cam surface D of the sucker blade cam 45, whereby the sucker blades 42*a* to 42*d* constantly protrude, making parallel folding of the cutoff web possible.

The pin main cam 50, as shown in FIG. 12, has a cam surface as an upward inclined surface (a lower part⇒a higher part) indicated by a region A (hereinafter referred to as the cam surface A), a higher cam surface indicated by a region B (hereinafter referred to as the cam surface B), a cam surface as a downward inclined surface (a higher part⇒a lower part) indicated by a region C (hereinafter referred to as the cam surface C), and a lower cam surface indicated by a region D (hereinafter referred to as the cam surface D).

When the aforementioned cam followers 43*a* to 43*d* roll over the cam surface A of the pin main cam 50, the pins 41*a* to 41*d* move from the protruding position to the sinking position with respect to the surface of the folding cylinder 11. When the cam followers 43*a* to 43*d* roll over the cam surface B of the pin main cam 50, the pins 41*a* to 41*d* maintain the sinking position. When the cam followers 43*a* to 43*d* roll over the cam surface C of the pin main cam 50, the pins 41*a* to 41*d* move from the sinking position to the protruding position. When the cam followers 43*a* to 43*d* roll over the cam surface D of the pin main cam 50, the pins 41*a* to 41*d* maintain the protruding position.

On the other hand, the pin sub-cam 52, as shown in FIGS. 13A and 13B, has a higher cam surface indicated by a region B' corresponding to (of the same shape as) the cam surface B of the pin main cam 50 (hereinafter referred to as the cam surface B'), a cam surface as a downward inclined surface (a higher part⇒a lower part) indicated by a region C' corresponding to (of the same shape as) the cam surface C of the pin main cam 50 (hereinafter referred to as the cam surface C'), and a lower cam surface indicated by a region D' corresponding to (of the same shape as) the cam surface D of the pin main cam 50 (hereinafter referred to as the cam surface D').

When the aforementioned cam followers 43*b*, 43*d* roll over the cam surface B' of the pin sub-cam 52, the pins 41*b*, 41*d* maintain the sinking position with respect to the surface of the folding cylinder 11. When the cam followers 43*b*, 43*d* roll over the cam surface C' of the pin sub-cam 52, the pins 41*b*, 41*d* move from the sinking position to the protruding position. When the cam followers 43*b*, 43*d* roll over the cam surface D' of the pin sub-cam 52, the pins 41*b*, 41*d* maintain the protruding position.

Thus, during non-collect folding, the pin sub-cam 52 rotates clockwise via the cam holder 51 upon contraction of the air cylinder 53, and is switched to the position where its cam surfaces B', C' and D' coincide with (overlap) the cam surfaces B, C and D of the pin main cam 50, as shown in FIGS. 12 and 13A.

As a result, at the position opposing the collecting and cutting cylinder 10, the pins 41*b*, 41*d*, like the pins 41*a*, 41*c*, protrude from the circumferential surface of the folding cylinder 11 to hold the cutoff web, since the cam followers 43*b*, 43*d*, like the cam followers 43*a*, 43*c*, roll over the cam surfaces C and C' to the cam surfaces D and D' of the pin main cam 50 and the pin sub-cam 52. At the predetermined rotating position past the position opposing the jaw cylinder 12, the pins 41*b*, 41*d*, like the pins 41*a*, 41*c*, sink below the circumferential surface of the folding cylinder 11 to release the cutoff web, since the cam followers 43*b*, 43*d*, like the cam followers 43*a*, 43*c*, roll over the cam surface A of the pin main cam 50 to the cam surfaces B and B'.

During collect folding, as shown in FIG. 13B, the pin sub-cam 52 rotates counterclockwise via the cam holder 51 upon extension of the air cylinder 53, and is switched to a position displaced by a predetermined phase where at least an end side of the cam surface B' coincides with the cam surface B of the pin main cam 50, at least an end side of the cam surface D' coincides with the cam surface D of the pin main cam 50, and the cam surface C' does not coincide with the cam surface C of the pin main cam 50.

As noted above, the pins 41*b*, 41*d*, unlike the above-mentioned pins 41*a*, 41*c*, maintain sinking with respect to the circumferential surface of the folding cylinder 11, failing to hold the cutoff web, since the cam followers 43*b*, 43*d* roll over the cam surface B' of the pin sub-cam 52 at the position opposing the collecting and cutting cylinder 10. That is, the cam followers 43*b*, 43*d* roll over the cam surface B' of the pin sub-cam 52 without moving from the cam surface B to the cam surfaces C and D of the pin main cam 50, whereby the pins 41*b*, 41*d* maintain the sinking position without moving from the sinking position to the protruding position.

The jaw cylinder 12, as shown in FIG. 3 and FIGS. 6A, 6B, is formed of a quadruple-diameter cylinder having the gripper boards 55*a* to 55*d* and the gripper jaws 54*a* to 54*d* provided at positions dividing its circumferential surface into four equal parts in the circumferential direction, the gripper boards 55*a* to 55*d* and gripper jaws 54*a* to 54*d* corresponding to the sucker blades 42*a* to 42*d* of the folding cylinder 11. The respective gripper boards 55*a* to 55*d* are of a cam-open design, and are usually urged in a closing direction by the force of a spring.

On the counter-gear side of the machine frame 24, a gripping main cam 59 comprising an all-around cam is fixedly provided on a jogger bearing 58 which supports a shaft 12*b* of the jaw cylinder 12 rotatably via a bearing 57. A gripping sub-cam 61 comprising an arcuate cam is fixedly provided on a cam holder 60 which is rotatably fitted to the outer periphery of the jogger bearing 58. A rod leading end of an air cylinder 62 for cam switching is pinned to the cam holder 60, and a head proximal end of the air cylinder 62 is pinned to the machine frame 24. On the gear-side of the machine frame 24, a transmission gear 29*c* is mounted on the shaft 12*a* of the jaw cylinder 12.

Of cam followers 56*a* to 56*d* of the respective gripper boards 55*a* to 55*d*, the cam followers 56*a* and 56*c* located in point symmetry roll over the gripping main cam 59 only, while the cam followers 56*b* and 56*d* similarly located in point symmetry can roll over both of the gripping main cam 59 and the gripping sub-cam 61 astride them.

The gripping main cam 59, as shown in FIG. 14, has a cam surface as an upward inclined surface (a lower part⇒a higher part) indicated by a region A (hereinafter referred to as the cam surface A), a higher cam surface indicated by a region B (hereinafter referred to as the cam surface B), a cam surface as a downward inclined surface (a higher part⇒a lower part) indicated by a region C (hereinafter referred to as the cam surface C), and a lower cam surface indicated by a region D (hereinafter referred to as the cam surface D).

When the aforementioned cam followers 56*a* to 56*d* roll over the cam surface A of the gripping main cam 59, the gripper boards 55*a* to 55*d* move from a closed state to an open state with respect to the gripper jaws 54*a* to 54*d*. When the cam followers 56*a* to 56*d* roll over the cam surface B of the gripping main cam 59, the gripper boards 55*a* to 55*d* maintain the open state. When the cam followers 56*a* to 56*d* roll over the cam surface C of the gripping main cam 59, the gripper boards 55*a* to 55*d* move from the open state to the closed state. When the cam followers 56*a* to 56*d* roll over the cam surface D of the gripping main cam 59, the gripper boards 55*a* to 55*d* maintain the closed state.

On the other hand, the gripping sub-cam 61, as shown in FIGS. 15A and 15B, has, sequentially from the upstream side to the downstream side in the rotating direction of the jaw cylinder 12, a cam surface as a downward inclined surface (a higher part⇒a lower part) indicated by a region C' corresponding to (of the same shape as) the cam surface C of the gripping main cam 59 (hereinafter referred to as the cam surface C'), a cam surface as an upward inclined surface (a lower part⇒a higher part) indicated by a region A' corresponding to (of the same shape as) the cam surface A of the gripping main cam 59 (hereinafter referred to as the cam surface A'), a cam surface as a downward inclined surface (a higher part⇒a lower part) indicated by a region C' corresponding to (of the same shape as) the cam surface C of the gripping main cam 59 (hereinafter referred to as the cam surface C'), and a lower cam surface indicated by a region D' corresponding to (of the same shape as) the cam surface D of the gripping main cam 59 (hereinafter referred to as the cam surface D').

When the aforementioned cam followers 56*b*, 56*d* roll over the cam surface C' of the gripping sub-cam 61, the gripper boards 55*b*, 55*d* move from an open state to a closed state with respect to the gripper jaws 54*a* to 54*d*. When the cam followers 56*b*, 56*d* roll over the cam surface A' of the gripping sub-cam 61, the gripper boards 55*b*, 55*d* move from the closed state to the open state. When the cam followers 56*b*, 56*d* roll over the cam surface D' of the gripping sub-cam 61, the gripper boards 55*b*, 55*d* maintain the closed state.

Thus, during non-collect folding, the gripping sub-cam 61 rotates counterclockwise via the cam holder 60 upon extension of the air cylinder 62, and is switched to the position where its cam surfaces C', A' and C' are retracted with respect to the cam surfaces B, C of the gripping main cam 59, as shown in FIGS. 14 and 15A.

As a result, at the position opposing the folding cylinder 11, the gripper boards 55*b*, 55*d*, like the gripper boards 55*a*, 55*c*, are closed with respect to the gripper jaws 54*a* to 54*d* to hold the single parallel folded signature, since the cam followers 56*b*, 56*d*, like the cam followers 56*a*, 56*c*, roll over the cam surface C to the cam surface D of the gripping main cam 59. At the position opposing the reduction cylinder 13, on the other hand, the gripper boards 55*b*, 55*d*, like the gripper boards 55*a*, 55*c*, are open with respect to the gripper jaws 54*a* to 54*d* to release the single parallel folded signature, since the cam followers 56*b*, 56*d*, like the cam followers 56*a*, 56*c*, roll over the cam surface A to the cam surface B of the gripping main cam 59.

During collect folding, as shown in FIG. 15B, the gripping sub-cam 61 rotates clockwise via the cam holder 60 upon contraction of the air cylinder 62, and is switched to a position where the cam surfaces C', A', C', D' are displaced by a predetermined phase from the cam surfaces B, C, D of the gripping main cam 59 (the position where the connection between the cam surface A' and the cam surface C' in the gripping sub-cam 61 coincides with the connect ion between the cam surface C and the cam surface D in the gripping main cam 59).

Thus, at the position opposing the folding cylinder 11, the gripper boards 55*b*, 55*d*, unlike the gripper boards 55*a*, 55*c*, maintain an open state with respect to the gripper jaws 54*a* to 54*d*, failing to hold the cutoff web, since the cam followers 56*b*, 56*d* roll over the cam surface C' to the cam surface A' of the gripping sub-cam 61.

The reduction cylinder 13, as shown in FIG. 3 and FIGS. 7A, 7B, is formed of a sextuple-diameter cylinder having signature-holding grippers 65*a* to 65*f* provided at positions dividing its circumferential surface into six equal parts in the circumferential direction, the grippers 65*a* to 65*f* corresponding to the gripper boards 55*a* to 55*d* and the gripper jaws 54*a* to 54*d* of the jaw cylinder 12. The respective grippers 65*a* to 65*f* are of a cam-open design, and are usually urged in a closing direction by the force of springs.

Of cam followers 66*a* to 66*f* of the grippers 65*a* to 65*f*, the cam followers 66*a*, 66*c*, 66*e* arranged at alternate positions are composed of double cam followers (namely, the cam followers 66*a*, 66*c*, 66*e* on one side, and the cam followers 66*a*, 66*c*, 66*e* on the other side). These cam followers on one side roll over a gripper main cam (second fixed cam, switching means) 67 comprising an all-around cam, while the cam followers on the other side roll over a gripper rotating cam (rotating cam, switching means) 68 comprising a fan-shaped cam. The cam followers 66*b*, 66*d*, 66*f* similarly arranged at alternate positions roll over a gripper cam (first fixed cam, switching means) 69 comprising an all-around cam.

The gripper rotating cam 68, over which the cam followers 66*a*, 66*c*, 66*e* on the other side roll, is fixedly provided on a cam holder 73 on the gear side of the machine frame 24, the cam holder 73 being externally fitted rotatably onto a shaft 13*a* of the reduction cylinder 13 via a bearing 70 and being internally fitted rotatably via a bearing 72 to a jogger bearing 71 fixedly provided on the machine frame 24.

The cam holder 73 (gripper rotating cam 68) is rotationally driven at a speed 1.5 times that of the reduction cylinder 13 during upper-lower two-stage delivery in collect folding, and is fixed at a predetermined rotating position during upper one-stage delivery in collect folding and during non-collect folding.

That is, as shown in FIG. 21, a transmission gear 29*d* is mounted on the shaft 13*a* of the reduction cylinder 13, and the transmission gear 29*d* meshes with an input gear 31*b* of a clutch 30B (switching means). The cam holder 73 is mounted integrally with a cam gear 74, and the cam gear 74 meshes with an output gear 33*b* of the clutch 30B. Thus, when the input gear 31*b* and the output gear 33*b* are coupled together by the operation (ON) of the clutch 30B during upper-lower two-stage delivery in collect folding, the cam gear 74 rotates in accordance with the rotation of the reduction cylinder 13. As a result, the gripper rotating cam 68 rotates at a speed 1.5 times that of the reduction cylinder 13 according to the setting of a gear ratio in the gear train.

On the other hand, the machine frame 24 is provided with an air cylinder (switching means) 75 for cam fixing, and a cam fixing lever 76 is mounted on the air cylinder 75. A cam follower 77 is mounted on the cam fixing lever 76. During the aforementioned upper-lower two-stage delivery in collect folding, the cam follower 77 becomes non-fitted to a groove 74*a* of the cam gear 74, thereby enabling the aforementioned rotation of the gripper rotating cam 68. During upper one-stage delivery in collect folding and during non-collect folding, under non-operating conditions (OFF) of the aforementioned clutch 30B, the cam follower 77 is fitted to the groove 74*a* of the cam gear 74, thereby fixing the rotating position of the gripper rotating cam 68.

The above clutch 30B is also provided with a proximity switch 37*b* (not shown), and the cam gear 74 is mounted with a proximity dog 38*b*. Thus, if the clutch 30B is turned off during upper one-stage delivery in collect folding and during non-collect folding, the cam gear 74 is rotated with inertia. When the proximity switch 37*b* detects the proximity dog 38*b* during this inertial rotation, the air cylinder 75 contracts to swing the cam fixing lever 76, thereby fitting the cam follower 77 into the groove 74*a* of the cam gear 74. As a result, the rotation of the cam gear 74 is stopped, and the gripper rotating cam 68 is fixed at the predetermined rotating position.

The gripper main cam 67, over which the cam followers 66*a*, 66*c*, 66*e* on the one side roll, is fixedly provided on the aforementioned jogger bearing 71. The gripper cam 69, over which the respective cam followers 66*b*, 66*d*, 66*f* roll, is fixedly provided on a jogger bearing 79 on the counter-gear side of the machine frame 24, the jogger bearing 79 supporting the shaft 13*b* of the reduction cylinder 13 rotatably via a bearing 78.

The gripper main cam 67, as shown in FIG. 16, has a cam surface as an upward inclined surface (a lower part⇒a higher part) indicated by a region A (hereinafter referred to as the cam surface A), a higher cam surface indicated by a region B (hereinafter referred to as the cam surface B), a cam surface as a downward inclined surface (a higher part⇒a lower part) indicated by a region C (hereinafter referred to as the cam surface C), and a lower cam surface indicated by a region D (hereinafter referred to as the cam surface D).

When the aforementioned cam followers 66*a*, 66*c*, 66*e* on the one side roll over the cam surface A of the gripper main cam 67, the grippers (the other first holding means) 65*a*, 65*c*, 65*e* move from a closed state to an open state. When the cam followers 66*a*, 66*c*, 66*e* on the one side roll over the cam surface B of the gripper main cam 67, the grippers 65*a*, 65*c*, 65*e* maintain the open state. When the cam followers 66*a*, 66*c*, 66*e* on the one side roll over the cam surface C of the gripper main cam 67, the grippers 65*a*, 65*c*, 65*e* move from the open state to the closed state. When the cam followers 66*a*, 66*c*, 66*e* on the one side roll over the cam surface D of the gripper main cam 67, the grippers 65*a*, 65*c*, 65*e* maintain the closed state.

Regardless of the folding specifications, therefore, the grippers 65*a*, 65*c*, 65*e*, when located at the position opposing the jaw cylinder 12, make an opening⇒closing motion to receive the signature from the jaw cylinder 12 and grip it, since the cam followers 66*a*, 66*c*, 66*e* on the one side roll over the cam surface C to the cam surface D of the gripper main cam 67. Then, at the position opposing the upper transfer cylinder 14, the cam followers 66*a*, 66*c*, 66*e* on the one side roll over the cam surface A to the cam surface B of the gripper main cam 67, whereby the grippers 65*a*, 65*c*, 65*e* make a closing⇒opening motion to pass the signature on to the upper transfer cylinder 14.

The gripper rotating cam 68, over which the cam followers 66*a*, 66*c*, 66*e* on the other side roll, as shown in FIGS. 17A and 17B, has two lower cam surfaces each indicated by a region D' (each hereinafter referred to as the cam surface D') corresponding to the cam surface D of the gripper main cam 67, a higher cam surface indicated by a region B' (hereinafter referred to as the cam surface B') corresponding to the cam surface B of the gripper main cam 67, a cam surface as an upward inclined surface (a lower part⇒a higher part) indicated by a region A' (hereinafter referred to as the cam surface A') corresponding to the cam surface A of the gripper main cam 67, and a cam surface as a downward inclined surface (a higher part⇒a lower part) indicated by a region C' (hereinafter referred to as the cam surface C') corresponding to the cam surface C of the gripper main cam 67, the cam surfaces B', A' and C' being located between the two cam surfaces D', and the cam surfaces A' and C' being provided on both sides of the cam surface B'.

When the aforementioned cam followers 66*a*, 66*c*, 66*e* roll over the cam surface A' of the gripper main cam 67, the grippers 65*a*, 65*c*, 65*e* move from a closed state to an open state. When the cam followers 66*a*, 66*c*, 66*e* roll over the cam surface B' of the gripper main cam 67, the grippers 65*a*, 65*c*, 65*e* maintain the open state. When the cam followers 66*a*, 66*c*, 66*e* roll over the cam surface C' of the gripper main cam 67, the grippers 65*a*, 65*c*, 65*e* move from the open state to the closed state. When the cam followers 66*a*, 66*c*, 66*e* roll over the cam surface D' of the gripper main cam 67, the grippers 65*a*, 65*c*, 65*e* maintain the closed state.

Thus, during upper one-stage delivery in collect folding and during non-collect folding, the rotating position where the gripper rotating cam 68 is fixed is a position hidden by the cam surface B of the gripper main cam 67, and is not involved in the opening and closing motions of the grippers 65*a*, 65*c*, 65*e*, as shown in FIG. 17A.

During upper-lower two-stage delivery in collect folding, on the other hand, the grippers 65*a*, 65*c*, 65*e*, at the position opposing the lower transfer cylinder 15, make a closing⇒opening motion to pass the held signature on to the lower transfer cylinder 15, since the cam followers 66*a*, 66*c*, 66*e* roll over the cam surface A' to the cam surface B' of the gripper rotating cam 68, as shown in FIG. 17B.

The gripper cam 69, over which the cam followers 66*b*, 66*d*, 66*f* roll, as shown in FIG. 18, has two cam surfaces each as an upward inclined surface (a lower part⇒a higher part) indicated by a region A (each hereinafter referred to as the cam surface A), two higher cam surfaces each indicated by a region B (each hereinafter referred to as the cam surface B), two cam surfaces each as a downward inclined surface (a higher part⇒a lower part) indicated by a region C (each hereinafter referred to as the cam surface C), and two lower cam surfaces each indicated by a region D (each hereinafter referred to as the cam surface D), the two cam surfaces A, B, C and D being provided in point symmetry.

When the aforementioned cam followers 66*b*, 66*d*, 66*f* roll over the cam surface A of the gripper cam 69, the grippers (one set of first holding means) 65*b*, 65*d*, 65*f* move from a closed state to an open state. When the cam followers 66*b*, 66*d*, 66*f* roll over the cam surface B of the gripper cam 69, the grippers 65*b*, 65*d*, 65*f* maintain the open state. When the cam followers 66*b*, 66*d*, 66*f* roll over the cam surface C of the gripper cam 69, the grippers 65*b*, 65*d*, 65*f* move from the open state to the closed state. When the cam followers 66*b*, 66*d*, 66*f* roll over the cam surface D of the gripper cam 69, the grippers 65*b*, 65*d*, 65*f* maintain the closed state.

During non-collect folding, therefore, the grippers 65*b*, 65*d*, 65*f*, at the position opposing the jaw cylinder 12, make an opening⇒closing motion to receive the signature from the jaw cylinder 12 and grip it, since the cam followers 66*b*, 66*d*, 66*d* roll over the cam surface C to the cam surface D of the gripper cam 69. Then, the grippers 65*b*, 65*d*, 65*f*, at the position opposing the lower transfer cylinder 15, make a closing⇒opening motion to pass the signature on to the lower transfer cylinder 15, since the cam followers 66*b*, 66*d*, 66*d* roll over the cam surface A to the cam surface B of the gripper cam 69.

The upper transfer cylinder 14, as shown in FIG. 3 and FIGS. 8A, 8B, is formed of a quadruple-diameter cylinder having signature-holding grippers 80*a*, 80*b* provided at positions dividing its circumferential surface into two equal parts in the circumferential direction, the grippers 80*a*, 80*b* corresponding to the grippers 65*a*, 65*c*, 65*e* of the reduction cylinder 13. The grippers 80*a*, 80*b* are each of a cam-open design, and are each usually urged in a closing direction by the force of a spring.

Cam followers 81*a*, 81*b* of the grippers 80*a*, 80*b* can roll over a gripper main cam (fourth fixed cam, switching means) 83 comprising an all-around cam.

The gripper main cam 83 is fixedly provided on a jogger bearing 85 on the counter-gear side of the machine frame 24, the jogger bearing 85 supporting a shaft 14*b* of the upper transfer cylinder 14 rotatably via a bearing 84. On the gear-side of the machine frame 24, a transmission gear 29*e* is mounted on a shaft 14*a* of the upper transfer cylinder 14.

The gripper main cam 83, as shown in FIG. 18, has a cam surface as an upward inclined surface (a lower part⇒a higher part) indicated by a region A (hereinafter referred to as the cam surface A), a higher cam surface indicated by a region B (hereinafter referred to as the cam surface B), a cam surface as a downward inclined surface (a higher part⇒a lower part) indicated by a region C (hereinafter referred to as the cam surface C), and a lower cam surface indicated by a region D (hereinafter referred to as the cam surface D).

When the aforementioned cam followers 81*a*, 81*b* roll over the cam surface A of the gripper main cam 83, the grippers 80*a*, 80*b* move from a closed state to an open state. When the cam followers 81*a*, 81*b* roll over the cam surface B of the gripper main cam 83, the grippers 80*a*, 80*b* maintain the open state. When the cam followers 81*a*, 81*b* roll over the cam surface C of the gripper main cam 83, the grippers 80*a*, 80*b* move from the open state to the closed state. When the cam followers 81*a*, 81*b* roll over the cam surface D of the gripper main cam 83, the grippers 80*a*, 80*b* maintain the closed state.

Regardless of the folding specifications, therefore, the grippers 80*a*, 80*b*, at the position opposing the reduction cylinder 13, make an opening⇒closing motion to receive the signature from the reduction cylinder 13 and grip it, since the cam followers 81*a*, 81*b* roll over the cam surface C to the cam surface D of the gripper main cam 83 (see FIG. 16). Then, at the position opposing an upper conveyor belt 100A, the cam followers 81*a*, 81*b* roll over the cam surface A to the cam surface B of the gripper main cam 83, whereby the grippers 80*a*, 80*b* make a closing⇒opening motion to pass the signature on to the upper conveyor belt 100A.

The lower transfer cylinder 15, as shown in FIG. 3 and FIGS. 9A, 9B, is formed of a quadruple-diameter cylinder having signature-holding grippers 90*a*, 90*b* provided at positions dividing its circumferential surface into two equal parts in the circumferential direction, the grippers 90*a*, 90*b* corresponding to the grippers 65*b*, 65*d*, 65*f* of the reduction cylinder 13 during non-collect folding and corresponding to the grippers 65*a*, 65*c*, 65*e* of the reduction cylinder 13 during collect folding as a result of phase switching (to be described later). The grippers 90*a*, 90*b* are each of a cam-open design, and are each usually urged in a closing direction by the force of a spring.

On the counter-gear side of the machine frame 24, a gripper main cam (third fixed cam, switching means) 94 comprising an all-around cam is fixedly provided on a jogger bearing 93 which supports a shaft 15*b* of the lower transfer cylinder 15 rotatably via a bearing 92. A gripper sub-cam (moving cam, switching means) 96 comprising an arcuate cam is fixedly provided on a cam holder 95 which is rotatably fitted to the outer periphery of the jogger bearing 93. A rod leading end of an air cylinder (switching means) 97 for cam switching is pinned to the cam holder 95, and a head proximal end of the air cylinder 97 is pinned to the machine frame 24. On the gear-side of the machine frame 24, a transmission gear 29*f* is mounted on a shaft 15*a* of the lower transfer cylinder 15.

A cam follower 91*a* of the gripper 90*a* rolls over the gripper main cam 94 only, while a cam follower 91*b* of the gripper 90*b* can roll over both of the gripper main cam 94 and the gripper sub-cam 96 astride them.

The gripper main cam 94, as shown in FIG. 18, has a cam surface as an upward inclined surface (a lower part⇒a higher part) indicated by a region A (hereinafter referred to as the cam surface A), a higher cam surface indicated by a region B (hereinafter referred to as the cam surface B), a cam surface as a downward inclined surface (a higher part⇒a lower part) indicated by a region C (hereinafter referred to as the cam surface C), and a lower cam surface indicated by a region D (hereinafter referred to as the cam surface D).

When the aforementioned cam followers 91*a*, 91*b* roll over the cam surface A of the gripper main cam 94, the grippers 90*a*, 90*b* move from a closed state to an open state. When the cam followers 91*a*, 91*b* roll over the cam surface B of the gripper main cam 94, the grippers 90*a*, 90*b* maintain the open state. When the cam followers 91*a*, 91*b* roll over the cam surface C of the gripper main cam 94, the grippers 90*a*, 90*b* move from the open state to the closed state. When the cam followers 91*a*, 91*b* roll over the cam surface D of the gripper main cam 94, the grippers 90*a*, 90*b* maintain the closed state.

During non-collect folding, therefore, the grippers 90*a*, 90*b*, at the position opposing the reduction cylinder 13, make an opening⇒closing motion to receive the signature from the reduction cylinder 13 (its grippers 65*b*, 65*d*, 65*f*) and grip it, since the cam followers 91*a*, 91*b* roll over the cam surface C to the cam surface D of the gripper main cam 94. Then, at the position opposing a lower conveyor belt 100B, the cam followers 91*a*, 91*b* roll over the cam surface A to the cam surface B of the gripper main cam 94, whereby the grippers 90*a*, 90*b* make a closing⇒opening motion to pass the signature on to the lower conveyor belt 100B.

The gripper sub-cam 96, as shown in FIG. 19A, has a higher cam surface indicated by a region B' corresponding to (of the same shape as) the cam surface B of the gripper main cam 94 (hereinafter referred to as the cam surface B'), a cam surface as a downward inclined surface (a higher part⇒a lower part) indicated by a region C' corresponding to (of the same shape as) the cam surface C of the gripper main cam (hereinafter referred to as the cam surface C'), and a lower cam surface indicated by a region D' corresponding to (of the same shape as) the cam surface D of the gripper main cam 94 (hereinafter referred to as the cam surface D').

When the aforementioned cam follower 91 rolls over the cam surface B' of the gripper sub-cam 96, the gripper 90*b* maintains an open state. When the cam follower 91 rolls over the cam surface C' of the gripper sub-cam 96, the gripper 90*b* moves from the open state to a closed state. When the cam follower 91 rolls over the cam surface D' of the gripper sub-cam 96, the gripper 90*b* maintains the closed state.

During upper one-stage delivery in collect folding and during non-collect folding, therefore, the gripper sub-cam 96 is rotated counterclockwise via the cam holder 95 upon extension of the air cylinder 97, and is switched to the position where its cam surfaces B', C' and D' coincide with (overlap) the cam surfaces B, C and D of the gripper main cam 94. Thus, the gripper 90*b*, like the above-mentioned gripper 90*a*, moves from the open state to the closed state, at the position opposing the reduction cylinder 13, since the cam follower 91*b* rolls over the cam surface C' (to the cam surface D') of the gripper sub-cam 96.

During upper-lower two-stage delivery in collect folding, on the other hand, phase switching of the lower transfer cylinder 15 (to be described later) takes place. Also, the gripper sub-cam 96 is rotated clockwise via the cam holder 95 upon contraction of the air cylinder 97, and is switched to a position displaced by a predetermined phase where at least an end side of the cam surface B' coincides with the cam surface B of the gripper main cam 94, at least an end side of the cam surface D' coincides with the cam surface D of the gripper main cam 94, and the cam surface C' does not coincide with the cam surface C of the gripper main cam 94. These are as shown in FIG. 19B.

Consequently, the gripper 90*b*, unlike the aforementioned gripper 90*a*, maintains the open state, at the position opposing the reduction cylinder 13, since the cam follower 91*b* rolls over the cam surface B' of the gripper sub-cam 96. Thus, the signature is transported to the upper transfer cylinder 14.

During upper-lower two-stage delivery in collect folding, as stated above, the lower transfer cylinder 15 has a rotation phase shifted 90 degrees with respect to the reduction cylinder 13. A harmonic gear drive (registered trademark) apparatus 102 (see FIG. 3) publicly known as a differential mechanism is used as a phase switching mechanism for this purpose. In further detail, as shown in FIG. 22, the transmission gear 29*d* of the reduction cylinder 13 meshes via an intermediate gear 101 with an input gear 102*a* of the harmonic gear drive apparatus 102 driven by a gear 103*a* and a gear 102*c* by the action of a phase adjusting motor 103, while the transmission gear 29*f* of the lower transfer cylinder 15 meshes with an output gear 102*b* of the harmonic gear drive apparatus 102. In FIG. 22, the numeral 104 denotes an encoder of an absolute type as a phase detecting means.

According to the transport apparatus (folder) of the present embodiment, configured as above, the transport path is switched among upper-lower two-stage delivery in non-collect folding, upper one-stage delivery in collect folding, and upper-lower two-stage delivery in collect folding.

First of all, during upper-lower two-stage delivery in non-collect folding, various switching apparatuses are switched into a state shown in FIG. 3. That is, in the collecting and cutting cylinder 10, the clutch 30A is turned off, and the air cylinder 34 is contracted to fix the pin cam 23 at the aforementioned predetermined non-operating position, thereby making impossible the protrusion of the pins 21*a* to 21*c* at the position opposing the folding cylinder 11 (see FIG. 10A). In the folding cylinder 11, the air cylinder 53 is contracted to switch the pin sub-cam 52 to the solid-line position in the drawing, thereby making possible the protrusion of the pins 41*b*, 41*d* at the position opposing the collecting and cutting cylinder (see FIG. 13A).

In the jaw cylinder 12, the air cylinder 62 is extended to switch the gripping sub-cam 61 to the solid-line position in the drawing, thereby making possible the gripping closure of the gripper boards 55*a* to 55*d* at the position opposing the folding cylinder 11 (see FIG. 15A). In the reduction cylinder 13, the clutch 30B is turned off, and the air cylinder 75 is contracted to fix the gripper rotating cam 68 at the aforementioned predetermined non-operating position (see FIG. 17A).

In the lower transfer cylinder 15, the driving of the phase adjusting motor 103 is stopped (non-collect shaft phase is achieved), and the air cylinder 97 is extended to switch the gripper sub-cam 96 to the solid-line position in the drawing, thereby making possible the gripper closure of the grippers 90*a*, 90*b* at the position opposing the reduction cylinder 13 (see FIG. 19A).

In consequence, as shown in FIG. 23, a cutoff web Wa and a cutoff web Wb, which have been formed by cutting at the collecting and cutting cylinder 10 and continuously wrapped around the circumferential surface of the folding cylinder 11, are converted into a signature Sa and a signature Sb at the jaw cylinder 12, and transported to the reduction cylinder 13. These signatures are alternately allocated to the transfer cylinders such that the signature Sa is passed on to the upper transfer cylinder 14, while the signature Sb is passed on to the lower transfer cylinder 15, and then they are delivered.

Then, during upper one-stage delivery in collect folding, various switching apparatuses are switched from the state shown in FIG. 3. That is, in the collecting and cutting cylinder 10, the clutch 30A is turned on, and the air cylinder 34 is extended to rotate the pin cam 23 at a 1.5-fold speed, thereby making possible the protrusion of the alternate pins of the pins 21*a* to 21*c* at the position opposing the folding cylinder 11 (see FIG. 10B). In the folding cylinder 11, the air cylinder 53 is extended to switch the pin sub-cam 52 to the chain-line position in the drawing, thereby making impossible the protrusion of the pins 41*b*, 41*d* at the position opposing the collecting and cutting cylinder 10 (see FIG. 13B).

In the jaw cylinder 12, the air cylinder 62 is contracted to switch the gripping sub-cam 61 to the chain-line position in the drawing, thereby making possible the grip opening of the gripper boards 55*b*, 55*d* at the position opposing the folding cylinder 11 (see FIG. 15B). In the lower transfer cylinder 15, the driving of the phase adjusting motor 103 is stopped (non-collect shaft phase is achieved), and the air cylinder 97 is extended to switch the gripper sub-cam 96 to the solid-line position in the drawing, thereby making possible the gripper closure of the grippers 90*a*, 90*b* at the position opposing the reduction cylinder (see FIG. 19A).

In consequence, as shown in FIG. 24, a cutoff web Wa, which has been formed by cutting at the collecting and cutting cylinder 10 and held by every other pin of the collecting and cutting cylinder 10, and a cutoff web Wb, which has been held by every other pin of the folding cylinder 11, are transported as a two-ply combination by every other pin of the folding cylinder 11. At the jaw cylinder 12, the two-ply combination is converted into a signature Sa and a signature Sb, and transported to the reduction cylinder 13. From the reduction cylinder 13, the signature Sa and the signature Sb are not subjected to a receiving motion by the lower transfer cylinder 15 (in other words, the signatures Sa, Sb are not held by the grippers 65*b*, 65*d*, 65*f* of the reduction cylinder 13 so as to be passed on to the grippers 90*a*, 90*b* of the lower transfer cylinder 15), but they are both delivered to the upper transfer cylinder 14.

Then, during upper-lower two-stage delivery in collect folding, the various switching apparatuses are switched from the state shown in FIG. 3. That is, in the collecting and cutting cylinder 10, the clutch 30A is turned on, and the air cylinder 34 is extended to rotate the pin cam 23 at a 1.5-fold speed, thereby making possible the protrusion of the alternate pins of the pins 21*a* to 21*c* at the position opposing the folding cylinder 11 (see FIG. 10B). In the folding cylinder 11, the air cylinder 53 is extended to switch the pin sub-cam 52 to the chain-line position in the drawing, thereby making impossible the protrusion of the pins 41*b*, 41*d* at the position opposing the collecting and cutting cylinder 10 (see FIG. 13B).

In the jaw cylinder 12, the air cylinder 62 is contracted to switch the gripping sub-cam 61 to the chain-line position in the drawing, thereby making possible the grip opening of the gripper boards 55*b*, 55*d* at the position opposing the folding cylinder 11 (see FIG. 15B).

In the reduction cylinder 13, the clutch 30B is turned on, and the air cylinder 75 is extended to rotate the gripper rotating cam 68 at a 1.5-fold speed, thereby making possible the alternate gripper opening of the grippers 65*a*, 65*c*, 65*e* at the position opposing the lower transfer cylinder 15 (see FIG. 17B).

In the lower transfer cylinder 15, the phase adjusting motor 103 is driven to switch the phase by 90 degrees so that the grippers 90*a*, 90*b* can oppose the grippers 65*a*, 65*c*, 65*e* of the reduction cylinder 13 (the state is switched from the state of FIG. 24 to the state of FIG. 25). Also, the air cylinder 97 is contracted to switch the gripper sub-cam 96 to the dashed-line position in the drawing, thereby making possible the gripper closure of the gripper 90*a* at the position opposing the reduction cylinder 13, while making possible the gripper opening of the gripper 90*b* at the same position (see FIG. 19B).

In consequence, as shown in FIGS. 25, 26A and 26B, a cutoff web Wa, which has been formed by cutting at the collecting and cutting cylinder 10 and held on every other pin of the collecting and cutting cylinder 10, and a cutoff web Wb, which has been held on every other pin of the folding cylinder 11, are converted into a two-ply combination at every other pin of the folding cylinder 11 for transport. At the jaw cylinder 12, the two-ply combination is converted into a signature Sa and a signature Sb, and transported to the reduction cylinder 13. From the reduction cylinder 13, these signatures are alternately allocated to the transfer cylinders such that the signature Sa is passed onto the upper transfer cylinder 14, while the signature Sb is passed on to the lower transfer cylinder 15, and then they are delivered.

On this occasion, at the lower transfer cylinder 15, the signature Sb is received upon gripper closure of the gripper 90*a*, while the signature Sa is not received upon gripper opening of the gripper 90*b*, as stated earlier. The symbols A, B and C enclosed in circles at the reduction cylinder 13 in FIGS. 25A, 25B correspond to the collect shafts having the grippers 65*a*, 65*c* and 65*e* opening and closing during collect folding in FIG. 7A. Thus, the shafts having the grippers 65*b*, 65*d* and 65*f* in FIG. 7A are non-collect shafts.

According to the present embodiment, as described above, upper-lower two-stage delivery in collect folding can be performed. Thus, it becomes possible to effectively achieve an increase in productivity, prolongation of the life cycles of consumable parts, a decrease in the running cost, a lighter burden on the operator's work, and a reduction in spending on plants and equipment.

That is, upper-lower two-stage delivery in collect folding equalizes, the mechanical states in the upper and lower (two) stages, facilitates agreement between the states in the upper and lower (two) stages, and results in comparable consumption of consumable parts. Thus, the number of replacements can be decreased. Wasteful replacement of parts before expiration of their lives can also be prevented. The same effects as mentioned above can be expected of the stacker-bundler. Furthermore, the piling capacity of the stacker-bundler, etc. doubles. Thus, a high performance post-treatment apparatus such as a stacker-bundler is not necessary any more, leading to the increased operating speed of the machine.

In the pre sent embodiment, moreover, the gripper rotating cam 68 is used for the switching mechanism of the reduction cylinder 13. Thus, upper-lower two-stage delivery or upper one-stage delivery in collect folding can be carried out without complicating the cam mechanism even in the reduction cylinder 13 as a sextuple-diameter cylinder in which there are an odd number of the collect shafts having the grippers 65*a*, 65*c* and 65*e*. This brings the advantage that the larger diameter than that of, say, a quadruple-diameter cylinder the sextuple-diameter cylinder has, the larger space for maintenance is ensured.

Embodiment 2

Figure 27:
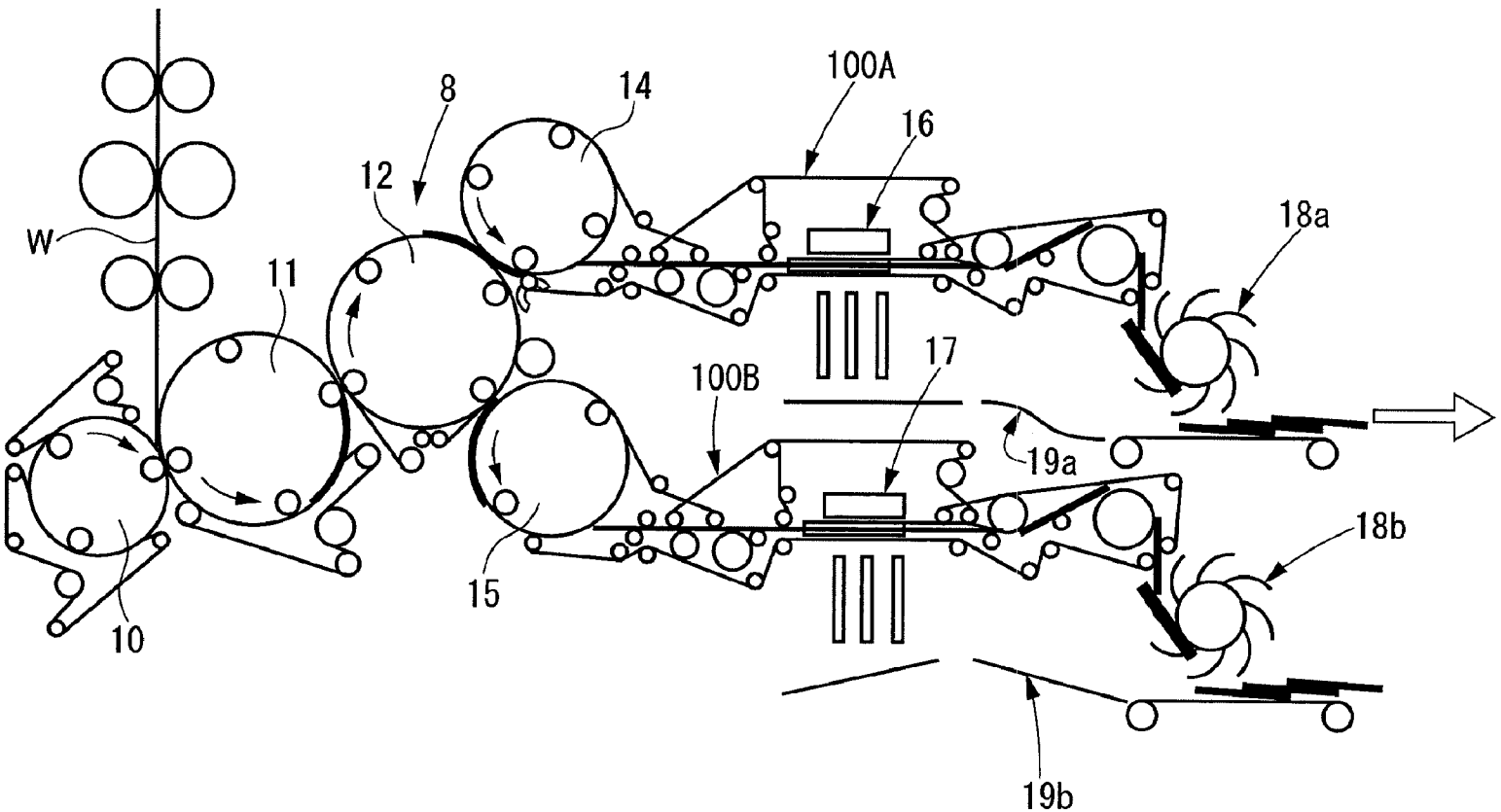
FIG. 27 is a schematic configurational drawing of a transport path of a folder in a web rotary printing press showing Embodiment 2 of the present invention.
Figure 28:
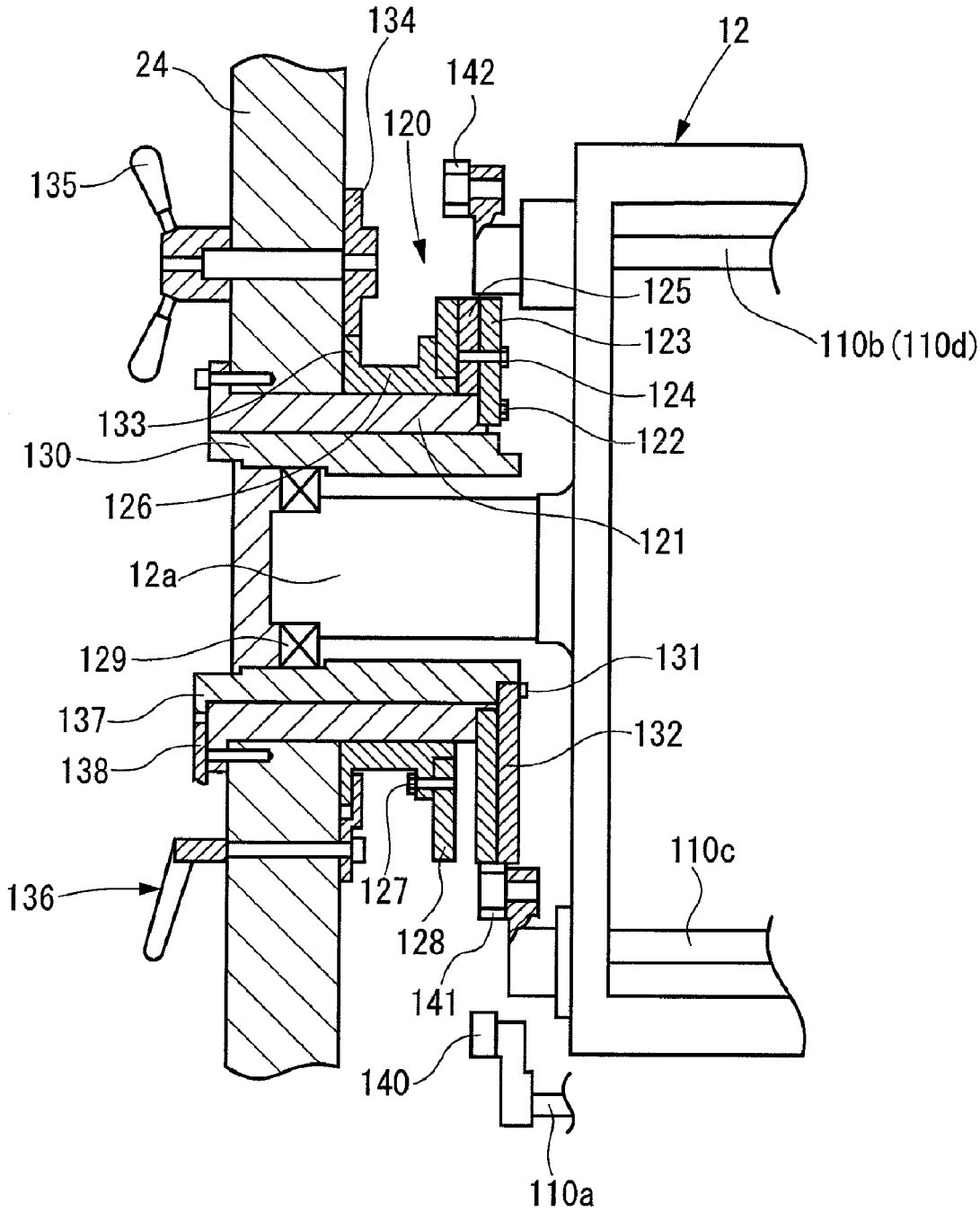
FIG. 28 is a structural drawing of a cam mechanism.
Figure 29:
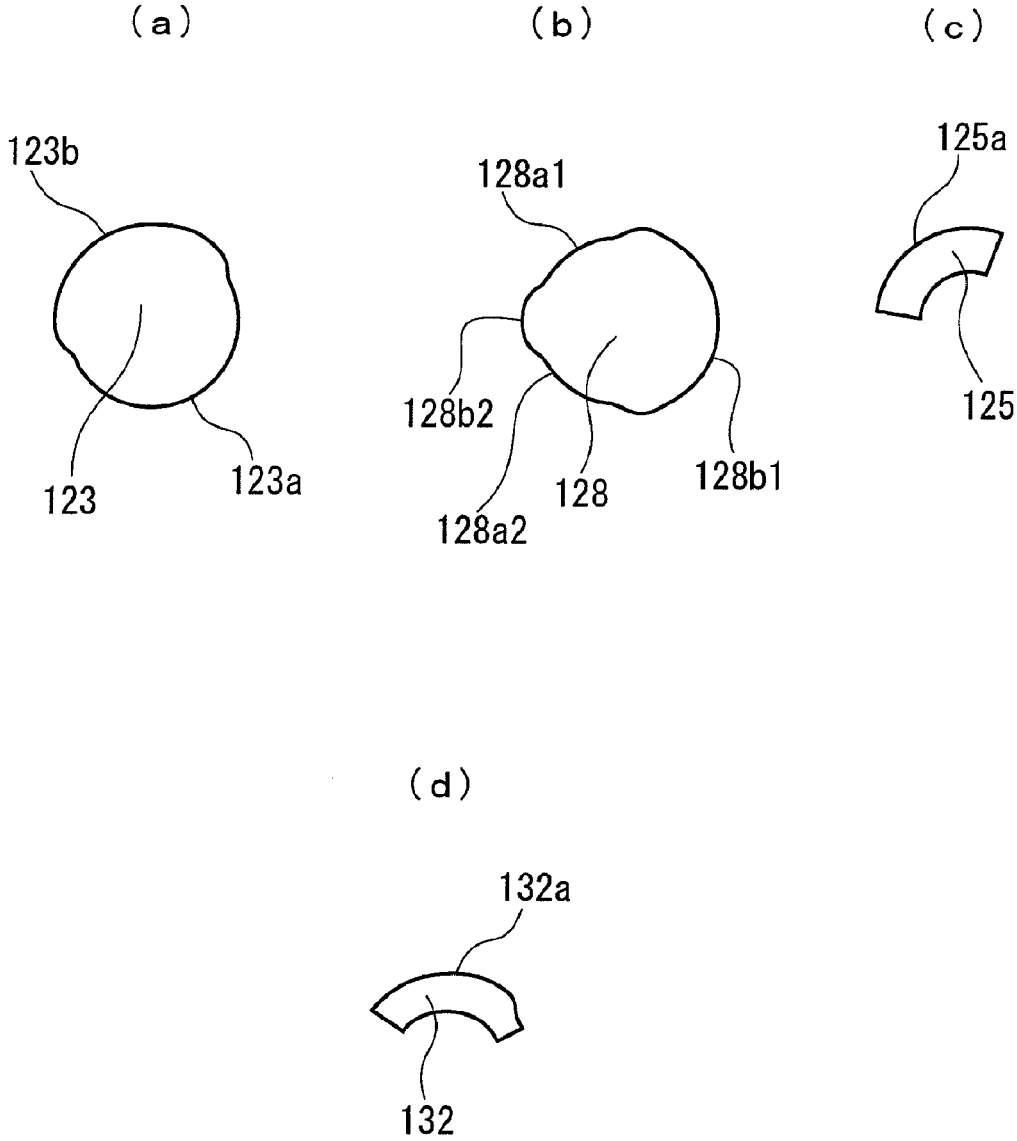
FIGS. 29(*a*) to 29(*d*) are explanation drawings of cams.
Figure 30:
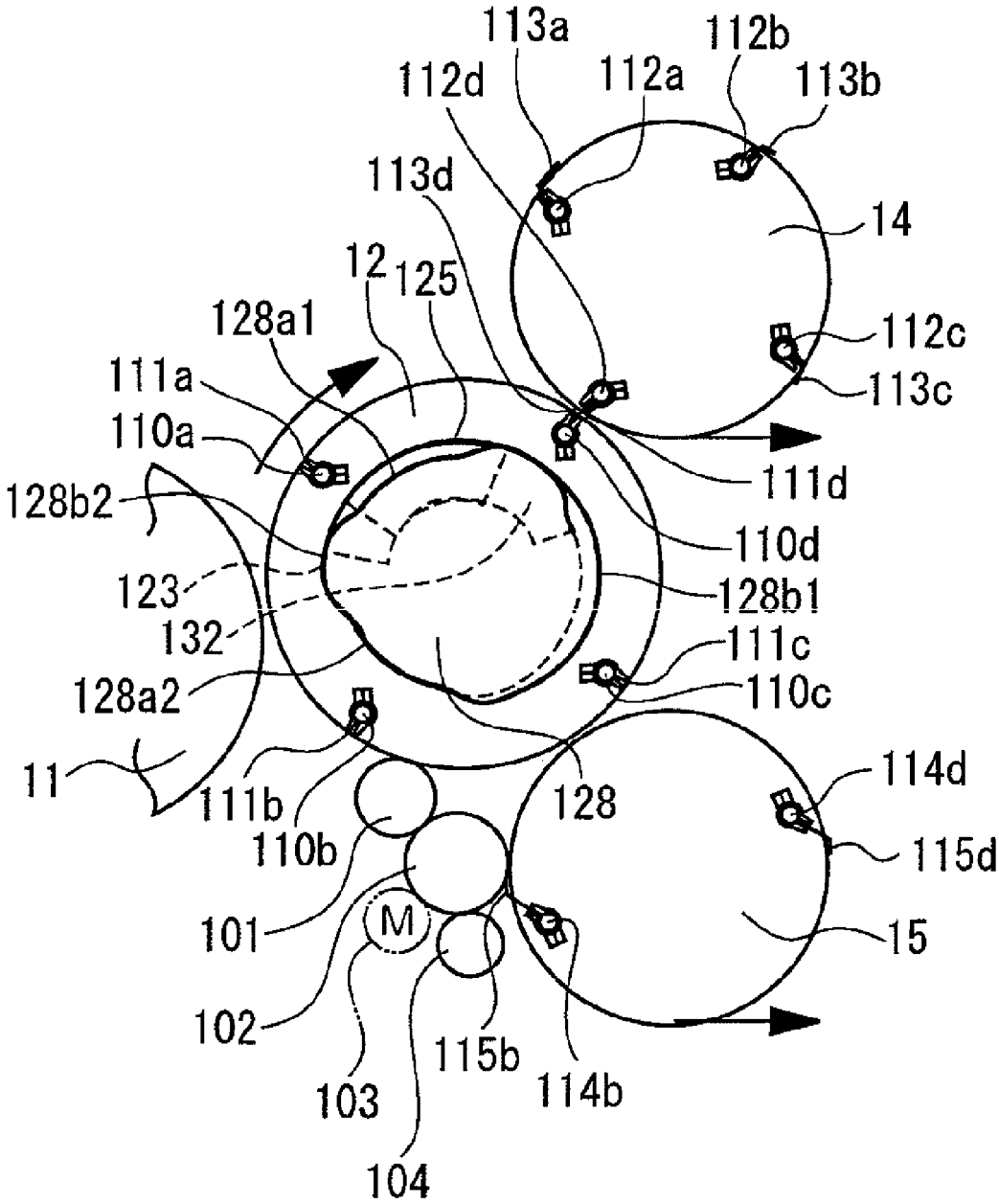
FIG. 30 is an explanation drawing of motions during upper-lower two-stage delivery in non-collect folding.
Figure 31:
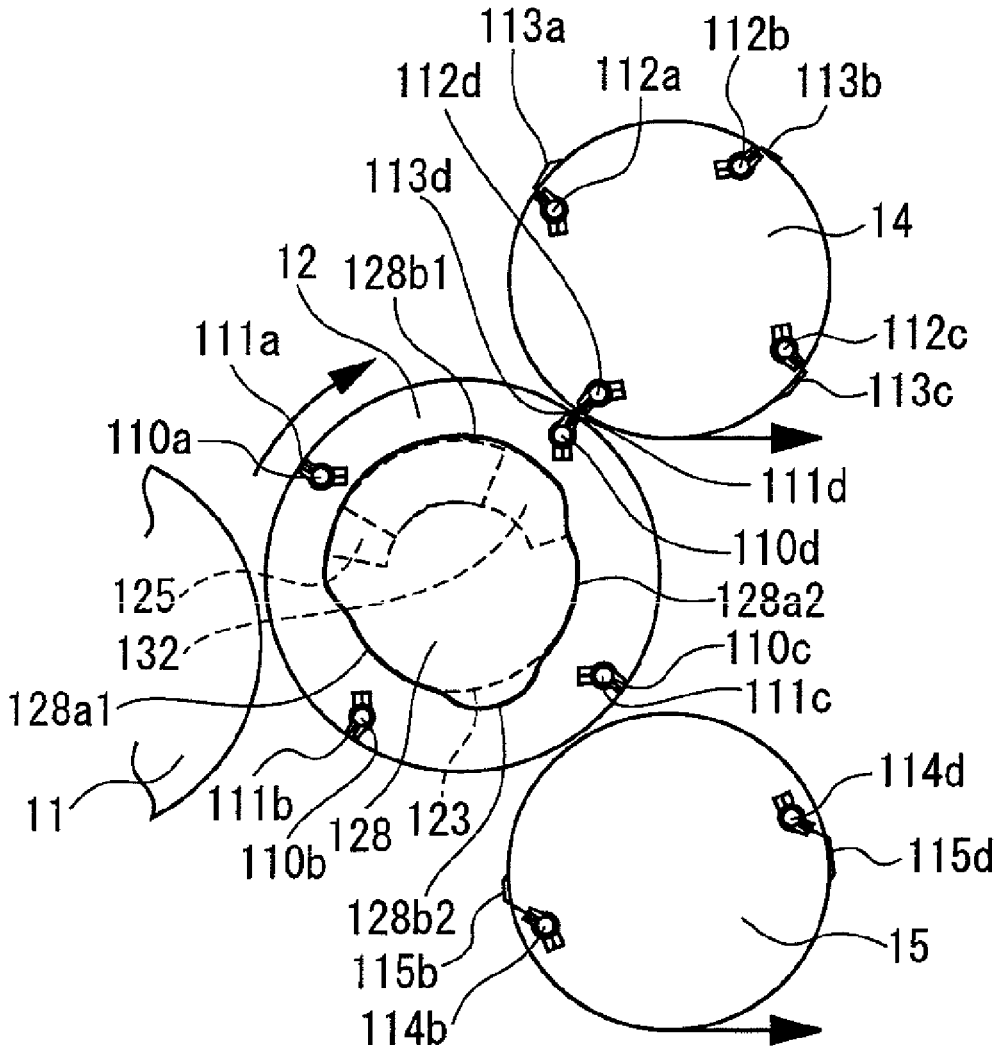
FIG. 31 is an explanation drawing of motions during upper one-stage delivery (merge delivery) in non-collect folding.
Figure 32:
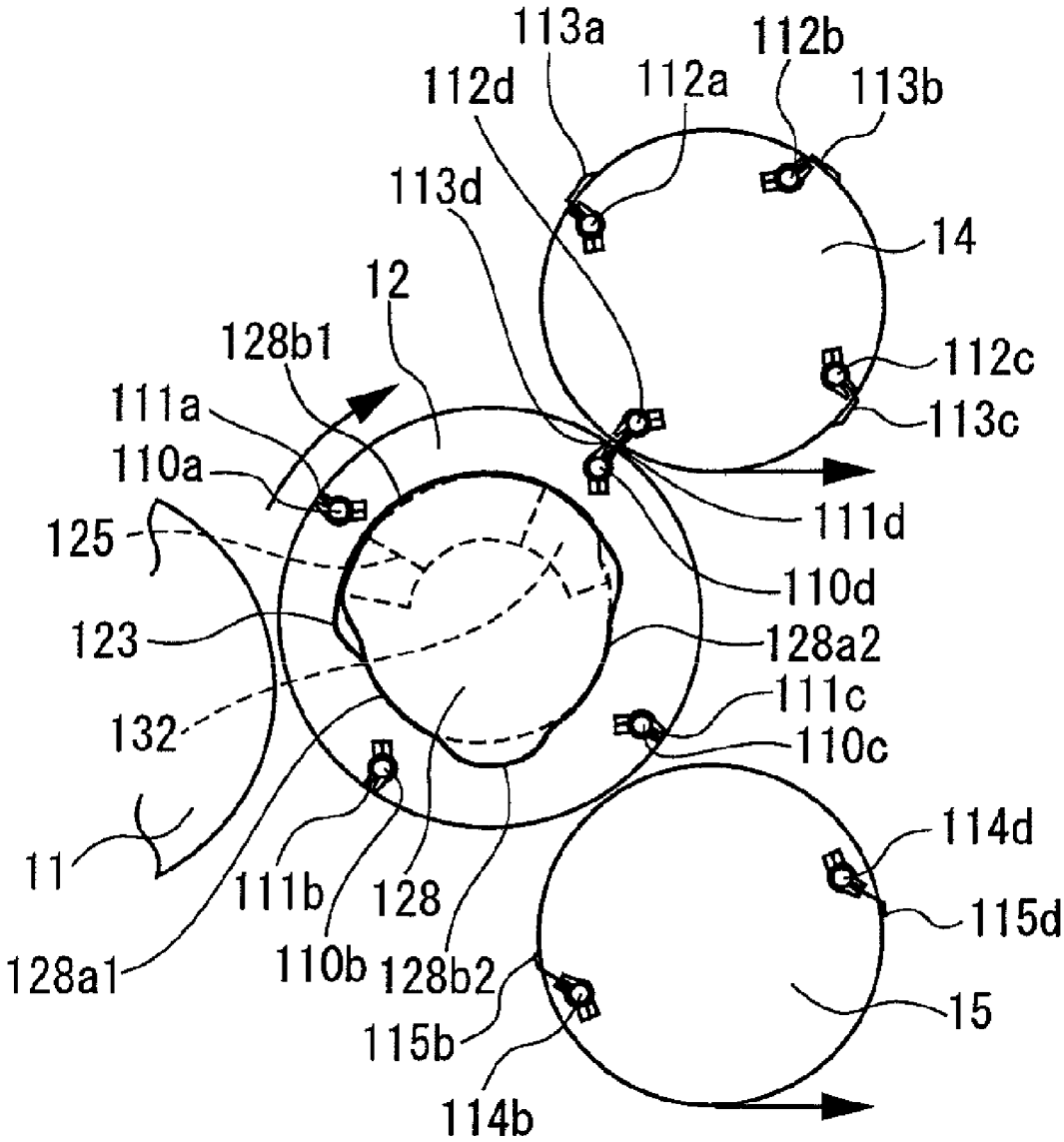
FIG. 32 is an explanation drawing of motions during upper one-stage delivery (merge delivery) in collect folding.
Figure 33:
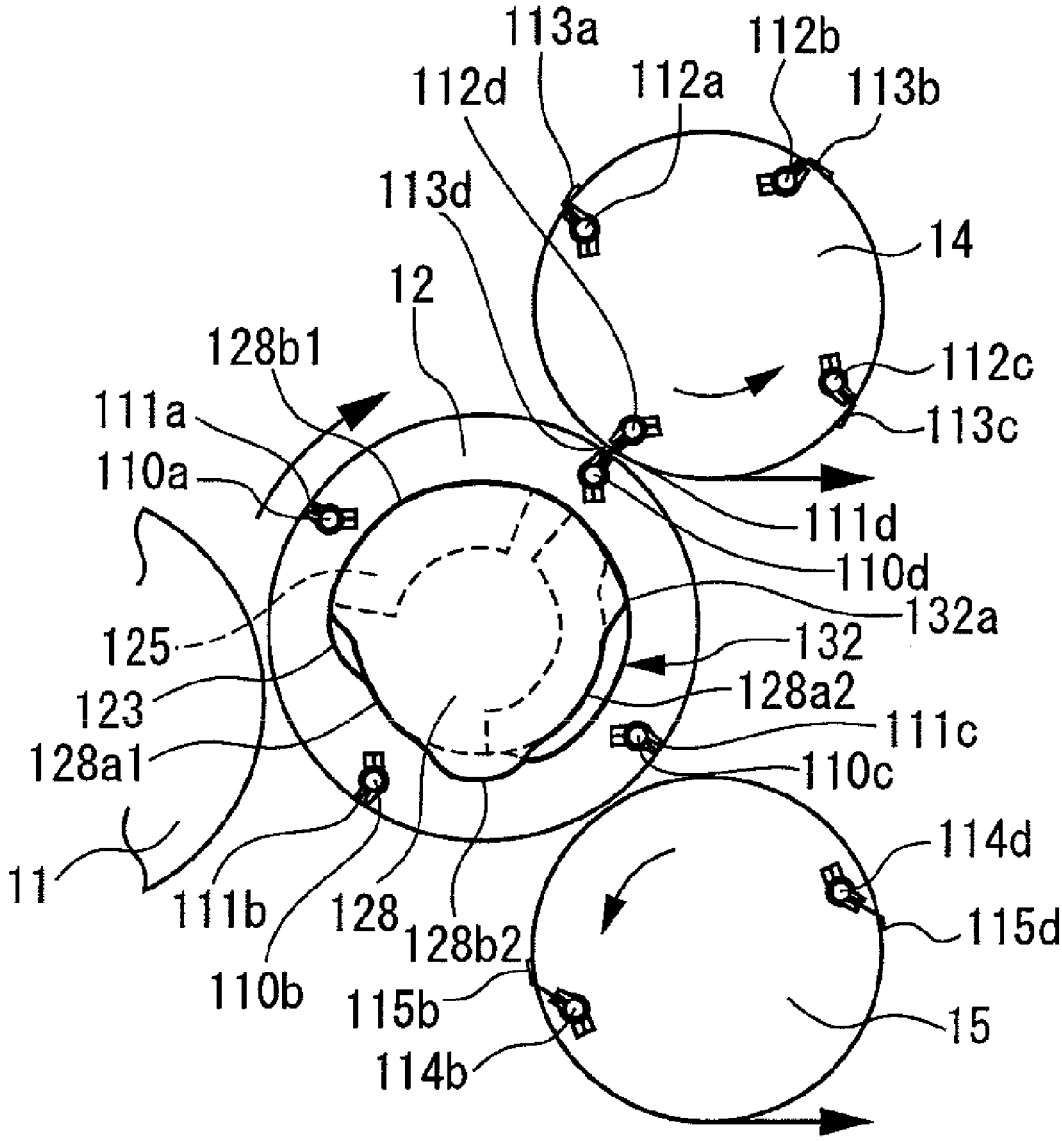
FIG. 33 is an explanation drawing of motions during upper-lower two-stage delivery in collect folding.

FIG. 27 is a schematic configurational drawing of a transport path of a folder in a web rotary printing press showing Embodiment 2 of the present invention. FIG. 28 is a structural drawing of a cam mechanism. FIGS. 29(*a*) to 29(*d*) are explanation drawings of cams. FIG. 30 is an explanation drawing of motions during upper-lower two-stage delivery in non-collect folding. FIG. 31 is an explanation drawing of motions during upper one-stage delivery (merge delivery) in non-collect folding. FIG. 32 is an explanation drawing of motions during upper one-stage delivery (merge delivery) in collect folding. FIG. 33 is an explanation drawing of motions during upper-lower two-stage delivery in collect folding.

Figure 34:
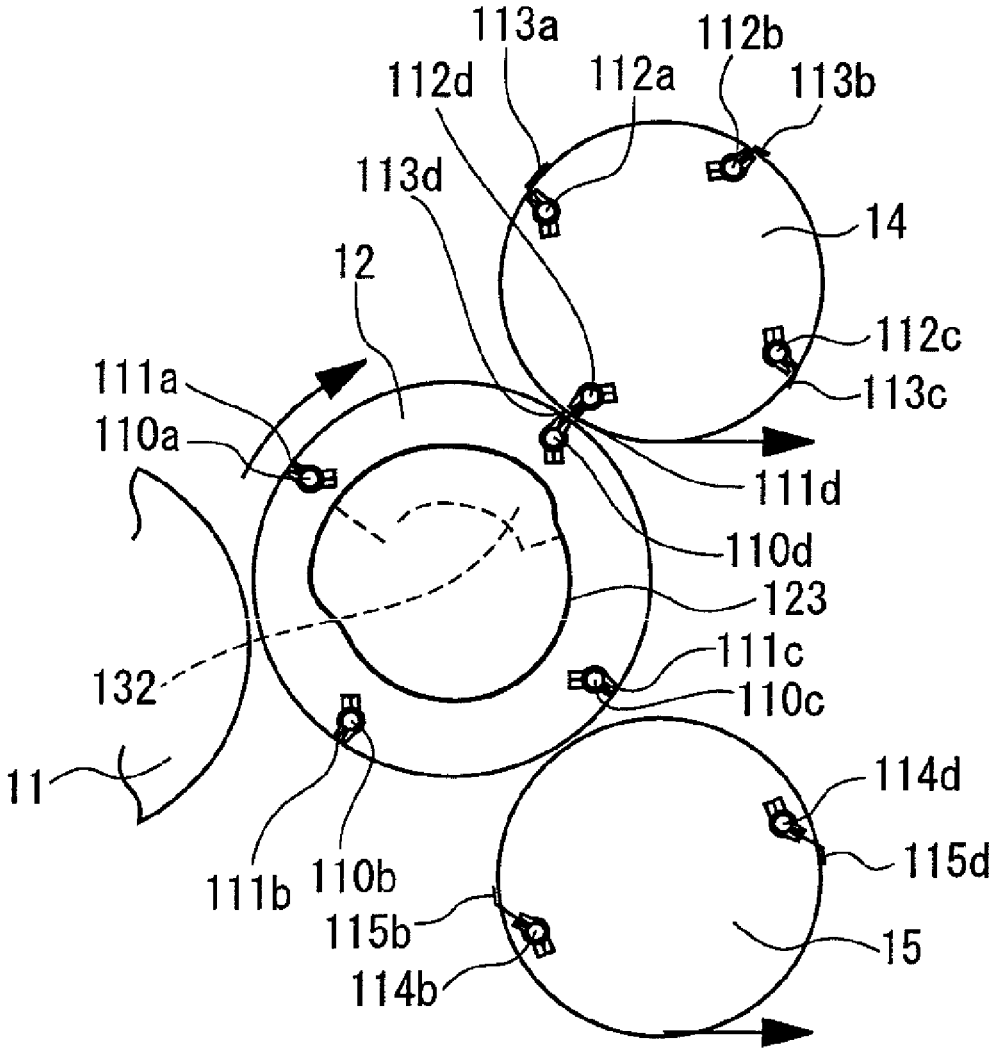
FIG. 34 is an extraction drawing of a first main cam and a second sub-cam during upper-lower two-stage delivery and upper one-stage delivery in non-collect folding and during upper one-stage delivery in collect folding.
Figure 35:
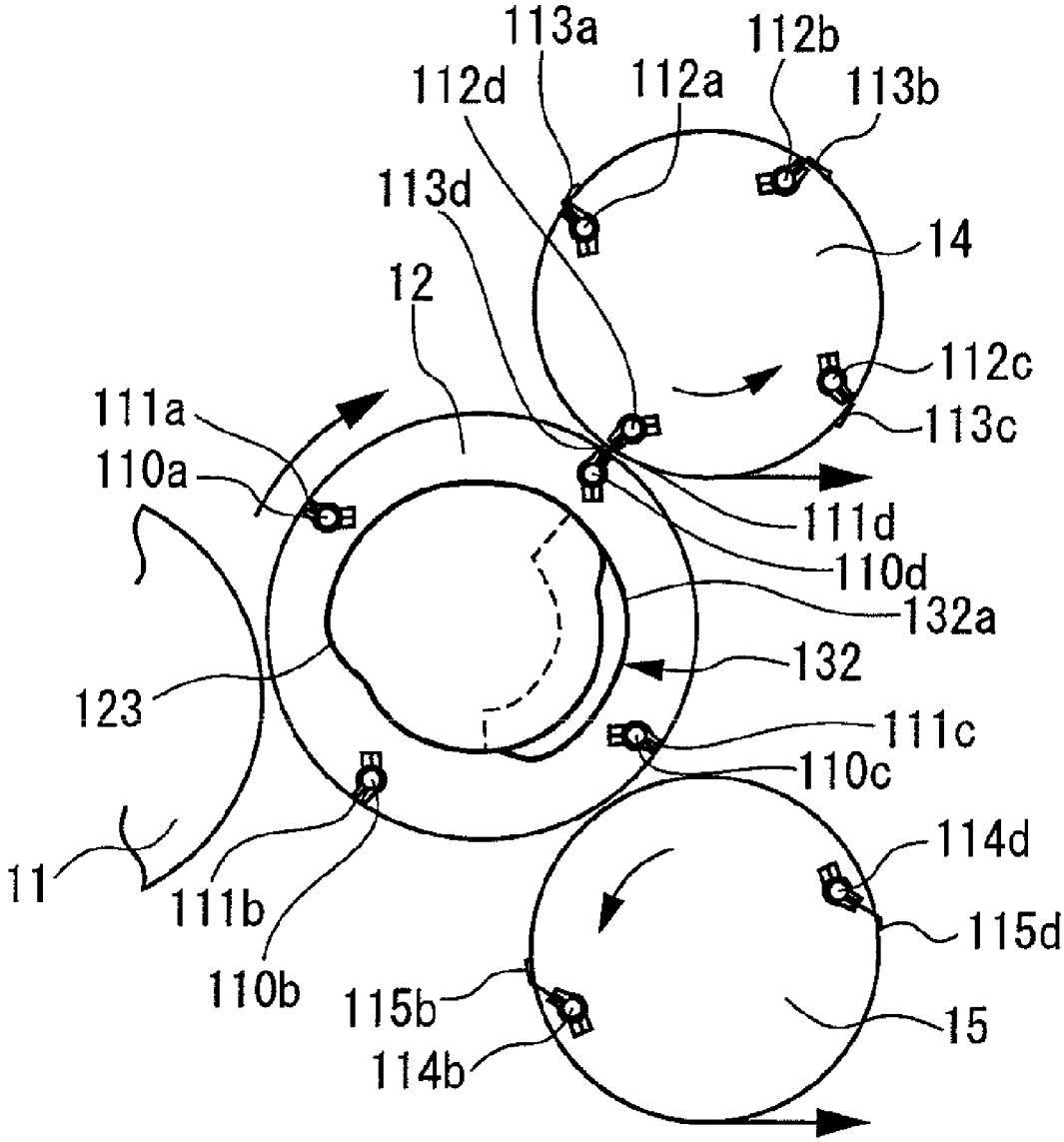
FIG. 35 is an extraction drawing of the first main cam and the second sub-cam during upper-lower two-stage delivery in collect folding.
Figure 36:
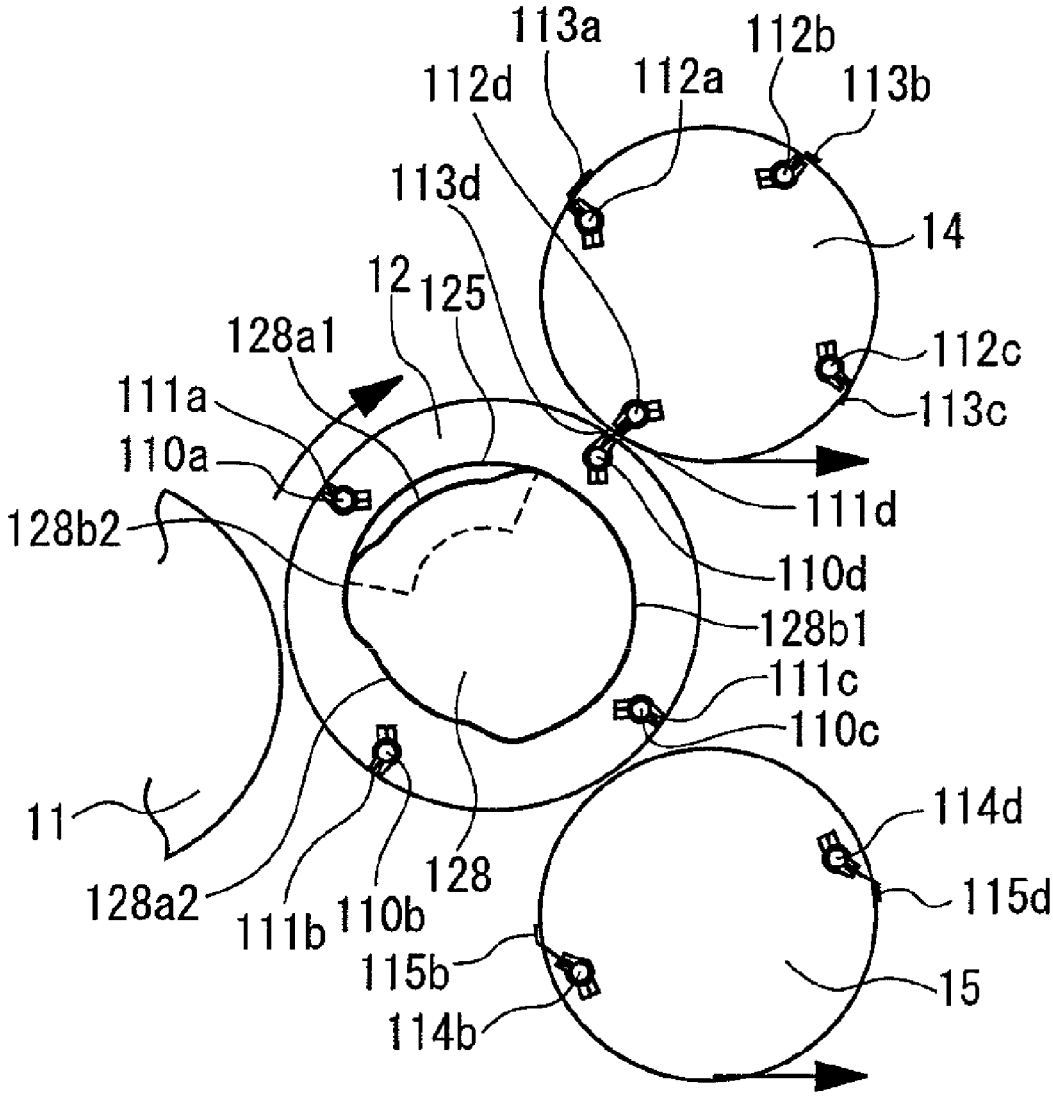
FIG. 36 is an extraction drawing of a second main cam and a first sub-cam during upper-lower two-stage delivery in non-collect folding.
Figure 37:
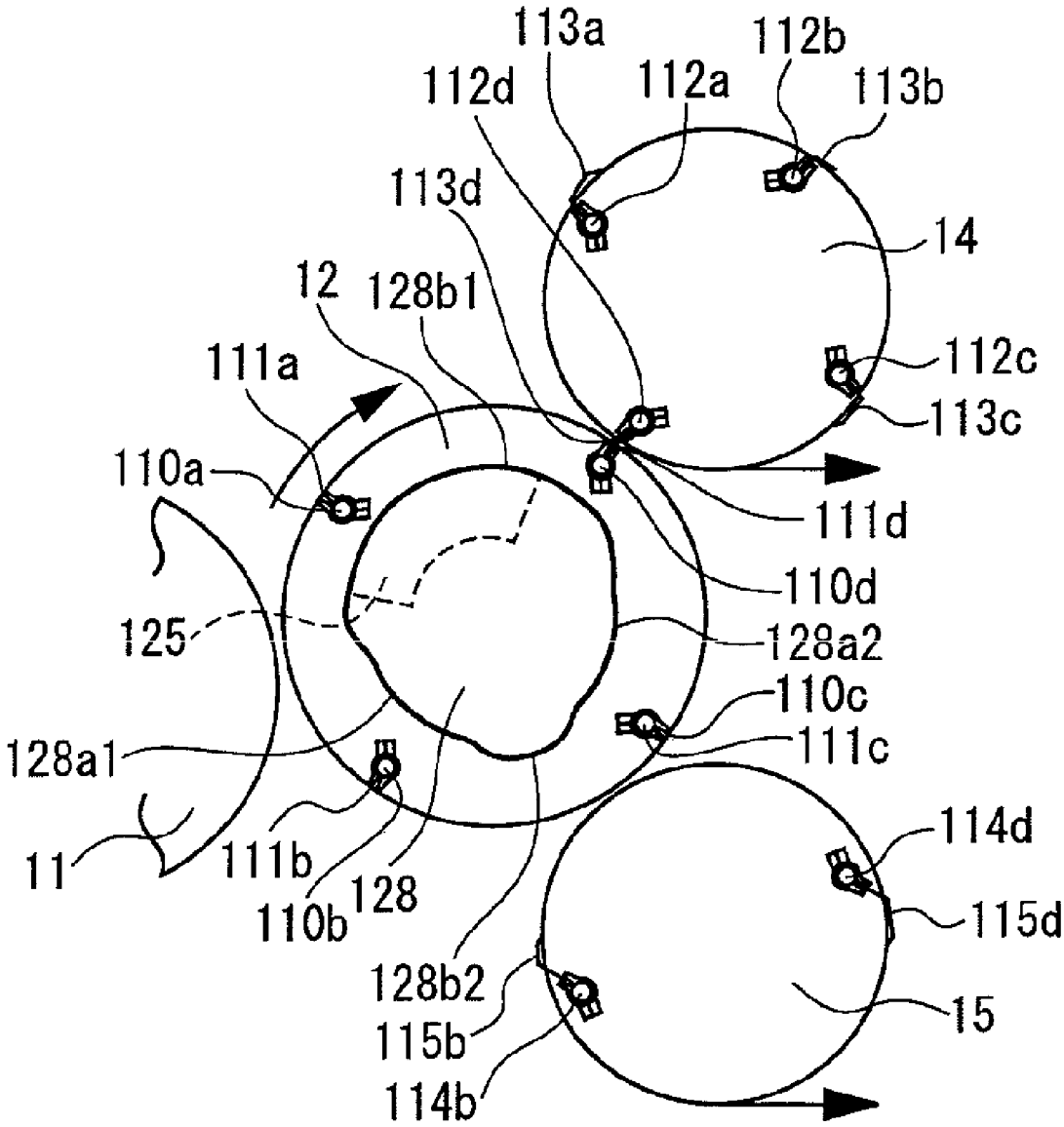
FIG. 37 is an extraction drawing of the second main cam and the first sub-cam during upper one-stage delivery in non-collect folding.
Figure 38:
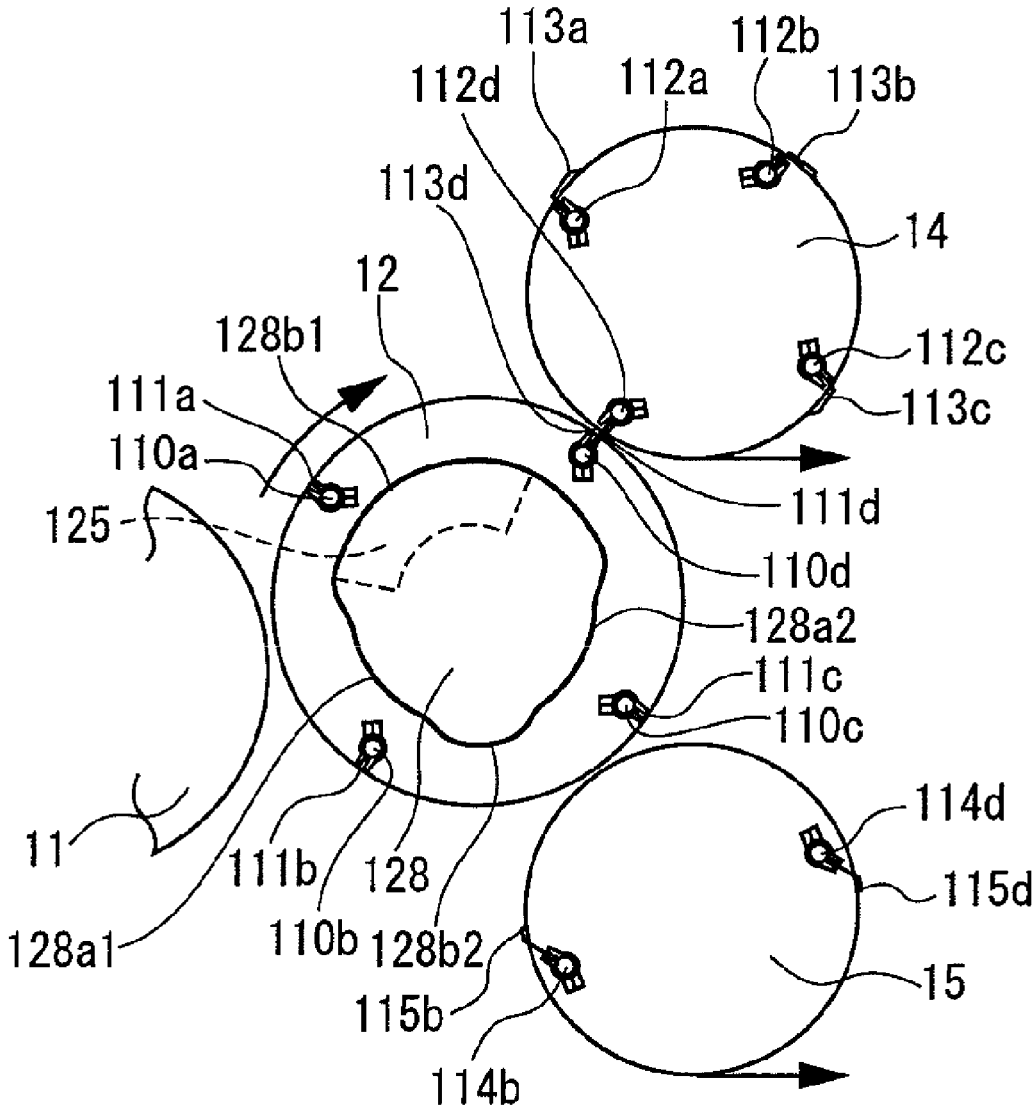
FIG. 38 is an extraction drawing of the second main cam and the first sub-cam during upper one-stage delivery and upper-lower two-stage delivery in collect folding.

FIG. 34 is an extraction drawing of a first main cam and a second sub-cam during upper-lower two-stage delivery and upper one-stage delivery in non-collect folding and during upper one-stage delivery in collect folding. FIG. 35 is an extraction drawing of the first main cam and the second sub-cam during upper-lower two-stage delivery in collect folding. FIG. 36 is an extraction drawing of a second main cam and a first sub-cam during upper-lower two-stage delivery in non-collect folding. FIG. 37 is an extraction drawing of the second main cam and the first sub-cam during upper one-stage delivery in non-collect folding. FIG. 38 is an extraction drawing of the second main cam and the first sub-cam during upper one-stage delivery and upper-lower two-stage delivery in collect folding.

As shown in FIG. 27, within a folder 8, a web W fed between a collecting and cutting cylinder 10 comprising a triple-diameter cylinder and a folding cylinder 11 comprising a quadruple-diameter cylinder is cut to predetermined dimensions by cut-off knives (not shown) of the collecting and cutting cylinder 10 and cut bearers (not shown) of the folding cylinder 11, for example, during upper-lower two-stage delivery (transport path) in non-collect folding. In this case, the web W is also held by pins (not shown) of the folding cylinder 11, and wrapped around the lower half of the circumferential surface of the folding cylinder 11.

The cutoff web (sheet) held by the pins of the folding cylinder 11 is then gripped by gripper boards (first holding means; to be described later) of a jaw cylinder (first transport cylinder) 12, which comprises a quadruple-diameter cylinder, and the web is single parallel folded in collaboration with sucker blades (not shown) of the folding cylinder 11. While being subjected to single parallel folding, the web is converted into a signature (sheet) and contacted with and along the upper circumferential surface of the jaw cylinder 12. Further, such single parallel folded signatures are sent from the gripper boards of the jaw cylinder 12 and alternately allocated to grippers (second holding means; to be described later) of an upper transfer cylinder (second transport cylinder) 14 comprising a quadruple-diameter cylinder, and to grippers (third holding means; to be described later) of a lower transfer cylinder (third transport cylinder) 15 comprising a quadruple-diameter cylinder, whereby the signatures are delivered. These signatures are chopper folded by an upper chopper folding apparatus 16 and a lower chopper folding apparatus 17, respectively. Alternatively, the signatures are passed, unchanged, through the upper chopper folding apparatus 16 and the lower chopper folding apparatus 17, and delivered to conveyors 19*a*, 19*b* via fan wheels 18*a*, 18*b*, respectively. Then, the signatures are piled on a stacker-bundler (not shown) as a post-treatment apparatus. Upper one-stage delivery (transport path) can also be performed by a switching means (to be described later).

During collect folding, the cutoff web once held on the collecting and cutting cylinder 10 and transported around it is superposed on the web W held on the folding cylinder 11, and the resulting double-ply cutoff web is single parallel folded at the jaw cylinder 12. The resulting single parallel folded signatures are fed from the jaw cylinder 12, and allocated by the switching means (to be described later) to the upper transfer cylinder 14 and the lower transfer cylinder 15 for delivery (upper-lower two-stage delivery; transport path), or they are delivered only to the upper transfer cylinder 14 (upper one-stage delivery; transport path).

As shown in FIG. 31, a multiplicity of gripper boards (first holding means) 111*a* to 111*d* are provided in the axial direction of gripper board shafts 110*a* to 110*d* disposed at positions dividing the circumferential surface of the jaw cylinder 12 into four equal parts. A multiplicity of grippers (second holding means) 113*a* to 113*d* are provided in the axial direction of gripper shafts 112*a* to 112*d* disposed at positions dividing the circumferential surface of the upper transfer cylinder 14 into four equal parts. A multiplicity of grippers (third holding means) 115*b*, 115*d* are provided in the axial direction of gripper shafts 114*b*, 114*d* disposed at positions dividing the circumferential surface of the lower transfer cylinder 15 into two equal parts. The grippers 113*a* to 113*d* of the upper transfer cylinder 14 sequentially oppose the gripper boards 111*a* to 111*d* of the jaw cylinder 12, and the grippers 115*b*, 115*d* of the lower transfer cylinder 15 only oppose the gripper boards 111*b*, 111*d* of the jaw cylinder 12.

As shown in FIG. 28, the jaw cylinder 12 is provided with a cam mechanism (switching means) 120 and, during non-collect folding, the cutoff web is held by all the pins of the folding cylinder 11. Thus, at the position opposing the sucker blades, the gripper boards 111*a* to 111*d* of the jaw cylinder 12 make an opening⇒closing motion. During collect folding, the folding cylinder 11 alternately has the pins holding the two cutoff webs stacked and the pins holding no cutoff webs. Thus, the gripper boards (other set of the first holding means) 111*a*, 111*c* opposing the pins holding the two-stacked cutoff webs make an opening⇒closing motion, while the gripper boards (one set of the first holding means) 111*b*, 111*d* opposing the pins holding no cutoff webs remain open.

In the cam holder 126, a segment gear 133 is integrally formed, and a gear 134 meshing with the segment gear 133 is fixedly provided on a shaft of a handle 135. Thus, the cam holder 126 (second main cam 128) can pivot, but can be fixed at predetermined two positions by a clamp 136. In the bearing inner metal 130, a segment gear 137 is integrally formed, and a gear 138 meshing with the segment gear 137 is fixedly provided on a shaft of a handle (not shown). Thus, the bearing inner metal 130 (second sub-cam 132) can also pivot, but can be fixed at predetermined two positions by a clamp (not shown), as can the cam holder 126 (second main cam 128).

A cam follower 140 attached to the shaft end of the gripper board shaft 110*a* follows the first main cam 123 (that is, the gripper board 111*a* on the gripper board shaft 110*a* acts according to a gripper board opening curve 123*a* and a gripper board closing curve 123*b* of the first main cam 123). On the other hand, a cam follower 141 attached to the shaft end of the gripper board shaft 110*c* follows the first main cam 123 and the second sub-cam 132 (that is, the gripper board 111*c* on the gripper board shaft 110*c* acts according to the gripper board opening curve 123*a* and the gripper board closing curve 123*b* of the first main cam 123, and a gripper board closing curve 132*a* of the second sub-cam 132).

A cam follower 142 attached to the shaft end of the gripper board shaft 110*b* or 110*d* follows the second main cam 128 and the first sub-cam 125 (that is, the gripper boards 111*b*, 111*d* on the gripper board shafts 110*b*, 110*d* act according to gripper board opening curves 128*a*1, 128*a*2 and gripper board closing curves 128*b*1, 128*b*2 of the second main cam 128, and a gripper board closing curve 125*a* of the first sub-cam 125).

The upper transfer cylinder 14 and the lower transfer cylinder 15 are provided with cam mechanisms (first and second cam mechanisms) for opening and closing the grippers 113*a* to 113*d* and the grippers 115*b*, 115*d*, although this is not illustrated. As the cam mechanism of the upper transfer cylinder 14, in particular, there are a gripper sub-cam for opening and closing the gripper 113*c* (see the gripper sub-cam 96 of FIG. 3), a gripper sub-cam for opening and closing the gripper 113*b*, and a gripper sub-cam for opening and closing the gripper 113*d*. During upper-lower two-stage delivery in non-collect folding, the gripper sub-cams for the grippers 113*b* and 113*d* do not permit a grip closing motion at the position opposing the gripper boards 111*b*, 111*d* of the jaw cylinder 12. During upper-lower two-stage delivery in collect folding, the gripper sub-cam for the gripper 113*c* does not permit a grip closing motion at the position opposing the gripper board 111*c* of the jaw cylinder 12.

A phase switching mechanism, such as a harmonic gear drive apparatus explained in Embodiment 1, is provided between the jaw cylinder 12 and the lower transfer cylinder 15. During upper-lower two-stage delivery in collect folding, the phase of the lower transfer cylinder 15 is switched by 90 degrees to bring the gripper boards 111*b*, 111*d* of the jaw cylinder 12 and the grippers 115*b*, 115*d* of the lower transfer cylinder 15 into an opposing state, thereby making the transfer of the signature possible.

Because of the above features, during upper-lower two-stage delivery in non-collect folding, the second main cam 128 is pivoted with respect to the fixed first main cam 123 and the fixed first sub-cam 125 to position the gripper board closing curve 128*b*1 of a longer dimension between the upper transfer cylinder 14 and the lower transfer cylinder 15, as shown in FIGS. 30, 34 and 36.

As a result, the gripper board 111*a* of the jaw cylinder 12 makes an opening and closing motion according to the first main cam 123, and the gripper board 111*c* makes an opening and closing motion according to the first main cam 123 and the second sub-cam 132. Thus, a gripper board closing motion is made between the folding cylinder 11 and the jaw cylinder 12, and a gripper board opening motion is made between the jaw cylinder 12 and the upper transfer cylinder 14 to pass the signature onto the grippers 113*a*, 113*c* of the upper transfer cylinder 14.

On the other hand, the gripper boards 111*b*, 111*d* of the jaw cylinder 12 make an opening and closing motion according to the second ma in cam 128 and the first sub-cam 125, and thus make a gripper board closing motion according to the gripper board closing curve 128*b*2 of a shorter dimension between the folding cylinder 11 and the jaw cylinder 12, and make a gripper board opening motion according to the gripper board opening curve 128*a*2 between the jaw cylinder 12 and the lower transfer cylinder 15, thereby passing the signature on to the grippers 115*b*, 115*d* of the lower transfer cylinder 15. On this occasion, at the gripper board opening curve 128*a*1 of the second main cam 128, the grippers 11*b*, 111*d* are not opened by the first sub-cam 125.

In the above-described manner, the signatures gripped by the gripper boards 111*a*, 111*c* of the jaw cylinder 12 are passed on to the grippers 113*a*, 113*c* of the upper transfer cylinder 14, and transported to the upper chopper folding apparatus 16, where the signatures are chopper folded, and delivered. On the other hand, the signatures gripped by the gripper boards 110*b*, 111*d* of the jaw cylinder 12 are passed on to the grippers 115*b*, 115*d* of the lower transfer cylinder 15, and transported to the lower chopper folding apparatus 17, where the signatures are chopper folded, and delivered.

During upper one-stage delivery in non-collect folding, the second main cam 128 is pivoted with respect to the fixed first main cam 123 and the fixed first sub-cam 125 to position the gripper board closing curve 128 *b*1 of a longer dimension between the folding cylinder 11 and the upper transfer cylinder 14, as shown in FIGS. 31, 34 and 37.

As a result, the gripper board 111*a* of the jaw cylinder 12 makes an opening and closing motion according to the first main cam 123, and the gripper board 111*c* makes an opening and closing motion according to the first main cam 123 and the second sub-cam 132. Thus, a gripper board closing motion is made between the folding cylinder 11 and the jaw cylinder 12, and a gripper board opening motion is made between the jaw cylinder 12 and the upper transfer cylinder 14 to pass the signature on to the grippers 113*a*, 113*c* of the upper transfer cylinder 14.

On the other hand, the gripper boards 111*b*, 111*d* of the jaw cylinder 12 make an opening and closing motion according to the pivoted second main cam 128 and the first sub-cam 125, and thus make a gripper board closing motion according to the gripper board closing curve 128*b*1 of a longer dimension in the second main cam 128 between the folding cylinder 11 and the jaw cylinder 12. A gripper board opening motion according to the gripper board opening curve 128*a*2 in the pivoted second main cam 128 changes from between the jaw cylinder 12 and the lower transfer cylinder 15 to between the jaw cylinder 12 and the upper transfer cylinder 14, thereby passing the signature on to the grippers 113*b*, 113*d* of the upper transfer cylinder 14.

In the above-described manner, the signatures gripped by the gripper boards 111*a* to 111*d* of the jaw cylinder 12 are passed on to the grippers 113*a* to 113*d* of the upper transfer cylinder 14, and all transported to the upper chopper folding apparatus 16, where the signatures are chopper folded, and delivered.

During upper one-stage delivery in collect folding, the second main cam 128 is pivoted with respect to the fixed first main cam 123 and the fixed first sub-cam 125 to displace the gripper board closing curve 128 *b*1 of a longer dimension slightly toward a downstream side from the aforementioned position between the folding cylinder 11 and the upper transfer cylinder 14, as shown in FIGS. 32, 34 and 38.

As a result, the gripper board 111*a* of the jaw cylinder 12 makes an opening and closing motion according to the first main cam 123, and the gripper board 111*c* makes an opening and closing motion according to the first main cam 123 and the second sub-cam 132. Thus, a gripper board closing motion is made between the folding cylinder 11 and the jaw cylinder 12, and a gripper board opening motion is made between the jaw cylinder 12 and the upper transfer cylinder 14 to pass the signatures on to the grippers 113*a*, 113*c* of the upper transfer cylinder 14, as in the above-mentioned manner. It is to be noted here that the signatures are held as stacks of two signatures each by the gripper boards 111*a*, 111*c* of the jaw cylinder 12. Thus, the signatures are transported only from the gripper boards 111*a*, 111*c* of the jaw cylinder 12 to the grippers 113*a*, 113*c* of the upper transfer cylinder 14.

On the other hand, the gripper board closing motion between the folding cylinder 11 and the jaw cylinder 12 is shifted according to the gripper board opening curve 128*a*1 because of the above-mentioned displacement (pivoting) of the second main cam 128. Thus, the interference between the sucker blades (not shown) of the folding cylinder 11 and the gripper boards 111*b*, 111*d* of the jaw cylinder 12 is avoided, and the wear of and damage to the sucker blades and the grippers 111*b*, 111*d* are prevented.

The signatures collect folded in the above-described manner are passed on to the grippers 113*a*, 113*c* of the upper transfer cylinder 14, and are all delivered via the upper chopper folding apparatus 16 (without being chopper folded).

Finally, during upper-lower two-stage delivery in collect folding, the second sub-cam 132 is pivoted from the state of FIG. 32 to position the gripper board closing curve 132*a* between the upper transfer cylinder 14 and the lower transfer cylinder 15, as shown in FIGS. 33, 35 and 38. Also, the rotating phase of the lower transfer cylinder 15 is switched by 90 degrees by the aforementioned phase switching mechanism to bring the gripper boards 111*b*, 111*d* of the jaw cylinder 12 and the grippers 115*b*, 115*d* of the lower transfer cylinder 15 into an opposing state, thereby enabling the signatures to be transferred.

As a result, the gripper board 111*a* of the jaw cylinder 12 makes an opening and closing motion according to the first main cam 123, and the gripper board 111*c* makes an opening and closing mot ion according to the first main cam 123 and the second sub-cam 132. Thus, a gripper board closing motion is made on the alternate gripper boards between the folding cylinder 11 and the jaw cylinder 12, and a gripper board opening motion is made alternately between the jaw cylinder 12 and the upper transfer cylinder 14 and between the jaw cylinder 12 and the lower transfer cylinder 15 to pass the signatures on to the gripper 113*a* of the upper transfer cylinder 14 and the gripper 115*d* of the lower transfer cylinder 15.

In the above-described manner, the signatures gripped by the gripper boards 111*a*, 111*c* of the jaw cylinder 12 are alternately passed on to the gripper 113*a* of the upper transfer cylinder 14 and the gripper 115*d* of the lower transfer cylinder 15, and delivered alternately via the upper chopper folding apparatus 16 and the lower chopper folding apparatus 17 (without being chopper folded).

According to the present embodiment, as described above, upper-lower two-stage delivery in collect folding can be performed, as in Embodiment 1. Thus, it becomes possible to effectively achieve an increase in productivity, prolongation of the life cycles of consumable parts, a decrease in the running cost, a lighter burden on the operator's work, and a reduction in spending on plants and equipment.

Furthermore, the cylinder arrangement has been changed from the six-cylinder arrangement (see FIG. 3) composed of the collecting and cutting cylinder 10, the folding cylinder 11, the jaw cylinder 12, the reduction cylinder 13, the upper transfer cylinder 14, and the lower transfer cylinder 15 to the five-cylinder arrangement composed of the collecting and cutting cylinder 10, the folding cylinder 11, the jaw cylinder 12, the upper transfer cylinder 14, and the lower transfer cylinder 15. This decrease in the number of the cylinders leads to downsizing of the apparatus. Besides, the configuration of the folding specification switching portion is simplified because of the cam mechanism 120, and the number of the components can be cut down. Thus, the switching time is shortened, and the manufacturing cost is reduced.

INDUSTRIAL APPLICABILITY

The sheet transport apparatus according to the present invention is preferred when used not only in a folder of a web rotary printing press, but also as a sheet transport apparatus in various machines.

The invention claimed is:

1. A sheet transport apparatus, comprising:

a folding cylinder for transporting sheets one by one or as a stack of a plurality of the sheets;

a first transport cylinder having first holding means, which holds the sheet, at a plurality of locations in a circumferential direction, and being adapted to hold the sheets by all of the first holding means and transport the sheets when the sheets are transported one by one, and hold the sheets by alternate ones of the first holding means and transport the sheets when the sheets are transported as the stack of the plurality of sheets;

a second transport cylinder opposing the first transport cylinder, having second holding means, which holds the sheet, at a plurality of locations in a circumferential direction, and being supported rotatably;

a third transport cylinder opposing the first transport cylinder, having third holding means, which holds the sheet, at a plurality of locations in a circumferential direction, and being supported rotatably; and a switching unit that switches transport paths, such that when the sheets are transported one by one, the sheets held by all of the first holding means are alternately transported to the second holding means and the third holding means, and when the sheets are transported as a stack, the sheets held by alternate ones of the first holding means are alternately transported to the second holding means and the third holding means.

2. The sheet transport apparatus according to claim 1, wherein the switching unit switches the transport paths so as to transport the stack of the plurality of sheets from the first transport cylinder to one of the second transport cylinder and the third transport cylinder.

3. The sheet transport apparatus according to claim 1, wherein the switching unit switches the transport paths so as to transport the sheets, transported one by one, from the first transport cylinder to the second transport cylinder and from the first transport cylinder to the third transport cylinder, while allocating the sheets to the second transport cylinder and to the third transport cylinder.

4. The sheet transport apparatus according to claim 1, wherein the switching unit switches the transport paths so as to transport the sheets, transported one by one, from the first transport cylinder to one of the second transport cylinder and the third transport cylinder.

5. The sheet transport apparatus according to claim 1, wherein the first transport cylinder comprises a sextuple-diameter cylinder having the first holding means at six locations, the second transport cylinder comprises a quadruple-diameter cylinder having the second holding means at two locations, and the third transport cylinder is provided downstream, in a rotating direction of the first transport cylinder, of an opposing position where the first transport cylinder and the second transport cylinder oppose, and comprises a quadruple-diameter cylinder having the third holding means at two locations.

6. The sheet transport apparatus according to claim 1, wherein the first transport cylinder includes:

a first fixed cam for operating one set of the alternately arranged first holding means of the first holding means to transport the sheets, transported one by one, to the second transport cylinder;

a rotating cam for operating alternate ones of other set of the first holding means arranged between the one set of the first holding means to transport the sheets, transported as the stack of the plurality of sheets, to the second transport cylinder, the rotating cam rotating at a speed 1.5 times a speed of the first transport cylinder;

a second fixed cam for operating the other set of the first holding means to transport the sheets, transported one by one or as the stack of the plurality of sheets, to the third transport cylinder; and a phase switching mechanism for switching the second holding means between a position where the second holding means oppose the one set of the first holding means and a position where the second holding means oppose the other set of the first holding means.

7. The sheet transport apparatus according to claim 6, wherein the second transport cylinder includes:

a third fixed cam for operating the second holding means so as to transport the sheets transported from the one set of the first holding means operated by the first fixed cam, and for operating the second holding means so as to transport the sheets, transported as the stack of the plurality of sheets, from the other set of the first holding means operated by the rotating cam; and a moving cam for preventing the second holding means from making a receiving motion for the stack of the plurality of sheets held by the first holding means of the other set of the first holding means not operated by the rotating cam, and the third transport cylinder includes a fourth fixed cam for operating the third holding means which transports the sheets, transported one by one or as the stack of the plurality of sheets, from the other set of the first holding means operated by the second fixed cam.

8. The sheet transport apparatus according to claim 1, wherein the first transport cylinder comprises a quadruple-diameter cylinder having the first holding means at four locations, the second transport cylinder comprises a quadruple-diameter cylinder having the second holding means at four locations, and the third transport cylinder is provided downstream, in a rotating direction of the first transport cylinder, of an opposing position where the first transport cylinder and the second transport cylinder oppose, and comprises a quadruple-diameter cylinder having the third holding means at two locations.

9. The sheet transport apparatus according to claim 1, wherein the first transport cylinder includes:

a first fixed cam for operating other set of the alternately arranged first holding means of the first holding means to transport the sheets, transported one by one or as the stack of the plurality of sheets, to the second transport cylinder;

a movable second pivoting cam for operating alternate ones of the other set of the first holding means to transport the sheets, transported as the stack of the plurality of sheets, to the third transport cylinder;

a movable first pivoting cam and a second fixed cam for operating one set of the first holding means arranged between the other set of the first holding means to transport the sheets, transported one by one, to the second transport cylinder or to the third transport cylinder; and a phase switching mechanism for switching the third holding means between a position where the third holding means oppose the one set of the first holding means and a position where the third holding means oppose the other set of the first holding means.

10. The sheet transport apparatus according to claim 9, wherein the second transport cylinder operates the second holding means so as to transport the sheets, transported one by one or as the stack of the plurality of sheets, from the other set of the first holding means operated by the first fixed cam, and operates the second holding means so as to transport the sheets, transported one by one, from the one set of the first holding means operated by the first pivoting cam; and the third transport cylinder operates the third holding means so as to transport the sheets, transported as the stack of the plurality of sheets, from the alternate ones of the other set of the first holding means operated by the second pivoting cam, and operates the third holding means so as to transport the sheets, transported one by one, from the one set of the first holding means operated by the first pivoting cam.

11. The sheet transport apparatus according to claim 1, wherein the first holding means of the first transport cylinder comprise at least two of one set of the first holding means for holding the sheets transported one by one, and at least two of other set of the first holding means, provided between the one set of the first holding means, for holding the sheets transported one by one and the sheets transported as the stack of the plurality of the sheets, and the switching unit comprises a pivoting cam for operating alternate ones of the other set of the first holding means, upon pivoting, to make a transfer motion from the other set of the first holding means for holding the sheets, transported as the stack of the plurality of the sheets, to the second holding means of the second transfer cylinder, and a fixed cam for making a transfer motion from the first holding means of the other set of the first holding means, which have not been operated by the pivoting cam, to the third holding means of the third transport cylinder past the second holding means of the second transport cylinder.

12. The sheet transport apparatus according to claim 1, wherein the first holding means of the first transport cylinder comprise at least two of one set of the first holding means for holding the sheets transported one by one, and at least two of other set of the first holding means, provided between the one set of the first holding means, for holding the sheets transported one by one and the sheets transported as the stack of the plurality of the sheets, and the switching unit comprises a fixed cam for making a transfer motion from the other set of the first holding means for holding the sheets, transported as the stack of the plurality of the sheets, to the second holding means of the second transfer cylinder, and a pivoting cam for making a transfer motion from the other set of the first holding means to the third holding means of the third transport cylinder past the second holding means of the second transport cylinder by operating alternate ones of the sheets transported as the stack of the plurality of the sheets which are subjected to the transfer motion from the other set of the first holding means to the second holding means of the second transport cylinder by the fixed cam.

* * * * *